US012458138B2

(12) United States Patent
Nye

(10) Patent No.: US 12,458,138 B2
(45) **Date of Patent: *Nov. 4, 2025**

(54) TWO-STAGE LOCK ASSEMBLY

(71) Applicant: Lifetime Products, Inc., Clearfield, UT (US)

(72) Inventor: S. Curtis Nye, Clinton, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/420,631

(22) Filed: Jan. 23, 2024

(65) Prior Publication Data

US 2024/0156249 A1 May 16, 2024

Related U.S. Application Data

(63) Continuation of application No. 16/923,924, filed on Jul. 8, 2020, now Pat. No. 11,896,119.

(60) Provisional application No. 62/872,240, filed on Jul. 9, 2019.

(51) Int. Cl.
*A47B 3/08* (2006.01)
*A47B 3/087* (2006.01)

(52) U.S. Cl.
CPC ..... *A47B 3/0812* (2013.01); *A47B 3/087* (2013.01)

(58) Field of Classification Search
CPC ..... A47B 3/0812; A47B 3/087; A47B 3/0915; A47B 3/0818; A47B 3/0916
USPC ..... 108/115
See application file for complete search history.

(56) References Cited

U.S. PATENT DOCUMENTS

| | | | |
|---|---|---|---|
| 1,063,642 | A | 6/1913 | Birdsall |
| 2,875,007 | A | 2/1959 | Fox |
| 3,027,209 | A | 3/1962 | Nielsen |
| 3,410,232 | A | 11/1968 | Krueger |
| 3,554,141 | A | 1/1971 | Burr |

(Continued)

FOREIGN PATENT DOCUMENTS

| | | | |
|---|---|---|---|
| FR | 2573467 | A1 | 5/1986 |
| FR | 2807632 | A1 | 10/2001 |
| JP | 1998179261 | A | 7/1998 |

OTHER PUBLICATIONS

International Search Report and Written Opinion mailed Aug. 21, 2020, from PCT Application No. PCT/US2020/041414.

(Continued)

*Primary Examiner* — Daniel J Troy
*Assistant Examiner* — Timothy M Ayres
(74) *Attorney, Agent, or Firm* — Maschoff Brennan

(57) ABSTRACT

A two-stage lock assembly comprising a multi-element lock tab configured for disposition in a lateral structure of a lock device. The multi-element lock tab may include a body that includes an end on which a first element and a second element are disposed. The first element may extend from the body farther than the second element to enable the first element to be introduced into a receiver prior to the second element. The multi-element lock tab may be configurable in a disengaged configuration in which the first element and the second element are not positioned in a receiver, a first engaged configuration in which the first element is positioned in the receiver and the second element is not, and a second engaged configuration in which the first and the second elements are positioned in the receiver.

19 Claims, 36 Drawing Sheets

(56) References Cited

U.S. PATENT DOCUMENTS

| | | | |
|---|---|---|---|
| 4,974,871 | A | 12/1990 | Mao |
| 5,490,467 | A | 2/1996 | Diffrient |
| 5,878,863 | A | 3/1999 | Madden |
| 6,032,585 | A | 3/2000 | Pinch |
| 6,044,775 | A | 4/2000 | Lashlee |
| 6,912,961 | B2 | 7/2005 | Winter |
| 6,968,789 | B2 | 11/2005 | Baik |
| 6,971,321 | B1 | 12/2005 | Strong |
| 7,051,662 | B2 | 5/2006 | Shenghao |
| 7,059,254 | B2 | 6/2006 | Strong |
| 7,096,799 | B2 | 8/2006 | Strong |
| 7,111,563 | B2 | 9/2006 | Strong |
| 7,278,361 | B2 | 10/2007 | Zhurong |
| 7,331,297 | B2 | 2/2008 | Strong |
| 7,461,601 | B2 | 12/2008 | Jin |
| 7,469,646 | B2 | 12/2008 | Baik |
| 7,475,643 | B2 | 1/2009 | Haney |
| 7,475,644 | B2 | 1/2009 | Strong |
| 7,475,648 | B2 | 1/2009 | Funayose |
| 7,640,870 | B2 | 1/2010 | Strong |
| 7,644,667 | B2 | 1/2010 | Strong |
| D619,831 | S | 7/2010 | Branch |
| 7,905,185 | B2 | 3/2011 | Peery |
| D640,487 | S | 6/2011 | Bennett |
| 7,971,930 | B2 | 7/2011 | Larsen |
| 8,006,630 | B2 | 8/2011 | Strong |
| 8,033,228 | B2 | 10/2011 | Haney |
| 8,156,875 | B2 | 4/2012 | Neunzert |
| D658,912 | S | 5/2012 | Winter |
| D659,450 | S | 5/2012 | Winter |
| 8,166,894 | B1 | 5/2012 | Branch |
| D662,736 | S | 7/2012 | Peery |
| D662,738 | S | 7/2012 | Winter |
| D667,659 | S | 9/2012 | Winter |
| 8,256,360 | B2 | 9/2012 | Chow |
| D668,483 | S | 10/2012 | Bennett |
| 8,302,541 | B2 | 11/2012 | Haney |
| D671,773 | S | 12/2012 | Johnson |
| D671,775 | S | 12/2012 | Clegg |
| D671,776 | S | 12/2012 | Clegg |
| D672,175 | S | 12/2012 | Peery |
| 8,342,107 | B2 | 1/2013 | Mower |
| 8,347,795 | B2 | 1/2013 | Peery |
| 8,397,652 | B2 | 3/2013 | Peery |
| 8,397,653 | B2 | 3/2013 | Ashby |
| 8,408,146 | B2 | 4/2013 | Peery |
| D681,982 | S | 5/2013 | Clegg |
| D682,586 | S | 5/2013 | Clegg |
| D683,985 | S | 6/2013 | Nye |
| 8,490,554 | B2 | 7/2013 | Jin |
| D688,496 | S | 8/2013 | Bennett |
| 8,534,205 | B1 | 9/2013 | Johnson |
| 8,544,393 | B2 | 10/2013 | Branch |
| 8,555,789 | B2 | 10/2013 | Jin |
| 8,555,790 | B2 | 10/2013 | Winter |
| 8,555,791 | B2 | 10/2013 | Jin |
| 8,578,863 | B2 | 11/2013 | Peery |
| 8,578,865 | B2 | 11/2013 | Haney |
| D696,882 | S | 1/2014 | Clegg |
| 8,622,007 | B2 | 1/2014 | Peery |
| D700,465 | S | 3/2014 | Johnson |
| 8,683,929 | B2 | 4/2014 | Peery |
| 8,720,990 | B2 | 5/2014 | Boydston |
| 8,726,817 | B2 | 5/2014 | Bennett |
| 8,746,155 | B2 | 6/2014 | Haney |
| 8,757,069 | B2 | 6/2014 | Peery |
| D708,462 | S | 7/2014 | Nye |
| D715,081 | S | 10/2014 | Bennett |
| 8,857,349 | B2 | 10/2014 | Peery |
| 8,904,943 | B2 | 12/2014 | Jin |
| 8,943,982 | B2 | 2/2015 | Peery |
| D727,074 | S | 4/2015 | Johnson |
| 8,997,663 | B2 | 4/2015 | Peery |
| D734,081 | S | 7/2015 | Johnson |
| 9,101,209 | B2 | 8/2015 | Bennett |
| D739,672 | S | 9/2015 | Johnson |
| 9,173,482 | B2 | 11/2015 | Peery |
| 9,192,229 | B2 | 11/2015 | Peery |
| 9,192,230 | B2 | 11/2015 | Clegg |
| D748,418 | S | 2/2016 | Johnson |
| 9,277,808 | B2 | 3/2016 | Cai et al. |
| 9,307,831 | B2 | 4/2016 | Peery |
| 9,351,563 | B2 | 5/2016 | Bennett |
| D759,411 | S | 6/2016 | Johnson |
| 9,486,076 | B2 | 11/2016 | Peery |
| 9,532,644 | B2 | 1/2017 | Nye |
| 9,549,612 | B2 | 1/2017 | Peery |
| 9,642,459 | B2 | 5/2017 | Peery |
| 9,661,916 | B2 | 5/2017 | Peery |
| 9,730,514 | B2 | 8/2017 | Peery |
| 9,738,295 | B1 | 8/2017 | Horowitz |
| 9,763,513 | B2 | 9/2017 | Cai |
| 9,763,517 | B2 | 9/2017 | Peery |
| D863,853 | S | 10/2019 | Johnson |
| D864,637 | S | 10/2019 | Johnson |
| 10,470,561 | B2 | 11/2019 | Clegg et al. |
| 11,517,105 | B1 | 12/2022 | Olsen |
| 11,819,121 | B2 | 11/2023 | Olsen |
| 11,896,119 | B2 * | 2/2024 | Nye ..... A47B 3/0818 |
| 2003/0164123 | A1 | 9/2003 | Lou-Hao |
| 2004/0094076 | A1 | 5/2004 | Jin |
| 2004/0187749 | A1 | 9/2004 | Zhurong et al. |
| 2005/0235886 | A1 | 10/2005 | Koning |
| 2005/0274302 | A1 | 12/2005 | Jin et al. |
| 2006/0021551 | A1 | 2/2006 | Pleiman |
| 2006/0021553 | A1 | 2/2006 | Pleiman |
| 2013/0233210 | A1 | 9/2013 | Jin et al. |
| 2014/0208992 | A1 | 7/2014 | Cai |
| 2015/0020716 | A1 | 1/2015 | Tsai |
| 2015/0282606 | A1 | 10/2015 | Tsai |
| 2016/0183673 | A1 | 6/2016 | Cai et al. |
| 2017/0013956 | A1 | 1/2017 | Tsai |
| 2020/0214440 | A1 | 7/2020 | Johnson |
| 2021/0007474 | A1 | 1/2021 | Nye |
| 2022/0395089 | A1 | 12/2022 | Nye |
| 2024/0081521 | A1 | 3/2024 | Olsen |

OTHER PUBLICATIONS

Australian Examination Report Application No. 2024201802; dated Apr. 16, 2025; 7 pages.

* cited by examiner

TWO-STAGE LOCK ASSEMBLY

CROSS-REFERENCE TO RELATED APPLICATIONS

The present application is a continuation of U.S. patent application Ser. No. 16/923,924, which was filed on Jul. 8, 2002, which claims priority to and the benefit of U.S. Provisional Patent Application Ser. No. 62/872,240, entitled TWO-STAGE LOCK ASSEMBLY, which was filed on Jul. 9, 2020, each of which is incorporated by reference in its entirety.

BACKGROUND

Field of the Invention

The present invention generally relates to furniture, such as tables, benches, and chairs, and, in particular, to improved leg assemblies that may be implemented in tables, benches, and other structures.

Description of Related Art

Many different types of tables are well known and used for a variety of different purposes. For example, conventional tables may include legs that are pivotally attached to a tabletop and the legs may be movable between a use position in which the legs extend outwardly from the tabletop and a storage position in which the legs are folded against the tabletop. Conventional tables with relatively large tabletops and folding legs are often referred to as "banquet tables" and these tables are frequently used in assembly halls, banquet halls, convention centers, hotels, schools, churches, and other locations where large groups of people meet. These types of tables can often be positioned in an assortment of different configurations and used in a variety of settings. When the banquet tables are no longer needed, the table legs can be moved into the storage position and the tables may be more easily moved or stored.

Because most banquet tables have a length between six and ten feet and a width between three and four feet, the required storage area for such tables is quite large even with the legs in the collapsed position. This large storage area may be problematic for businesses or facilities such as hotels, schools, and churches because a considerable number of these tables may have to be stored.

Conventional tables often include tabletops constructed from materials such as wood, particleboard, or metal. Table tops constructed from wood, particleboard, or metal, however, are often relatively heavy and this may make the table awkward or difficult to move. Tabletops constructed from wood or metal are also relatively expensive, and these types of tabletops must generally be treated or finished before use. For example, tabletops constructed from wood must generally be sanded and painted, and metal tabletops must be formed into the desired shape and painted. In addition, because these wooden and metal tabletops are relatively heavy, the cost of shipping and transportation of the tables may be increased. The weight of the tabletop may make the tables more difficult to move and store.

In order to decrease the weight of conventional tables, tabletops may be constructed from relatively lightweight materials such as plastic. Disadvantageously, tabletops constructed from lightweight materials may require large reinforcing members or other structural parts such as braces, brackets, support members and the like to strengthen the tabletop. While these additional parts may increase the strength of the tabletop, the added parts may also increase the weight of the table. These additional parts may result in increased manufacturing costs and require additional time to assemble the table. In addition, extra fasteners may be required to assemble and connect these parts to the table, which may require extra time and labor during the manufacturing process. The additional parts and fasteners may further increase the cost of the table and make the table more difficult to manufacture. Moreover, these additional parts and fasteners may have sharp edges that can injure a user's legs or arms.

Conventional tables may include a frame that is connected to the tabletop. The frame may include a pair of side rails connected to sides of the tabletop using fasteners. Multiple fasteners may be required to securely connect the frame to the tabletop and transmit forces applied to the tabletop to the frame. Undesirably, when a relatively large load or force is applied to some known tables, the frame may bend, deform, and/or detach from the tabletop. In addition, the fasteners used to connect the frame to the tabletop may detach or separate from the tabletop. The fasteners may even damage and tear through the tabletop if the load or force exceeds a certain amount. Further, the frames or fasteners of some known tables may collapse in some circumstances.

Additionally, conventional tables may include frames with components that help stabilize the table when the table is being used. These components may extend into the volume or space disposed below the tabletop. The components may also be disposed underneath the tabletop and between the table legs. The components may restrict or limit a user's placement of his or her legs below the tabletop, restrict a number of chairs placed below the tabletop, or restrict a number of users who can comfortably sit at the table.

Support structures, such as leg assemblies, in some conventional tables may be configured to fold relative to a tabletop. For example, these tables may be configured in a storage arrangement in which the support structures are folded against the tabletop and in a use arrangement in which the support structures are arranged substantially normal to the tabletop. In some existing tables, the support mechanisms may be engaged only when a leg assembly is disposed at a ninety-degree (90°) angle relative to the tabletop. In these tables, when a user is configuring the table in use arrangement, the table may be placed on a top surface or side surface of the tabletop such that the leg assembly is accessible. The user may then rotate the leg assembly relative to the tabletop. When the leg assembly is disposed at a ninety-degree (90°) angle relative to the tabletop, the leg assembly may be locked.

In some circumstances, the leg assembly may not be rotated sufficiently relative to the tabletop. For example, a user may erroneously think that the leg assembly is locked, but one or more mechanisms of the leg assembly may not be properly or fully engaged. Insufficient rotation or an improperly locked leg assembly may result in the leg assembly being disposed in an unlocked position. For instance, without the table locked, a force applied to the table or a load placed on the table may cause the leg assembly to rotate relative to the tabletop (e.g., unexpectedly rotate towards the tabletop). Thus, the table or a portion of the table may collapse.

The subject matter claimed herein is not limited to embodiments that solve any disadvantages or that operate only in environments, such as those described. Rather, this background is only provided to illustrate one example technology area where some embodiments described herein may be practiced.

BRIEF SUMMARY

A need therefore exists for a table that eliminates or diminishes the above-described disadvantages and problems.

An aspect is a table that may include two or more components such as a tabletop, a lateral structure, a frame, a leg assembly, and/or a brace member. The tabletop may include a first end, a second end (which may be opposite the first end), and a center portion that may be disposed substantially equidistant from the first end and the second end. The tabletop may include a first distance which may be measured between the first end and the center. The tabletop may be constructed from blow-molded plastic and may be formed as part of a unitary, one-piece construction during a blow-molding process. Additionally, the tabletop may include two tabletop portions, which may have generally the same sizes or different sizes. The two tabletop portions may be configured to be arranged in a storage configuration in which the two tabletop portions are substantially parallel to one another. Also, the two tabletop portions may be arranged in use configuration in which the two tabletop portions are disposed in a generally planar configuration and/or arranged in a plane. One or both of the tabletop portions may be constructed from blow-molded plastic and may be formed as part of the unitary, one-piece construction during a blow-molding process. The frame may be attached to a lower surface of the tabletop. The frame may include a first longitudinal structure that extends along a first side of the tabletop and a second longitudinal structure that extends along a second side of the tabletop. The first longitudinal structure may be separated from the second longitudinal structure by a particular distance such as a lateral frame dimension. The leg assembly may include a support element, a translation mechanism, and a lock device. The support element may include an end structure and the end structure may be attached to an elongated structure. The end structure may be rotatably coupled to the frame. The support element may be rotatable relative to the frame between a first position and a second position, and at least a portion of the support element may be substantially fixed at a position on the frame. The first position may be a stored position in which the leg assembly is positioned adjacent to or at least proximate the lower surface of the tabletop. The second position may be a use configuration in which the leg assembly is disposed substantially perpendicular to the tabletop. The end structure may be rotatably coupled to the frame at a second distance from the first end of the tabletop. Also, the end structure may be rotatably coupled to the frame at a first interface. The elongated structure may include a support shaft. The elongated structure may include a leg configured to be placed on a surface to support the tabletop. The elongated structure may include two legs or two support shafts; and the second distance may be between about one-fifth and one-third of the first distance. The elongated structure may include two support shafts, which may extend from the end structure. The two support shafts may be separated by a shaft support separation distance. The shaft support separation distance may be less than the lateral frame dimension such that the brace member extends in a lateral direction from the frame to one of the two support shafts. The support element may define a receiver on an inner surface. The receiver may be sized and shaped to receive a lock tab that may extend from a lock device when the lock device is in the engaged arrangement. The translation mechanism may be retained relative to the support element and the frame. The translation mechanism may be configured to translate along a portion of the support element as the support element rotates between the first position and the second position. The translation mechanism may include one or more sleeves. The one or more sleeves may at least partially surround the two legs or the two support shafts of the elongated structure. The sleeve may include a leg configured to be placed on a surface to support the tabletop. The leg may define a translation volume in which the support shaft is disposed. Alternatively, the sleeve may include a conduit, which may define a translation volume in which a portion of the elongated structure, such as a leg, is disposed. In detail, when the support element is in the first position, the translation mechanism may be disposed at a first distance from the end structure. Additionally, when the support element is in the second position, the translation mechanism may be disposed at a second distance from the end structure. The first position may be closer to the end structure than the second position. The lateral structure may extend between translation mechanisms. For instance, the lateral structure may extend from a first leg of the two legs to a second leg of the two legs, or from a first support shaft of the two support shafts to a second support shaft of the two support shafts. The lock device may be at least partially disposed in the lateral structure. The lock device may be configurable in an engaged arrangement. In the engaged arrangement, the lock device may fix the translation mechanism to the support element. The lock device may be configurable in a disengaged arrangement. In the disengagement arrangement, the translation mechanism may not be fixed relative to the support element. The lock device may include a compression mechanism. The compression mechanism may be configured to withdraw one or more lock tabs and the lock tabs may extend from the lateral structure into the support element. The brace member may be rotatably attached to the frame and to the translation mechanism. The brace member may be disposed between the frame and an outer portion of the translation mechanism. When the support element is in the first position, the brace member may be positioned at an angle relative to the support element and the frame. When the support element is in the second position, the brace member may be substantially parallel to the frame and the support element. The brace member may be rotatably coupled to the frame at a second interface. The second interface may be disposed between the center of the tabletop and the first interface. The brace member may be positioned between the elongated structure and the first longitudinal structure or between the elongated structure and the second longitudinal structure.

Another aspect is a support assembly and an exemplary embodiment of the support assembly may include a frame, a support element, a translation mechanism, a lock device, a brace member, and/or a lateral structure. The frame may include a first longitudinal structure and a second longitudinal structure. The first longitudinal structure and the second longitudinal structure may be separated by a distance, such as a lateral frame dimension. The support element may be rotatably coupled to the first longitudinal structure and the second longitudinal structure. The support element may be rotatable relative to the frame between a first position and a second position. The support element may be substantially fixed at a position on the frame. The support element may include an end structure and an elongated structure may be attached to the end structure. The elongated structure may include a leg and the leg may be configured to be placed on a surface to support the frame. The elongated structure may include a support shaft. The support element may define a receiver on an inner surface. The receiver may be sized and shaped to receive a lock tab and the lock tab may extend from the lock device when the lock device is configured in the engaged arrangement. The translation mechanism may be configured to translate along a portion of the support element as the support element rotates relative to the frame. The translation mechanism may include a sleeve that at least partially surrounds a structure of the support element. The sleeve may include a leg configured to be placed on a surface to support the tabletop. The leg may define at least a portion of a translation volume in which the support shaft is disposed. The sleeve may alternatively include a conduit and the conduit may define at least a portion of a translation volume in which a portion of the elongated structure such as a leg is disposed. In detail, when the support element is in the first position, the translation mechanism may be disposed a first distance from the end structure. When the support element is in the second position, the translation mechanism may be disposed a second distance from the end structure. The first portion and/or the first distance may be closer to the end structure than the second position and/or the second distance. The lock device may be configurable in an engaged arrangement. In the engaged arrangement, the lock device may fix the translation mechanism relative to the support element. The lock device may be configurable in a disengaged arrangement. In the disengaged arrangement, the lock device may not fix the translation mechanism relative to the support element. The lock device may be biased in the engaged arrangement when the support element is in the first position. The brace member may be disposed between the frame and an outer portion of the translation mechanism. The brace member may be rotatably attached to the frame and to the translation mechanism. The lateral structure may be attached to the translation mechanism. The lock device may be at least partially disposed in the lateral structure. The lock device may include a compression mechanism. The compression mechanism may be configured to withdraw lock tabs that extend from the lateral structure into the support element.

Some benefits of the table, support assembly, and the like may include increasing a volume below the tabletop of a table. For instance, the leg assemblies or the support assemblies may move brace members and other components of the leg assemblies or the support assemblies outside of the volume below the tabletop. For instance, the brace members may be moved to or towards the edges and the lateral element may be moved towards the lower surface of the tabletop. Accordingly, one or more of the components of the leg assemblies and the support assemblies may not interfere with legs of the user, or with chairs or other objects placed below the tabletop.

Another aspect is a table and the table may be comprised of multiple components such as a tabletop, a frame, and/or a leg assembly. The frame may be attached to a lower surface of the tabletop. The leg assembly may include two or more components such as a support element, a translation mechanism, and/or a two-stage lock assembly. The support element may include an end structure attached to an elongated structure. The end structure may be rotatably coupled to the frame such that the support element may be rotatable relative to the frame between a first position and a second position, and the support element may be substantially fixed at a position on the frame. The translation mechanism may be retained relative to the support element and the frame. The translation mechanism may be configured to translate along a portion of the support element as the support element rotates between the first position and the second position. The two-stage lock assembly may include a multi-element lock tab having a body and an end on which a first element and a second element are disposed. The two-stage lock assembly may be configurable in a disengaged configuration in which the translation mechanism is not fixed relative to the support element, a second engaged configuration in which the two-stage lock assembly fixes the translation mechanism to the support element, and a first engaged configuration in which the first element is positioned in a receiver which may be defined in the support element and the second element is not positioned in the receiver. The positioning of the first element in the receiver in the first engaged configuration may prevent an unintentional collapse of the tabletop when the leg and the end structure are not rotated to the second engagement angle. The elongated structure may include a support shaft. The translation mechanism may include a leg that defines a translation volume in which the support shaft is disposed. The leg assembly may be configured such that the disengaged configuration occurs when the leg and the end structure is disposed between an angle of about zero to a first engagement angle at which the first element is introduced to the receiver, the first engaged configuration may occur when the leg and the end structure are positioned in a range from the first engagement angle and a second engagement angle, and the second engaged configuration may occur when the leg and the end structure are positioned at the second engagement angle at which the second element enters the receiver. The first engagement angle may be between about 69 degrees and about 89 degrees. The second engagement angle may be between about 88 degrees and about 95 degrees. The multi-element lock tab may be outwardly biased. For instance, the multi-element lock tab may be outwardly biased such that at when the leg and the end structure are rotated to the first engagement angle, the first element is pushed into the receiver and at the second engagement angle, the second element may be pushed into the receiver. In the first engaged configuration, an opening in the leg may overlap a lower portion of the receiver to enable the first element to move outwardly into the receiver. The opening may include a height that substantially corresponds to a height of the multi-element lock tab. The first element may include a first element height and the multi-element lock tab may include a second height. The first element height may include between about twenty-five percent (25%) and about fifty percent (50%) of the second height. The first element may make up a first portion of the end and the second element may make up a remaining part of the end. The multi-element lock tab may include a top and a bottom. The second element may include a portion of the end between the top and the first element and between the bottom and the first element. The first element may be positioned on a lower portion or an upper portion of the end. A top or a bottom may be sloped towards the first element. The first element may include two protrusive features. The two protrusive features may be positioned at or near a central portion of the body.

Yet another aspect is a two-stage lock assembly. The two-stage lock assembly may be configured to prevent structure collapse because of an insufficiently rotated leg assembly. The two-stage lock assembly may include one or more components such as a multi-element lock tab. The multi-element lock tab may be configured for disposition in a lateral structure of a lock device. The multi-element lock tab may include a body that includes an end on which a first element and a second element may be disposed. The multi-element lock tab may be configurable in a disengaged configuration, a first engaged configuration, and a second engaged configuration. The first element may extend from the body farther than the second element to enable the first element to be introduced into a receiver prior to the second element. The disengaged configuration may occur when the first element and the second element are not positioned in the receiver. The first engaged configuration may occur when the first element is positioned in the receiver and the second element is not positioned in the receiver. The second engaged configuration may occur when the first and the second elements are positioned in the receiver. The first element may include first element height and the multi-element lock tab may include a second height. The first element height may be between about twenty-five percent (25%) and about fifty percent (50%) of the second height. The first element may make up a first portion of the end and the second element may make up a remaining part of the end. The multi-element lock tab may include a top and a bottom. The second element may include a portion of the end disposed between the top and the first element and between the bottom and the first element.

Another aspect is a table that may include a two-stage lock assembly. The two-stage lock assembly may be configured to prevent collapse of the table because of an insufficiently rotated leg assembly. The two-stage lock assembly may include one or more components such as a multi-element lock tab. The multi-element lock tab may be configured for disposition in a lateral structure of a lock device. The multi-element lock tab may include a body that includes an end on which a first element and a second element may be disposed. The multi-element lock tab may be configurable in a disengaged configuration, a first engaged configuration, and a second engaged configuration. The first element may extend from the body farther than the second element to enable the first element to be introduced into a receiver prior to the second element. The disengaged configuration may occur when the first element and the second element are not positioned in the receiver. The first engaged configuration may occur when the first element is positioned in the receiver and the second element is not positioned in the receiver. The second engaged configuration may occur when the first and the second elements are positioned in the receiver. The first element may include first element height and the multi-element lock tab may include a second height. The first element height may be between about twenty-five percent (25%) and about fifty percent (50%) of the second height. The first element may make up a first portion of the end and the second element may make up a remaining part of the end. The multi-element lock tab may include a top and a bottom. The second element may include a portion of the end between the top and the first element and between the bottom and the first element.

Still another aspect is a table that may include a tabletop, a frame attached to the tabletop, and a leg assembly connected to the frame. The leg assembly may include a support element rotatably coupled to the frame, the support element may be rotatable between a first position and a second position; a translation mechanism translating along a portion of the support element as the support element rotates between the first position and the second position; and a two-stage lock assembly including a lock tab with a first element and a second element, the two-stage lock assembly may include a disengaged configuration in which the translation mechanism is not fixed relative to the support element, a first or a second engaged configuration in which the two-stage lock assembly fixes the translation mechanism relative to the support element, and a first or a second engaged configuration in which the first element is positioned in a receiver in the support element and the second element is not positioned in the receiver.

Some benefits of the table, leg assemblies, two-stage lock assembly, and the like may include preventing collapse or reducing a likelihood of collapse of the table in instances in which a leg assembly is not fully extended. For example, in circumstances in which a user insufficiently rotates the leg assembly, a first element of the two-stage lock assembly may engage in a receiver and reduce the likelihood of collapse of the table.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of exemplary embodiments to further illustrate and clarify the above and other aspects, advantages, and features of the present invention. It will be appreciated that these drawings depict only exemplary embodiments of the invention and are not intended to limit its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF EXEMPLARY EMBODIMENTS

The present invention is generally directed towards structures such as tables or benches. The principles of the present invention, however, are not limited to tables or benches. It will be understood that, in light of the present disclosure, the exemplary tables disclosed herein can have a variety of shapes, sizes, configurations, and/or arrangements. In addition, while the tables shown in the accompanying figures are banquet or utility tables, it will be appreciated the tables may have any suitable style or configuration such as round, personal, conference, or card tables. Further, the structures disclosed herein may be successfully used in connection with other types of furniture and/or assemblies.

Additionally, to assist in the description of exemplary embodiments of the tables, words such as top, bottom, front, rear, right and left may be used to describe the accompanying figures which may be, but are not necessarily, drawn to scale. It will further be appreciated the tables can be disposed in a variety of desired positions or orientations, and used in numerous locations, environments, and arrangements. A detailed description of exemplary embodiments of a table now follows.

Figure 1A:
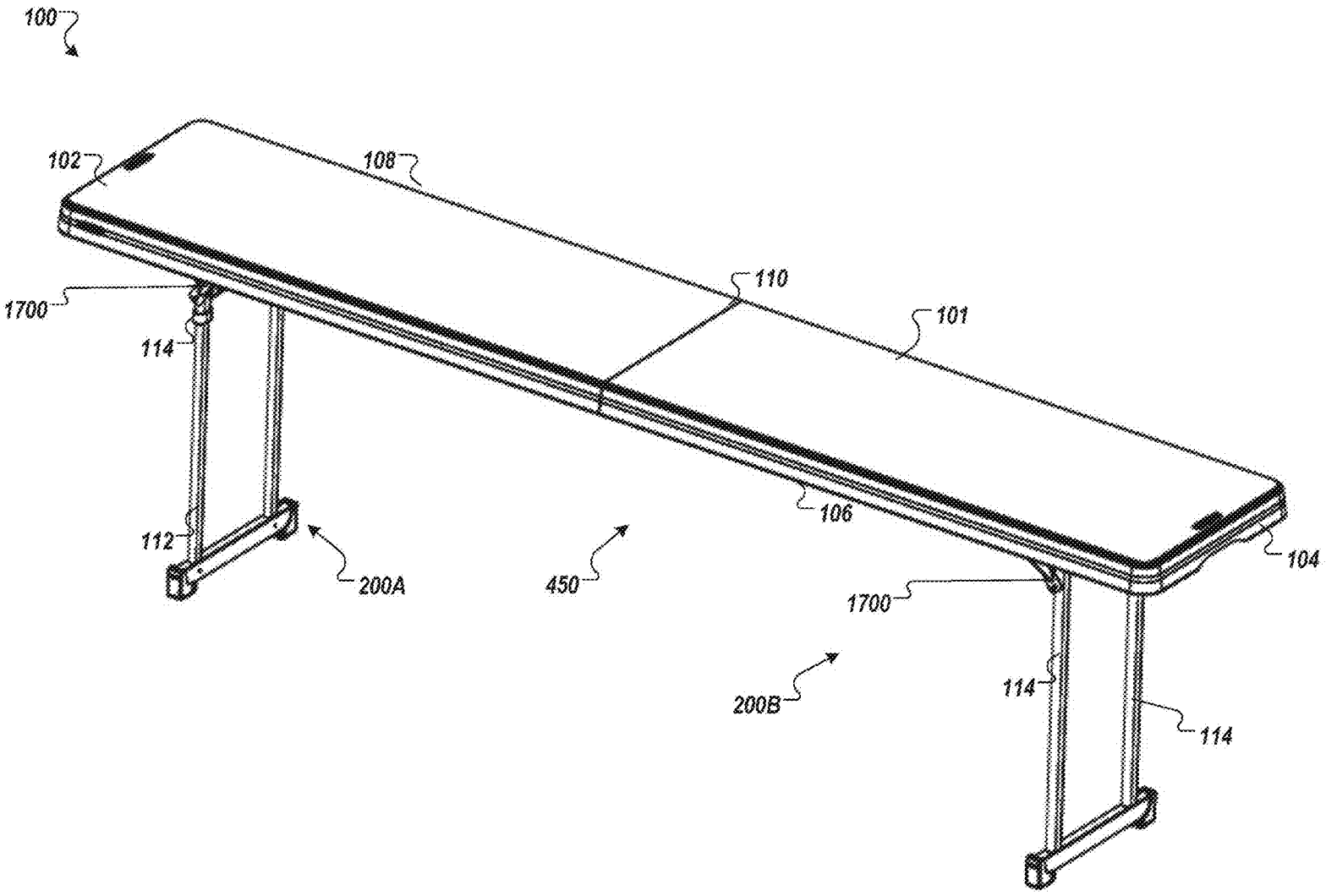
FIG. 1A illustrates an exemplary table that may implement a first and/or a second leg assembly.
Figure 1B:
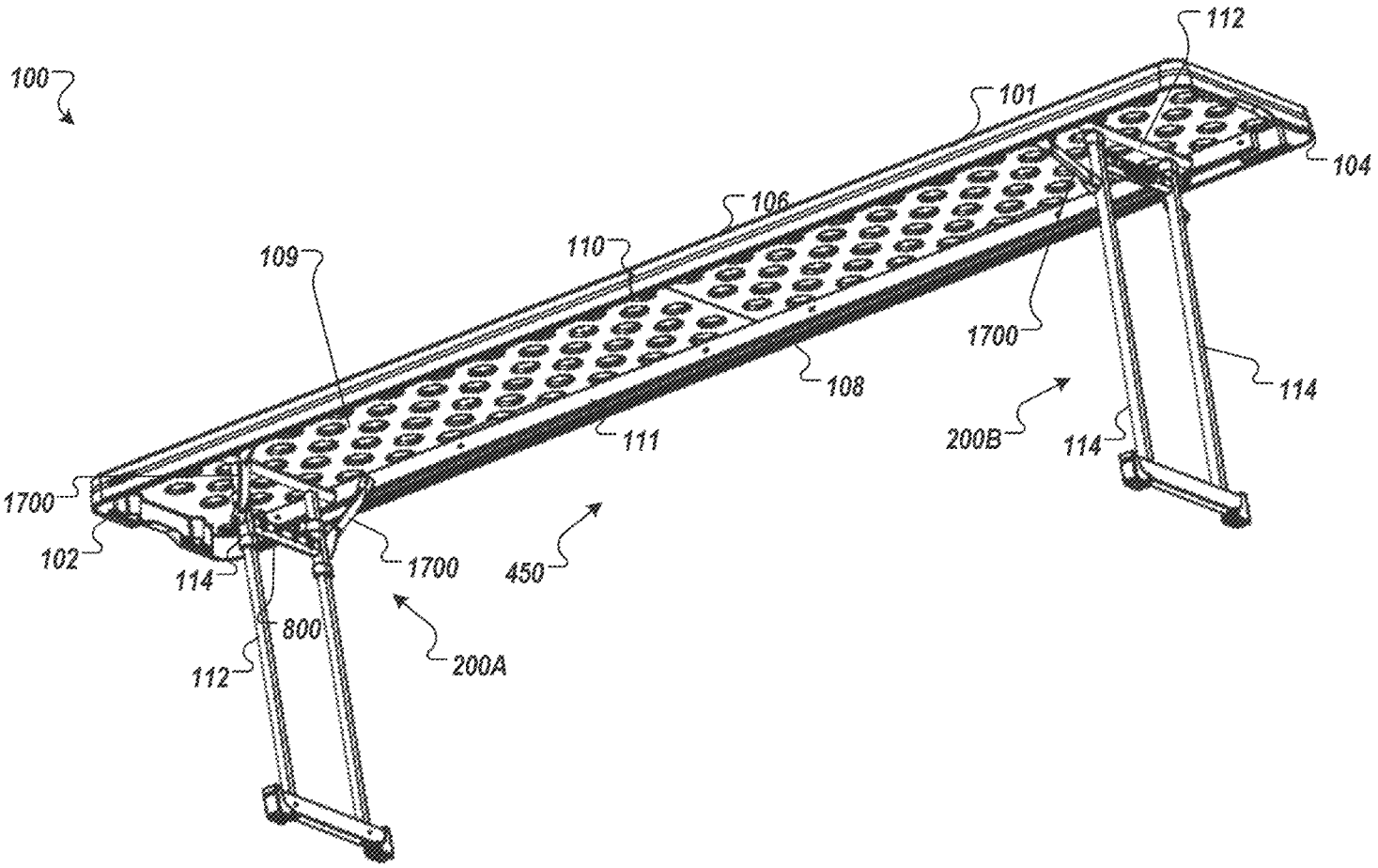
FIG. 1B is a lower perspective view of the table shown in FIG. 1A.

FIGS. 1A-1D illustrate an exemplary table 100 (which may be referred to as a first table 100) that may implement one or more leg assemblies 200A or 200B (collectively, leg assemblies or generally leg assembly 200) according to some exemplary embodiments described in the present disclosure. FIG. 2 is an enlarged view of a portion of the first table 100 depicting a first leg assembly 200A attached to an exemplary tabletop 101. As shown in FIGS. 1A-1D and 2, the first table 100 may include the tabletop 101 and one or more support assemblies, such as the support assembly 450, which may selectively support the table 100 and/or the tabletop 101 relative to a surface such as the floor or the ground. The support assembly 450 may include one or more leg assemblies 200, and the leg assemblies may be positioned in a first position and a second position. In the first position, the leg assemblies 200 may be disposed in a storage configuration in which the leg assemblies 200 are positioned adjacent to or at least proximate a lower surface 109 of the tabletop 101. Such positioning may reduce a height of the first table 100, which may reduce the volume used by the first table 100 when storing the first table 100. The second position may be a use configuration. In the second position, the leg assemblies 200 may be disposed substantially perpendicular to the lower surface 109 of the tabletop 101. The leg assemblies 200 may support the tabletop 101 such that the table 100 may be used. In FIGS. 1A-1D, the leg assemblies 200 are shown in the use configuration.

Figure 1C:
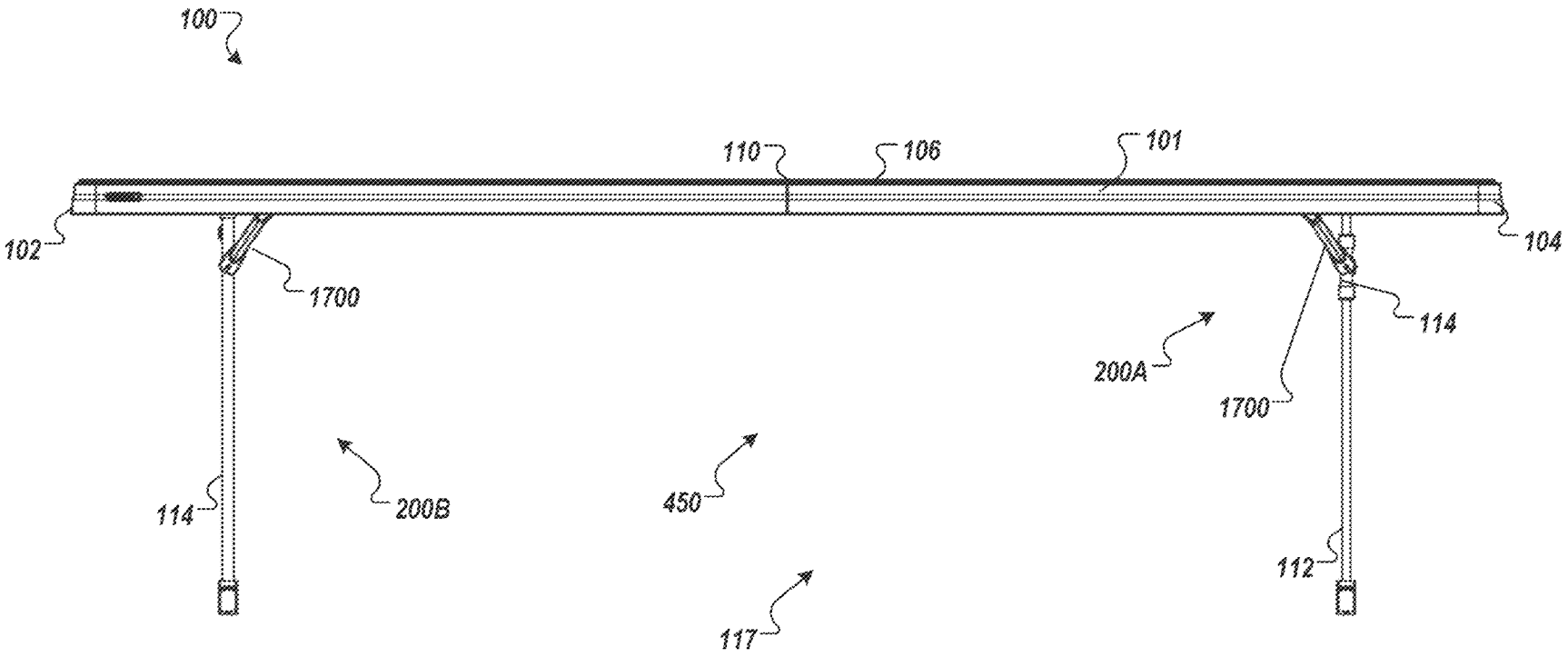
FIG. 1C is a side view of the table shown in FIG. 1A.
Figure 1D:
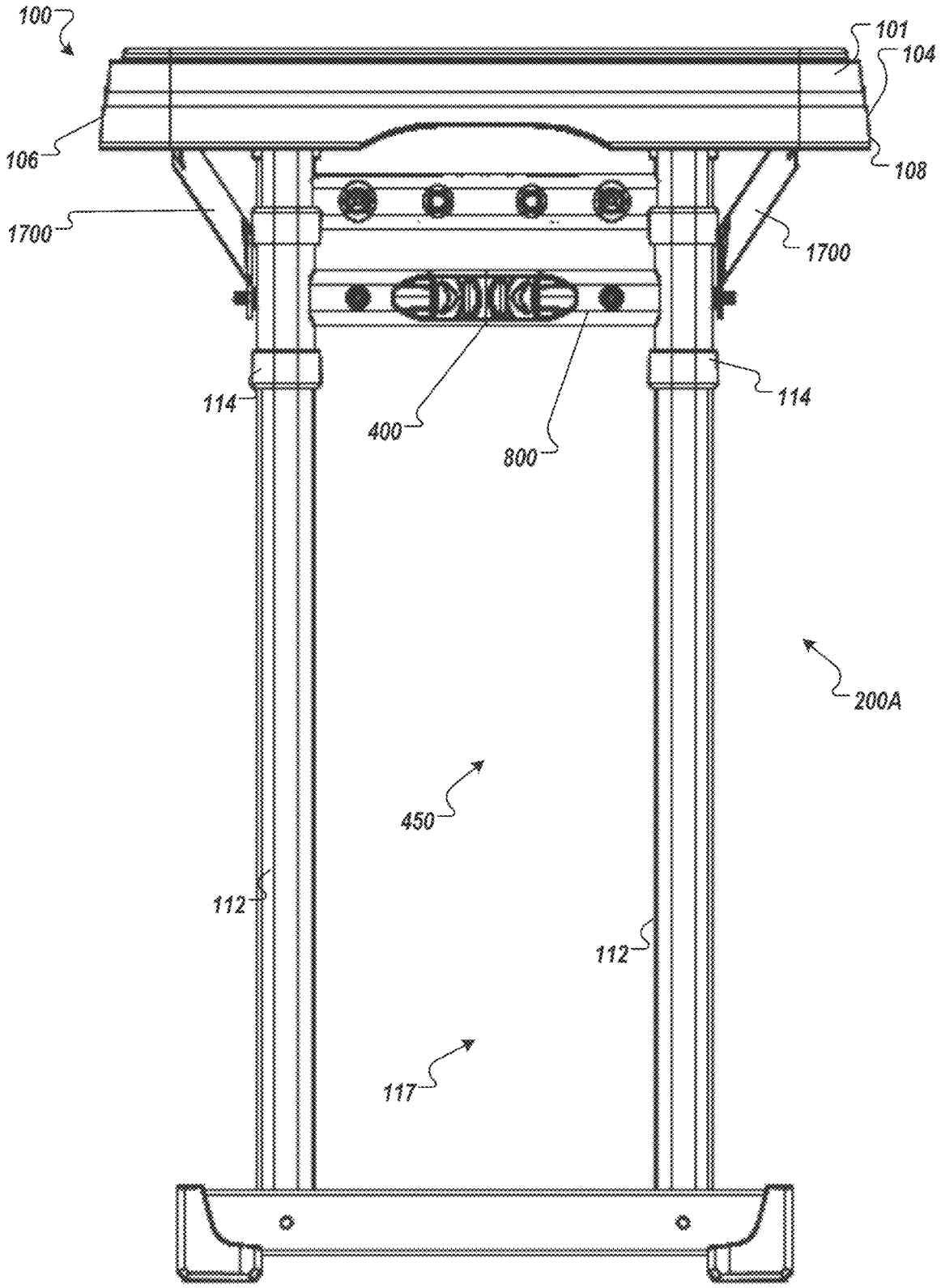
FIG. 1D is an end view of the table shown in FIG. 1A.
Figure 2:
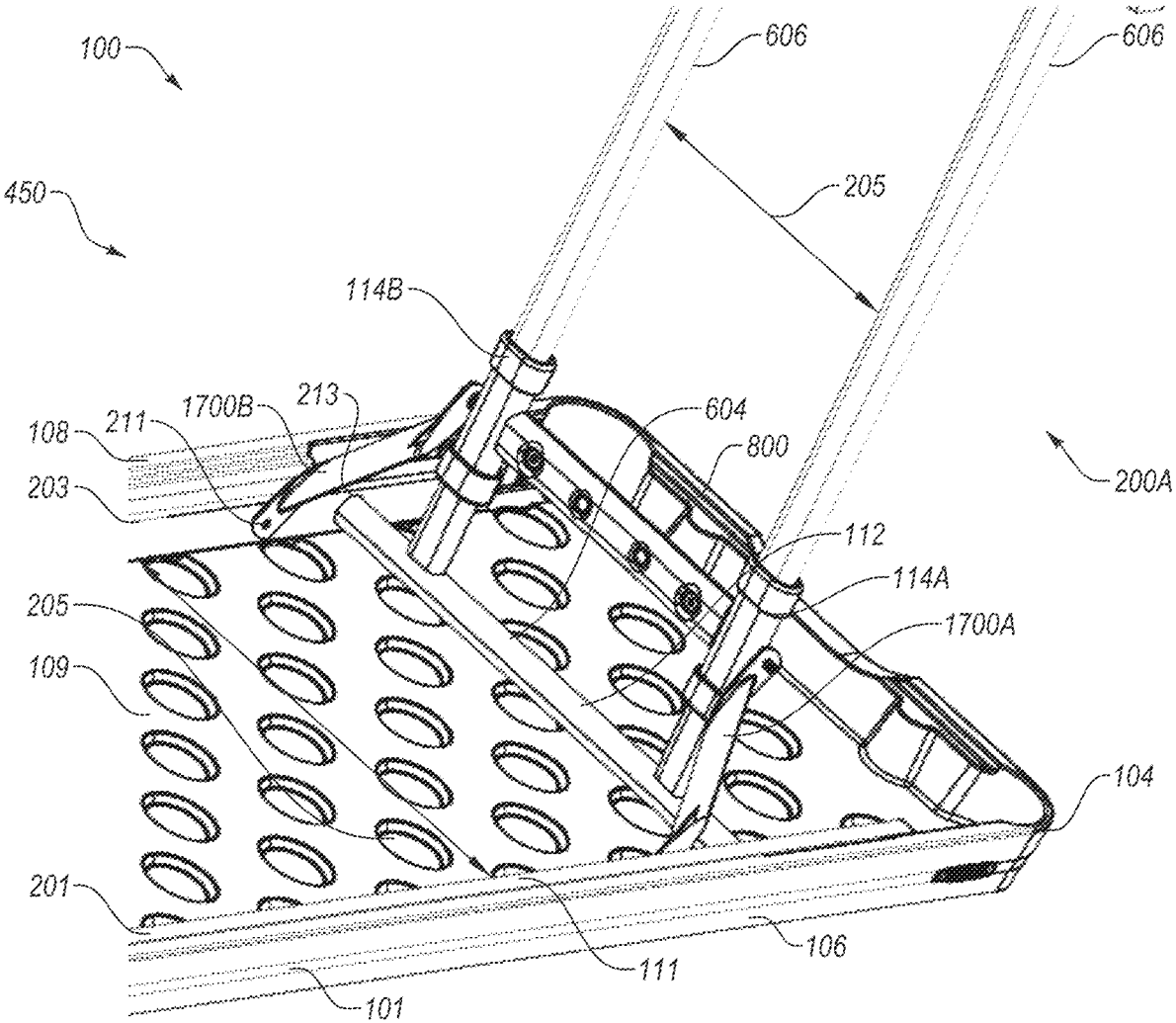
FIG. 2 is an enlarged view of a portion of the table shown in FIG. 1A, depicting a first leg assembly attached to an exemplary tabletop.

Referring to FIGS. 1C and 1D, the support assembly 450 and the leg assemblies 200 may be configured to open up the volume 117 below the tabletop 101. For instance, in some existing tables, the leg assemblies include an angled support. The angled support may extend from a center of the tabletop to a cross member of the leg assemblies. Accordingly, the angled support may occupy or be disposed in the volume (e.g., volume 117) below the tabletop. Presence of the angled support may interfere with chairs or a user's legs, which may limit use of the table.

Accordingly, in at least some of the exemplary embodiments described in the present disclosure, there is no angled support that extends from a center 110 of the tabletop 101 to the leg assemblies 200. Instead, the leg assemblies 200 may include brace members 1700. The brace members 1700 may be coupled between a frame 111 and the leg assemblies 200. The brace members 1700 may be located near outer edges of the tabletop 101. The locations of the brace members 1700 may open up or increase the volume 117 below the tabletop 101.

The leg assemblies 200 may include one or more support elements 112 and one or more translation mechanisms 114. The brace members 1700 may be coupled between the translation mechanism 114 and the frame 111. As the support element 112 transitions between the first position and the second position, the brace members 1700 may rotate and the translation mechanism 114 may translate along a portion of the support element 112. In the use configuration, the leg assembly 200 may be locked, which may secure the leg assemblies 200 by prohibiting the translation mechanism 114 from translating along the support element 112.

In some embodiments, the leg assemblies 200 may include a lock device 400. The lock device 400 may be configurable in an engaged arrangement in which the lock device 400 fixes the translation mechanism 114 to the support element 112, which may lock the leg assemblies 200. Accordingly, in the engaged arrangement the leg assemblies 200 may be fixed such that the translation mechanism 114 cannot translate relative to the support element 112. The lock device 400 may also be configurable in a disengaged arrangement in which the translation mechanism 114 is not fixed relative to the support element 112. In the disengaged arrangement, the leg assemblies 200 may transition from the second position to the first position.

The first table 100 shown in FIGS. 1A-1D and 2 is an exemplary seminar table. The seminar table may have a length of about ninety-six inches, which may be measured between a first end 102 and a second end 104. The seminar table may have a width of about eighteen inches, which may be measured between a first side 106 and a second side 108. The tabletop 101 of the seminar table may be constructed from plastic, such as a high-density polyethylene (HDPE). The tabletop 101 may be constructed from a process, such as blow-molding. Additionally, or alternatively, the tabletop 101 may be a unitary, one-piece structure, and the tabletop 101 may be formed using a blow molding process. Thus, the tabletop 101 may be integrally formed as part of a unitary, one-piece structure constructed from blow-molded plastic. In other embodiments, the leg assemblies 200 may be implemented in other tables or other structures, which may also be blow-molded structures. For instance, the leg assemblies 200 may be implemented in banquet tables (e.g., tables that are 72 inches in length, tables that are 96 inches in length, etc.), fold-in-half tables (e.g., second table 900), folding tables, nesting tables, round tables, bistro tables, fold-in-half round tables, benches, picnic tables, and the like. After reviewing this disclosure, one skill in the art will appreciate that the table 100, the tabletop 101, the leg assemblies, and the other parts and components, may have other suitable shapes, sizes, configurations, and/or arrangements depending, for example, upon the intended use of the table 100.

Referring to FIG. 1C, the first table 100 may include two type of leg assemblies 200. For instance, as best illustrated in FIG. 1B, the table 100 may include a first leg assembly 200A and a second leg assembly 200B. Both the first and second leg assemblies 200A and 200B may include the support element 112, the translation mechanism 114, the lock device 400, and the brace members 1700. Additionally, both the first and second leg assemblies 200A and 200B may be configured to rotate between the first position and the second position relative to the tabletop 101. The first leg assembly 200A and the second leg assembly 200B are described in more detail below.

Figure 3A:
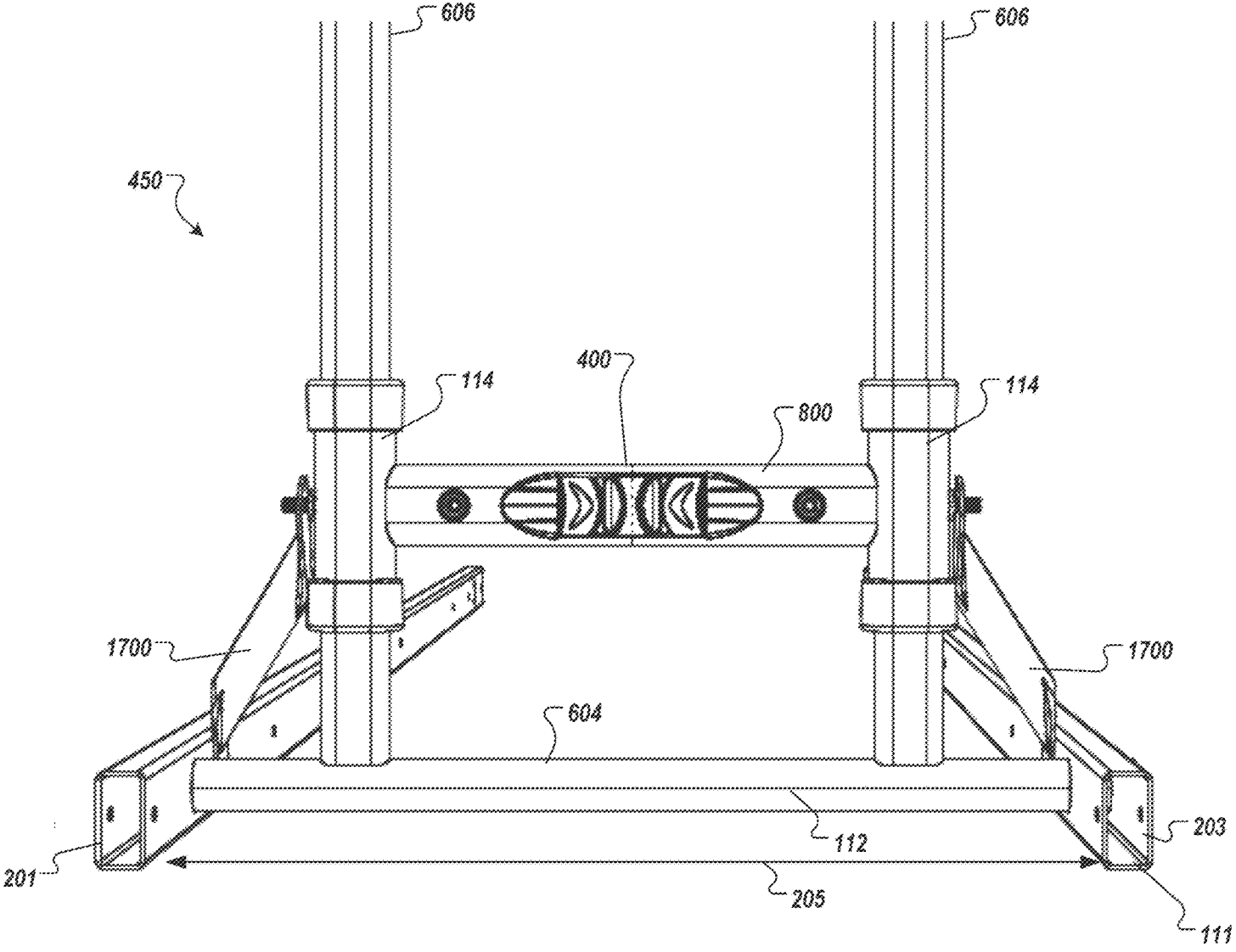
FIG. 3A illustrates a portion of an exemplary support assembly that includes a first leg assembly.
Figure 3B:
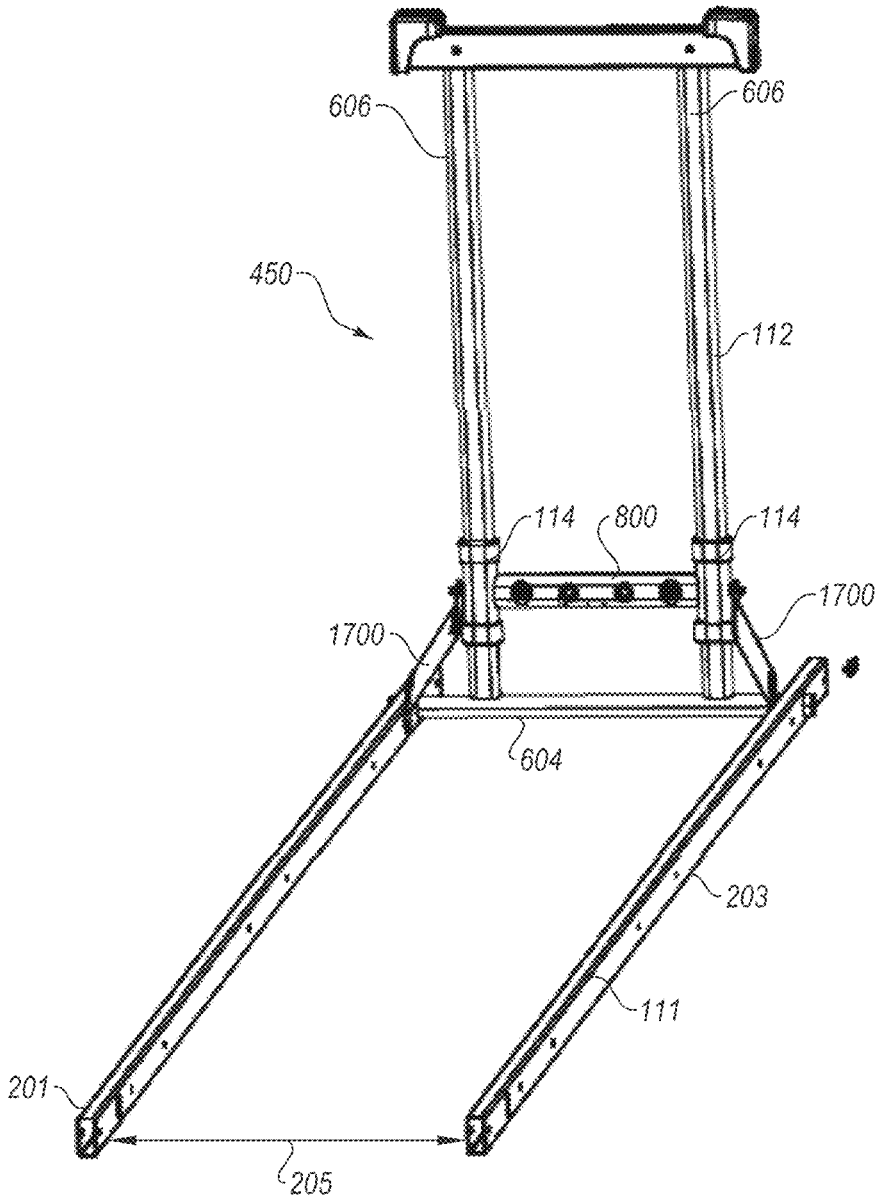
FIG. 3B illustrates another view of the support assembly shown in FIG. 3A.

FIG. 2 depicts a portion of the first table 100 shown in FIGS. 1A-1D. The first leg assembly 200A, a portion of the frame 111, and a portion of the tabletop 101 are included in the portion of the first table 100 shown in FIG. 2. Additionally, FIGS. 3A and 3B depict additional views of the support assembly 450, which may include the frame 111 and the first leg assembly 200A.

The support assembly 450 may include the frame 111, the support element 112, the translation mechanism 114, the lock device 400, the brace members 1700, and/or the lateral structure 800. The frame 111 may include a first longitudinal structure 201 and a second longitudinal structure 203. The first longitudinal structure 201 may be separated by a lateral frame dimension 205 from the second longitudinal structure 203. The first and second longitudinal structures 201 and 203 may be attached to the lower surface 109 of the tabletop 101. The leg assemblies 200 may be attached to the tabletop 101 indirectly via the first and second longitudinal structures 201 and 203.

The support assembly 450 may include the support element 112 and the support element 112 may be rotatably coupled to the longitudinal structures 201 and 203. In the first leg assembly 200A, the support element 112 may include an end structure 604 and an elongated structure 606. The end structure 604 may be rotatably coupled to the frame 111. For instance, in the embodiment shown in FIGS. 2-3B, the end structure 604 may include a cylindrical rod. The cylindrical rod may be retained in the longitudinal structures 201 and 203, and the cylindrical rod may be able to rotate relative to the frame 111.

The translation mechanism 114 may be configured to translate along a portion of the support element 112. For example, as the support element 112 rotates relative to the frame 111, the translation mechanism 114 may translates up or down the support element 112. When the support element 112 has rotated to a first position (such as when the first leg assembly 200A is disposed generally perpendicular to the lower surface 109) the translation mechanism 114 may be fixed relative to the support element 112 by the lock device 400.

The leg assembly 200A may be positioned within the first and second longitudinal structures 201 and 203. For instance, with reference to FIG. 2, a first brace member 1700A may be rotatably coupled to the first longitudinal structure 201 at a first end and to a first translational mechanism 114A at a second end. The first translational mechanism 114A may be retained relative to the support element 112, which may be rotatably coupled to the frame 111. The first translational mechanism 114A may be coupled to a second translational mechanism 114B by the lateral structure 800. The second translational mechanism 114B may also be retained relative to the support element 112. The second translational mechanism 114B may be coupled to a second brace member 1700B at a first end. At a second end of the second brace member 1700B, the brace member 1700B may be rotatably coupled to the second longitudinal structure 203. Accordingly, the first leg assembly 200A and the brace members 1700 may be located or at least partially disposed between the first and second longitudinal structures 201 and 203.

With further reference to FIG. 2, the end structure 604 may be rotatably coupled to the frame at a first interface 211. Additionally, the brace member 1700 may be rotatably coupled to the frame 111 at a second interface 213. The second interface 213 may be disposed between the second end 104 and the first interface 211.

The support assembly 450 shown in FIGS. 2-3B may be implemented in other tables (e.g., banquet tables, round tables, etc.), benches, other types of furniture, etc. Some additional details of these exemplary structures may be in accordance with U.S. Pat. Nos. 8,397,652; 8,347,795; 8,408,146; and 8,622,007; and U.S. patent application Ser. No. 15/942,215, the disclosures of these patents and patent application are incorporated by reference in their entireties. Some adaptations may be required to the frame 111 to use the support assembly 450 with some of the other tables or benches. However, the leg assembly 200A may operate substantially as described with reference to FIGS. 2-3B.

Figure 4A:
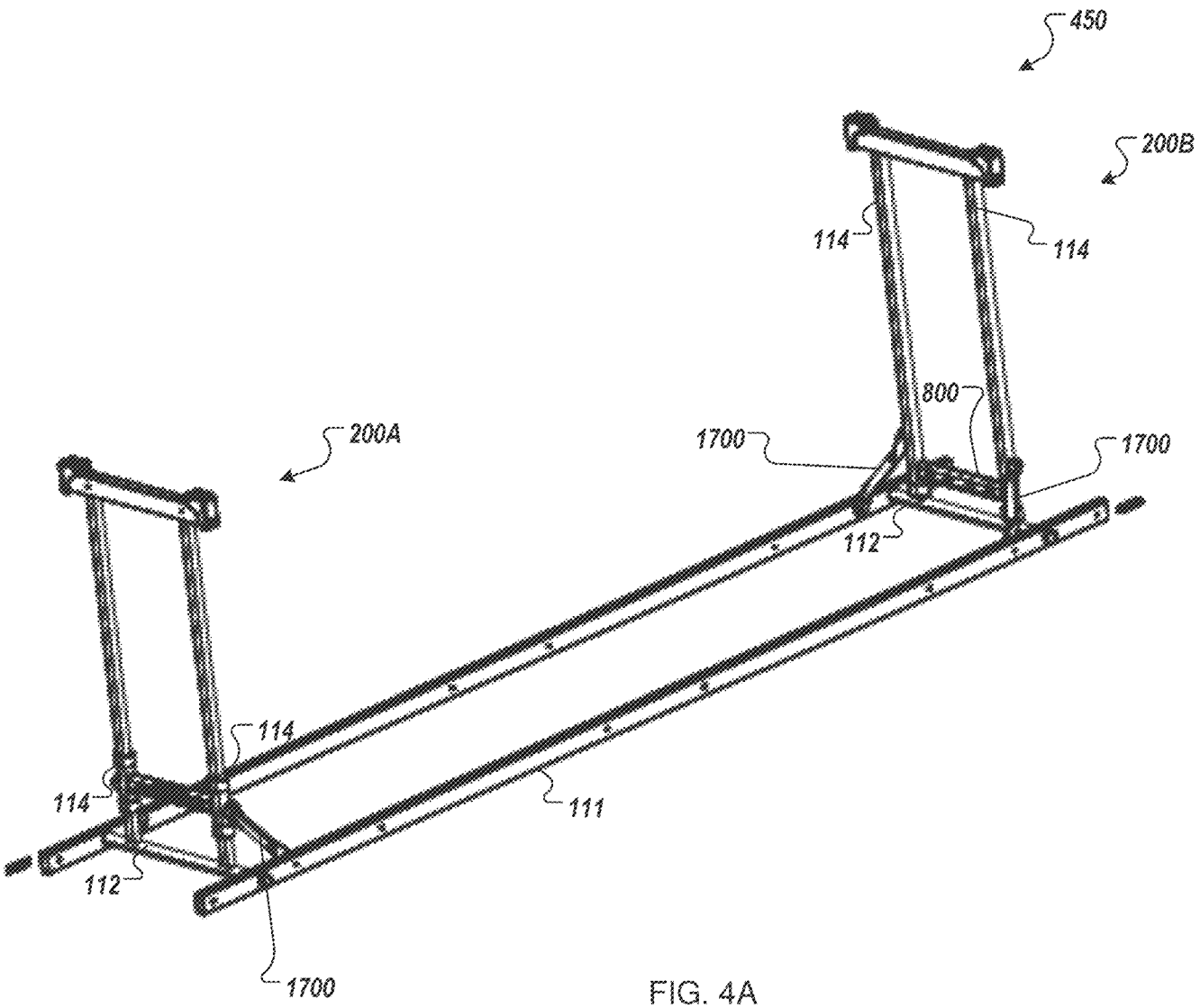
FIG. 4A illustrates an exemplary support assembly with the leg assemblies disposed in a use arrangement.
Figure 4B:
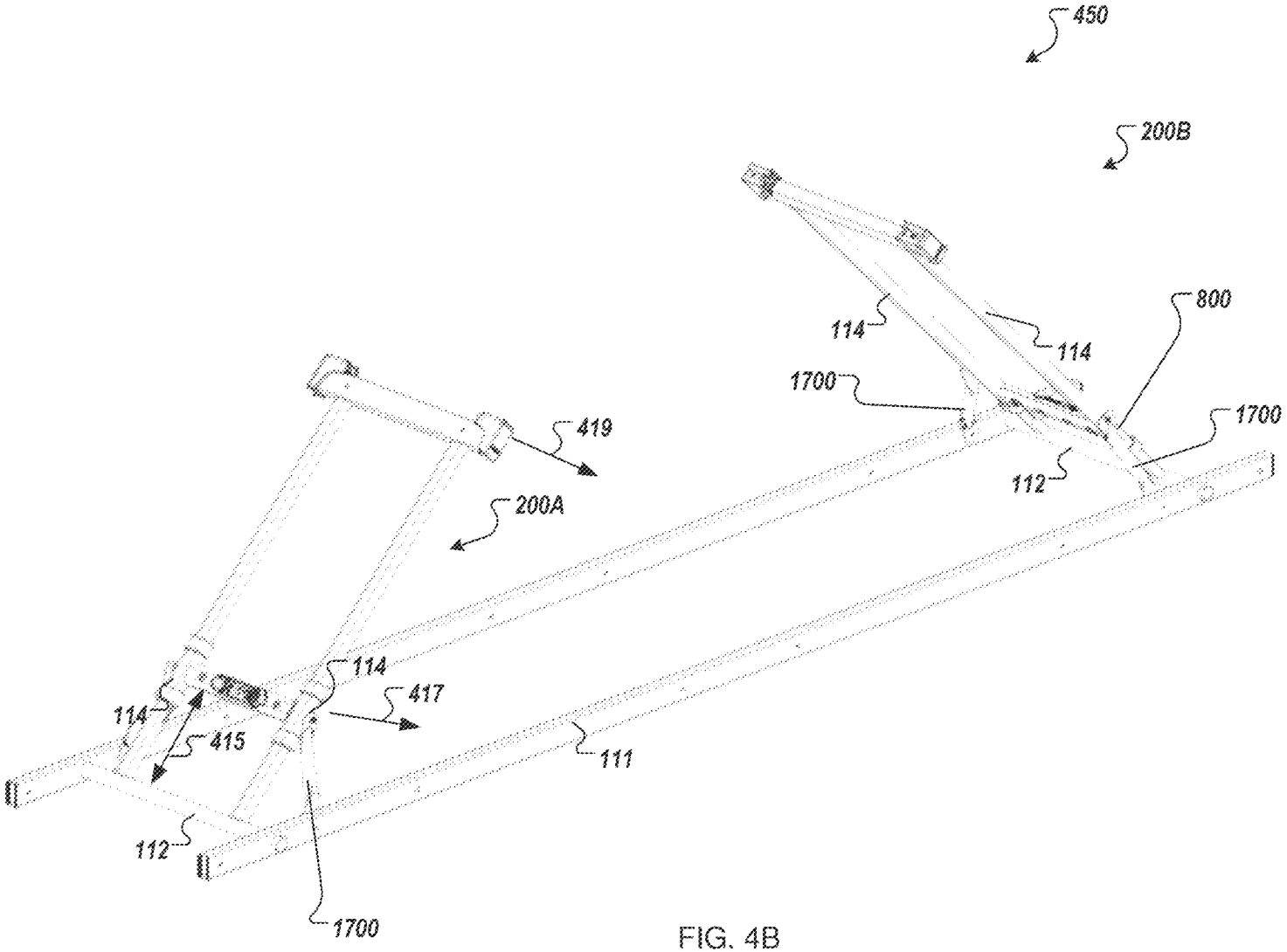
FIG. 4B illustrates the support assembly shown in FIG. 4A with the leg assemblies disposed in a partially folded arrangement.
Figure 4C:
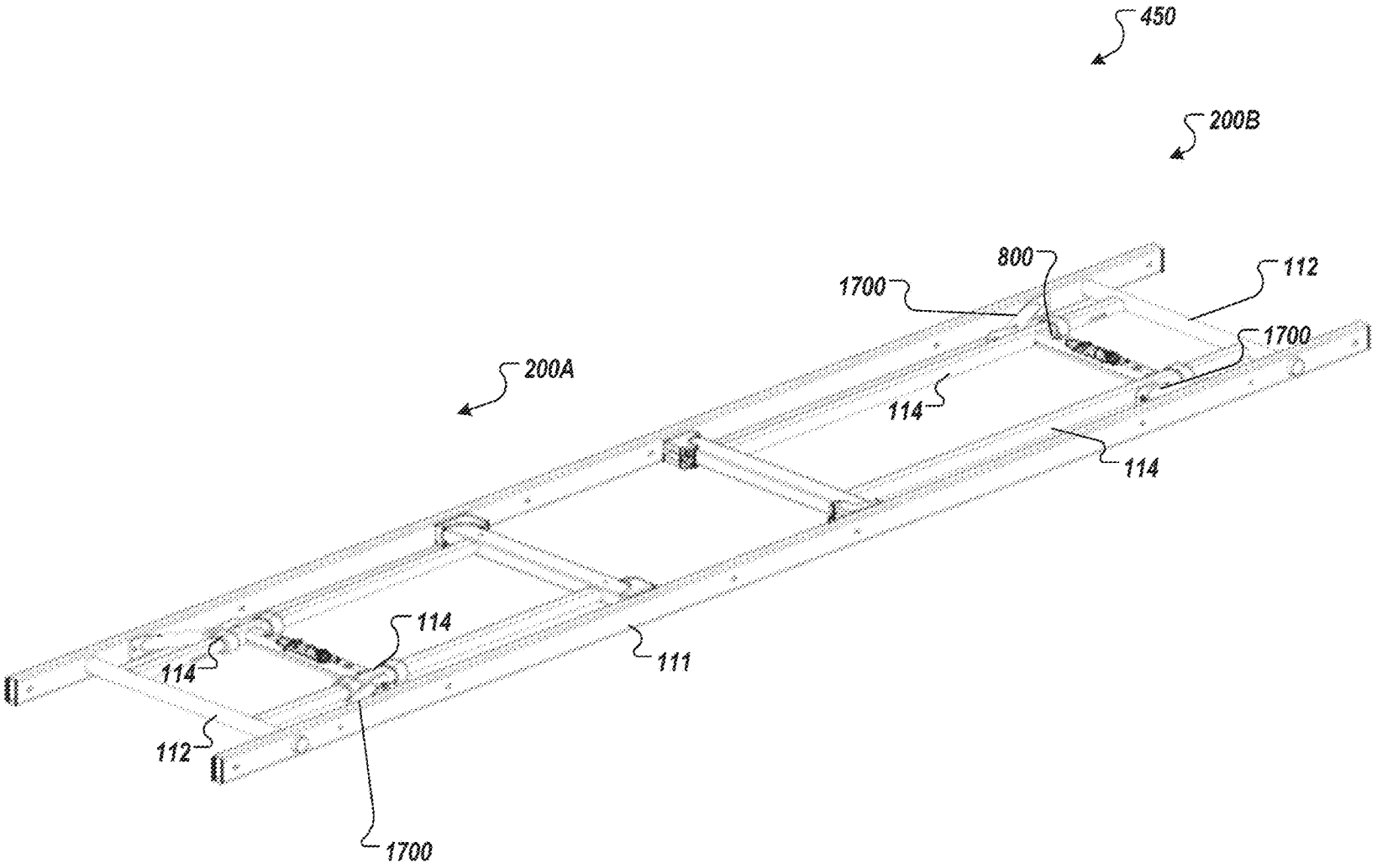
FIG. 4C illustrates the support assembly shown in FIG. 4A with the leg assemblies disposed in a storage arrangement.

FIGS. 4A-4C illustrate an exemplary embodiment of the support assembly 450 that may be implemented or used with structures such as tables or benches. For example, as shown in the accompanying figures, the support assembly 450 may be implemented in the first table 100, which is shown in FIGS. 1A-1D, or a second table 900, which is shown in FIGS. 9A-9D (described below). One of ordinary skill in the art will appreciate, after reviewing this disclosure, that the tables, support assembly, parts, components, and the like, could have different shapes, sizes, configurations, and arrangements depending, for example, upon its intended use. FIG. 4A illustrates the support assembly 450 with the leg assemblies 200 disposed in a use configuration or arrangement. FIG. 4B illustrates the support assembly 450 shown in FIG. 4A with the leg assemblies 200 disposed in a partially folded configuration or arrangement. FIG. 4C illustrates the support assembly 450 shown in FIG. 4A with the leg assemblies 200 disposed in a storage configuration or arrangement.

With reference to FIGS. 4A-4C, the leg assemblies 200 may be configured to rotate relative to the frame 111. For instance, the leg assemblies 200 may rotate from a first angular position in which the leg assemblies 200 are substantially perpendicular to the frame 111 (such as shown in FIG. 4A) to a second angular position in which the leg assemblies 200 are substantially parallel to the frame 111 (such as shown in FIG. 4C). FIG. 4B depicts the leg assemblies 200 transitioning from the first angular position to the second angular position.

Referring to FIG. 4A, the leg assemblies 200 are in a use configuration. In the use configuration, the leg assemblies 200 may be disposed substantially perpendicular to the frame 111. The translation mechanisms 114 may be positioned on a surface to support the frame 111 above the surface. In the use configuration, the lock device 400 may be in an engaged arrangement. In the engaged arrangement, the lock device 400 may fix the translation mechanism 114 relative to the support element 112. Also, in the use configuration, the translation mechanism 114 may be translated towards the support element 112 and the brace members 1700 may be oriented at an angle relative to the translation mechanism 114.

Referring to FIG. 4B, to transition the first leg assemblies 200A, the lock device 400 may be transitioned from the engaged arrangement to a disengaged arrangement. When the lock device 400 is in the disengaged arrangement, the translational mechanism 114 may not be fixed to the support element 112. Accordingly, the translational mechanism 114 may translate relative to the support element 112 as the support element 112 rotates relative to the frame 111. Additionally, the brace members 1700 may rotate with the translational mechanism 114 as the support element 112 rotates.

In particular, with reference to FIG. 4B, the first leg assembly 200A may rotate in a direction represented by arrow 419. As the first leg assembly 200A rotates in the direction 419, the brace member 1700 may rotate in the same direction, which is represented by arrow 417. Moreover, as the first leg assembly 200A rotates, a distance 415 between the lateral structure 800 and the support element 112 may increase.

Referring to FIG. 4C, the support assembly 450 is depicted in a storage configuration. In the storage configuration, the leg assemblies 200A, 200B may be disposed substantially parallel to the frame 111. The translation mechanisms 114 may be positioned in a volume at least partially defined by the frame 111. In the storage configuration, the lock device 400 may be disposed in the disengaged arrangement, which may allow the translational mechanism 114 to translate relative to the support element 112. Also, in the storage configuration, the brace members 1700 may be positioned between the translational mechanism 114 and an inner surface of the frame 111.

Figure 5A:
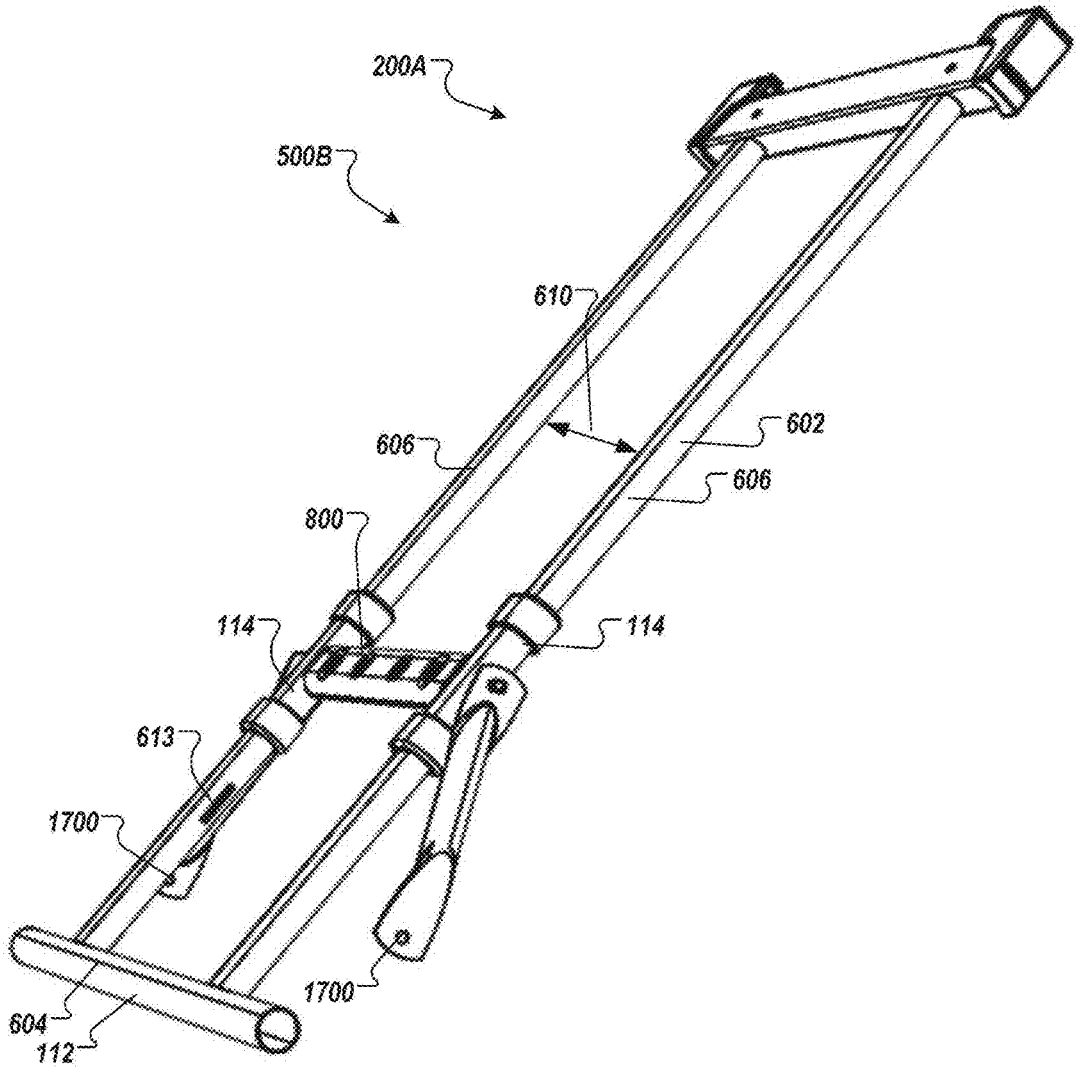
FIGS. 5A and 5B depict an exemplary leg assembly with a brace member disposed in partially folded positions.
Figure 5B:
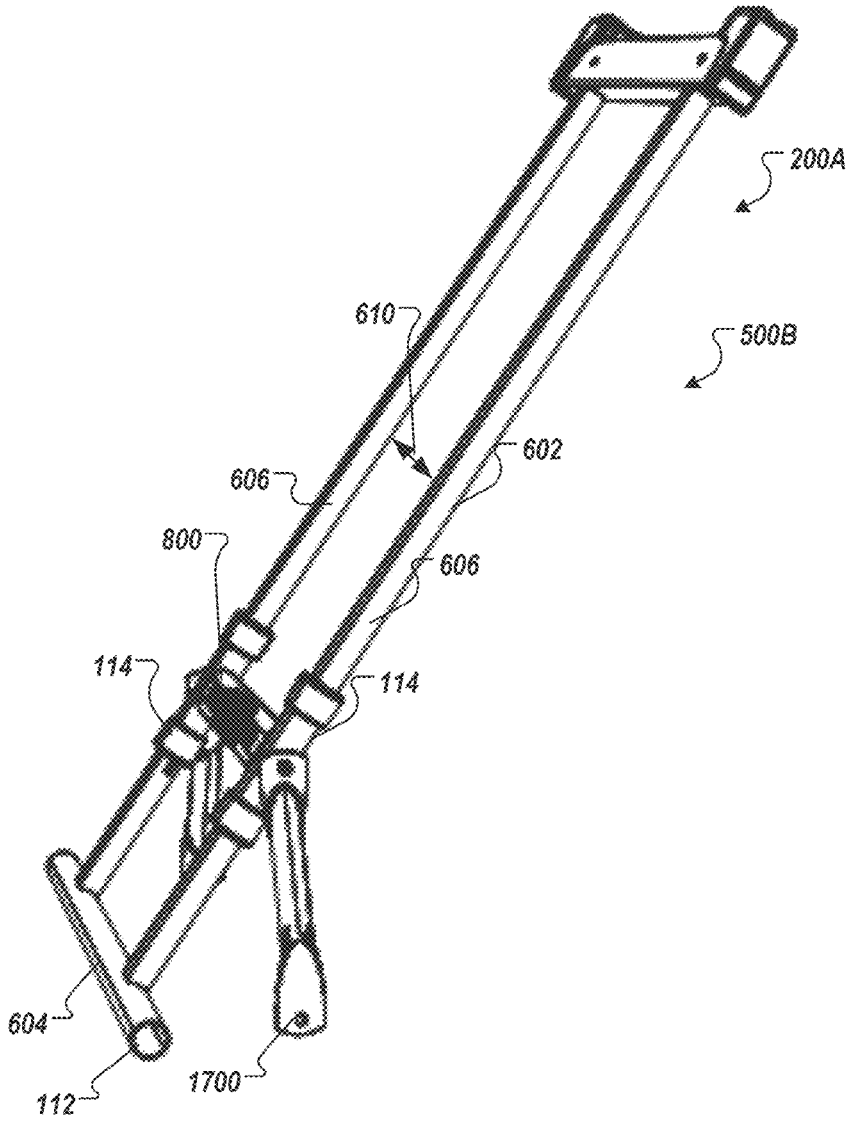
Figure 6:
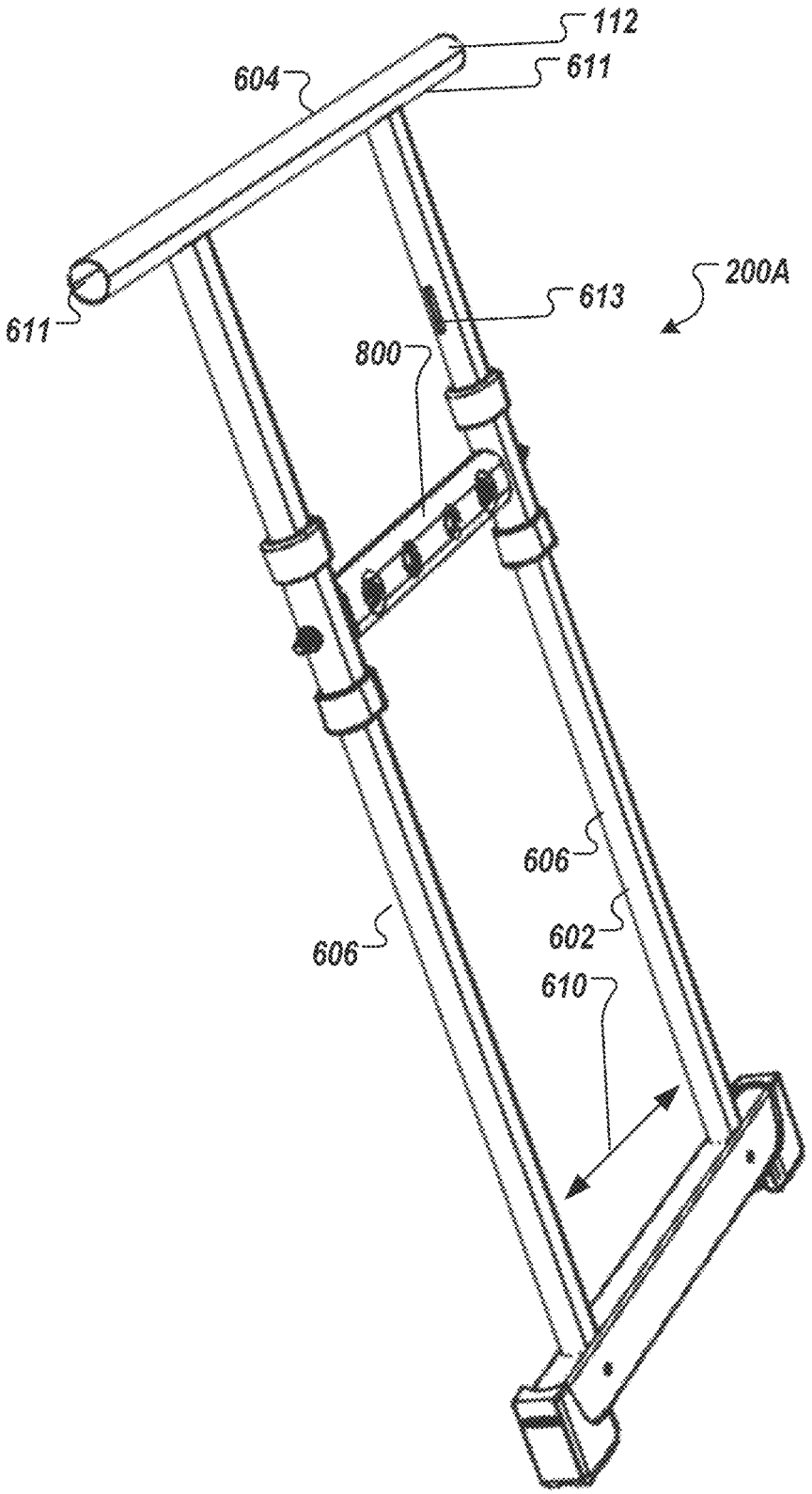
FIG. 6 illustrates an exemplary leg assembly.
Figure 7A:
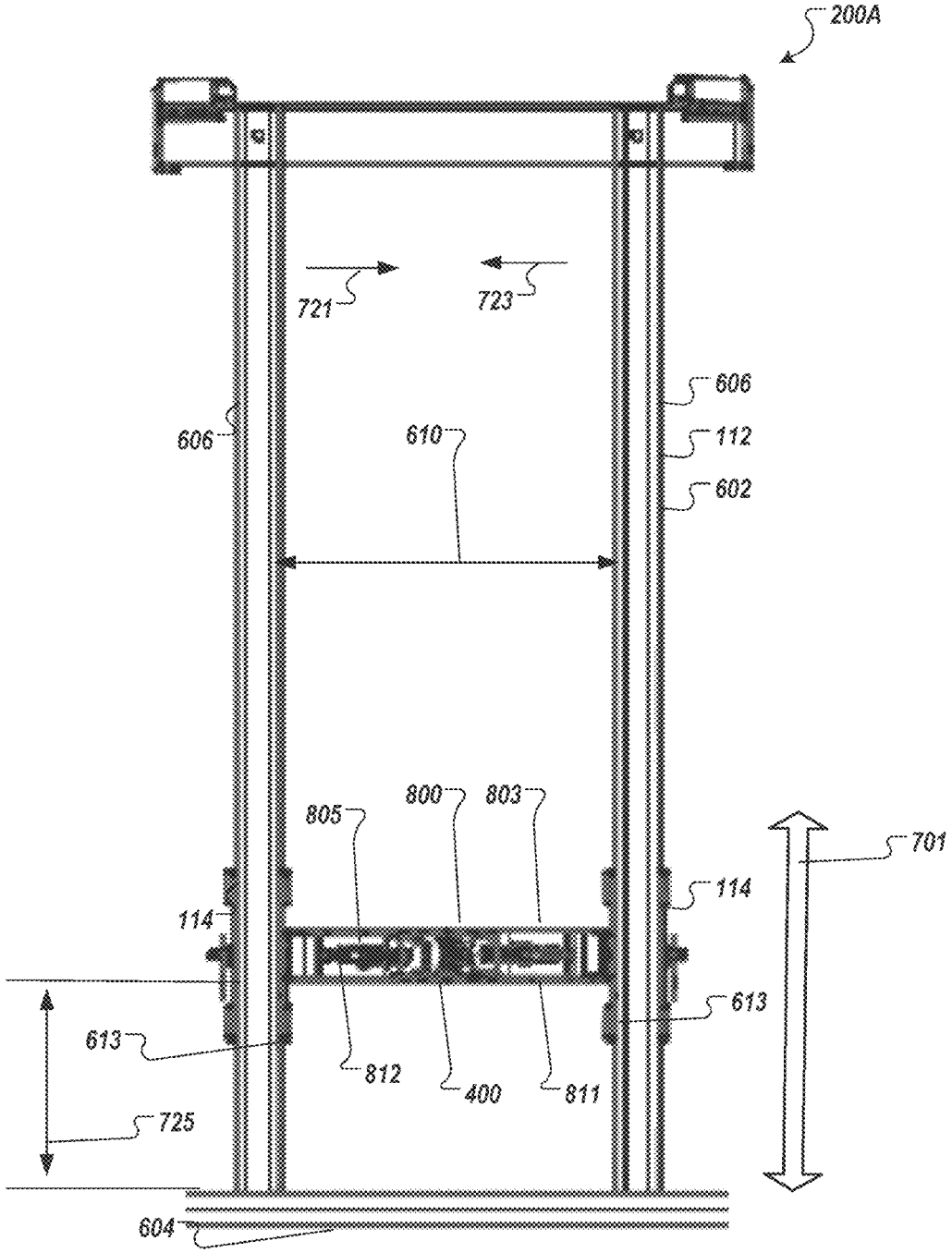
FIGS. 7A and 7B illustrate an exemplary leg assembly with an exemplary translation mechanism translating on an exemplary support element.
Figure 7B:
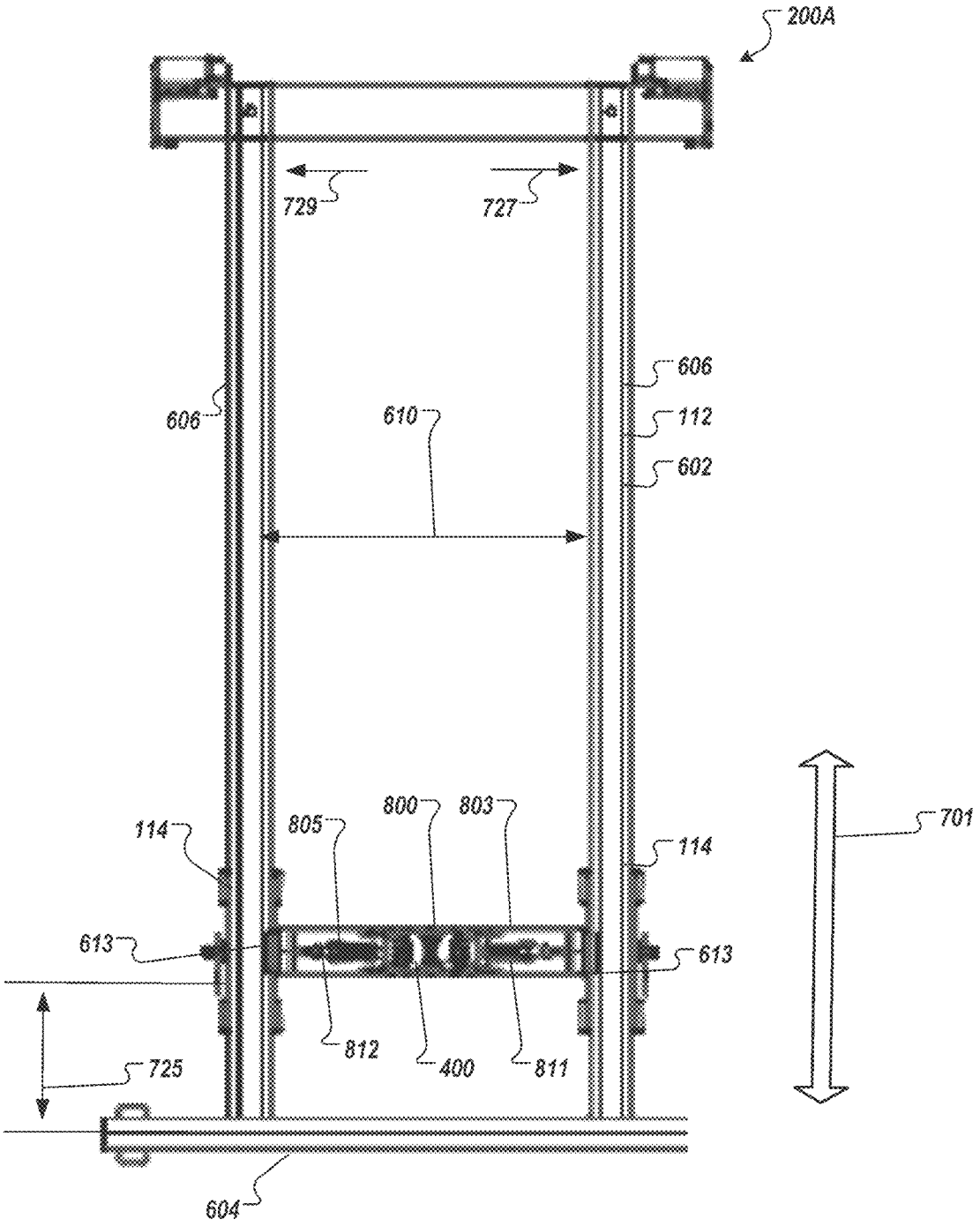

The first leg assembly 200A and one or more of the brace members 1700 may function together to enable a transition between the use configuration and the storage configuration, such as the use and storage configurations described above. FIGS. 5A and 5B depict the first leg assembly 200A with the brace member 1700 in partially folded positions 500A and 500B. FIG. 6 illustrates a perspective view of an exemplary embodiment of the first leg assembly 200A. FIGS. 7A and 7B illustrate sectional views of the first leg assembly 200A with the translation mechanism 114 translating on the support element 112.

With combined reference to FIGS. 5A-7B, the first leg assembly 200A may include the support element 112, the translation mechanism 114, the lock device 400, and/or a lateral structure 800. Referring to FIGS. 5A-6, an exemplary support element 602 is depicted that may be implemented in a leg assembly, such as the first leg assembly 200A. The support element 602 may be an example of the support element 112 described above. Accordingly, the support element 602 may be configured to be rotatably attached to a structure, such as a first longitudinal structure and a second longitudinal structure of a frame (e.g., the frame 111 described above).

The support element 602 may include an end structure 604 that is attached to one or more elongated structures 606, which are referred to in the embodiment shown in FIGS. 5A-6 as legs. The legs 606 may extend substantially perpendicular to the end structure 604. The legs 606 may each be configured to be received within a translation volume of a conduit (e.g., the conduit 802). For instance, the legs 606 may include a diameter and a length that enables the legs 606 to be received in the translation volume and for a corresponding translation mechanism to translate relative to the support element 602.

The legs 606 (as shown in the accompanying figures, the support element 602 may include two legs 606) may be separated by a shaft support separation distance 610. The shaft support separation distance 610 may be less than a lateral frame dimension (e.g., 205), which may be the distance between the first the second longitudinal structures of a frame. Thus, the legs 606 may be positioned within the fame of a table (e.g., tables 100 or 900).

The end structure 604 may be rotatably coupled to the frame. For example, the outer portions 611 (an exemplary embodiment of which is shown in FIG. 6) may be received by the first and the second longitudinal structures of the frame such that the support element 602 is rotatable relative to the frame from the first position to the second position. The end structure 604 may be rotatable relative to the frame, but the end structure may be fixed relative to the frame such that the end structure 604 cannot be displaced. It will be appreciated that the end structure 604 does not have to be rotatably coupled to the frame and the end structure 604 could be coupled to other suitable portions of the table.

The elongated structures 604 may define at least a portion of a receiver 613 (an exemplary receiver 613 is shown in FIGS. 5A and 6). One or more receivers 613 may be positioned on an inner surface of the elongated structures 606 and the receivers 613 may face one another. The receiver 613 may be sized and shaped to receive a lock tab that extends from a lock device (e.g., the lock device 400) when the lock device is configured in the engaged arrangement. The size and position of the receivers 613 may correspond to openings included on conduit (e.g., the conduit 802). Accordingly, the lock tab may extend through the opening into the receiver 613.

Referring to FIGS. 5A-7B, the first leg assembly 200A may include one or more translation mechanisms 114, which may include conduits. Some additional details of the conduits are provided below. The elongated structure 606 may extend into the translation mechanism 114, which may be configured to translate along a portion of the support element 112 as the support element 112 rotates relative to the frame.

The translation mechanism 114 may be retained relative to the support element 112. For instance, the translation mechanism 114 may be slidably retained relative to the support element 112 such that the translation mechanism 114 translates relative to the support element 112 and the translation mechanism 114 may translate in a particular direction.

In the exemplary embodiment shown in FIGS. 7A and 7B, the translation mechanism 114 may translates in a direction indicated by arrows 701. Because the brace members 1700 may be rotatably coupled between the translation mechanism 114 and the frame, in order for the support element 112 to rotate, the translation mechanism 114 may translate. Accordingly, fixing the translation mechanism 114 relative to the support element 112 may prevent the support element 112 from transitioning between the use position and the storage position.

The lateral structure 800 may be attached to the translation mechanism 114. For example, in the depicted embodiment, the lateral structure 800 may extend between the translation mechanisms 114. The lock device 400 may be at least partially disposed in the lateral structure 800. The lock device 400 may include a compression mechanism 820. The compression mechanism 820 may include one or more buttons, such as two buttons. The buttons may be disposed in opposing positions, which may create two opposed buttons. A user may actuate the compression mechanism 820 by drawing or pushing the two opposed buttons towards one another. Pressing the opposed buttons of the compression mechanism 820 towards one another may pull lock tabs 803 and 805 towards a center portion of the leg assembly 200. With sufficient force, the lock tabs 803 and 805 may be withdrawn from receivers 613 defined in the support element 112. When the lock tabs 803 and 805 are withdrawn from the receivers 613 and into the lateral structure 800, the translation mechanism 114 may be able to translate relative to the support element 112.

The lock device 400 may be configurable in two arrangements. In an engaged arrangement, an exemplary embodiment is shown in FIG. 7B, the lock tabs 803 and 805 may extend from the sides of the lateral structure 800 and may be received in the receiver 613. In the engaged arrangement, the lock device 400 may fix the translation mechanism 114 relative to the support element 112. Accordingly, the translation mechanism 114 may not translate relative to the support element 112, which may prevent the support element 112 from rotating.

With reference to FIG. 7B, the lock tabs 803 and 805 are depicted engaged in the receiver 613, which may correspond to the engaged arrangement of the lock device 400. The lock tabs 803 and 805 may be biased by a biasing mechanism such one or more springs 812 and 811. For instance, in the exemplary embodiment, the lock tabs 803 and 805 may be biased away from one another such that the lock tabs 803 and 805 are biased towards being introduced and retained in the receivers 613.

Referring back to FIGS. 5A-7B, the lock device 400 may also be configurable in a disengaged arrangement, exemplary embodiments of which are depicted in FIGS. 5A, 5B, 6, and 7A. In the disengaged arrangement, the lock tabs 803 and 805 may be withdrawn from the receivers 613 and into the lateral structure 800. The translation mechanism 114 may accordingly translate relative to the support element 112, which may enable the support element 112 to rotate relative to a frame. To transition the lock device 400 from the engaged arrangement to the disengaged arrangement, a user may press the buttons on the compression mechanism 820 towards one another. The buttons may translate these forces to the lock tabs 803 and 805 and retract them from the receivers 613.

Referring to FIGS. 7A and 7B, the first leg assembly 200A is depicted in the disengaged arrangement and the engaged arrangement, respectively. Referring to FIG. 7A, the lock tabs 803 and 805 are pulled towards one another. The direction the lock tabs 803 and 805 are moved are represented in FIG. 7A by arrows 721 and 723. The force applied to the buttons is sufficient to overcome a spring force applied by springs 812 and 811. With the lock tabs 803 and 805 withdrawn from the receivers 613, the translation mechanism 114 may translate relative to the support element 112. For instance, a distance 725 between the end structure 604 and a top of the lateral structure 800 may increase.

As shown in FIG. 7B, the lock tabs 803 and 805 are pressed away from one another by the springs 812 and 811. When the lock tabs 803 and 805 are aligned with the receivers 613, the lock tabs 803 and 805 extend into the receivers 613. The direction the lock tabs 803 and 805 may move because of the springs 812 and 811 are represented in FIG. 7B by arrows 727 and 729. With the lock tabs 803 and 805 positioned in the receivers 613, the translation mechanism 114 may be fixed to the support element 112, which may fix a distance 731 between the end structure 604 and a top of the lateral structure 800.

Figure 8A:
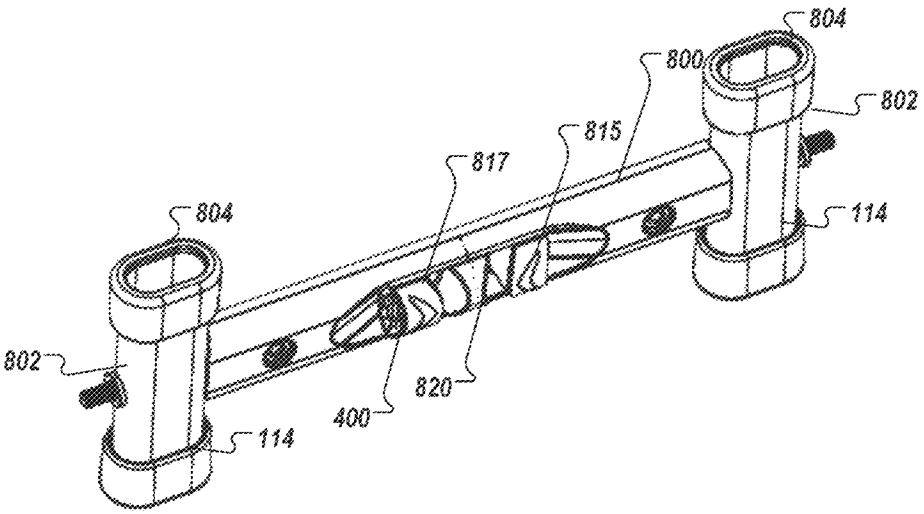
FIGS. 8A-8C illustrate views of an exemplary translation mechanism and an exemplary lateral structure.
Figure 8B:
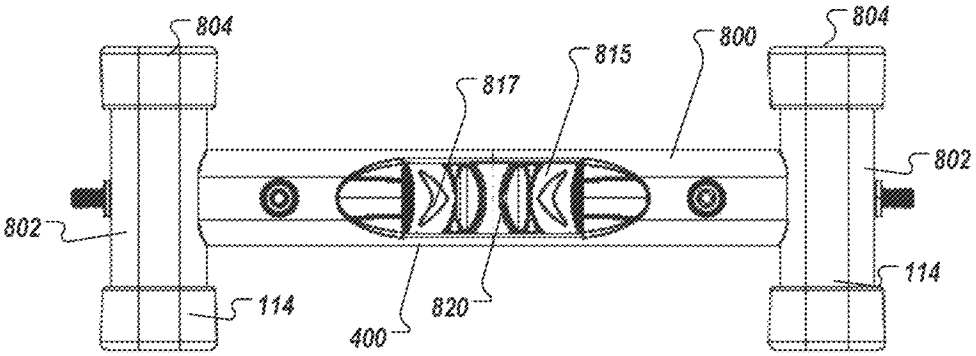
Figure 8C:
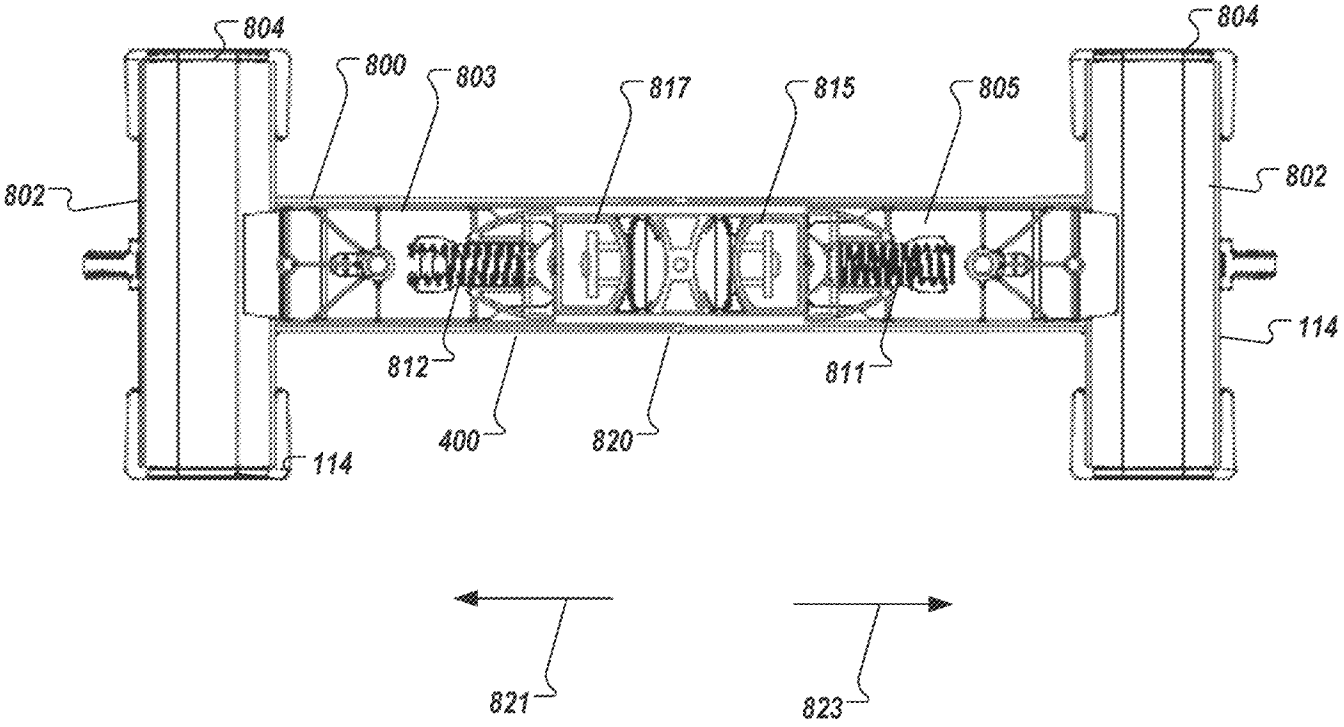

FIGS. 8A-8C illustrate views of an exemplary embodiment of the translation mechanism 114 and an exemplary embodiment of the lateral structure 800. Referring to FIGS. 8A-8C, the translation mechanism 114, the lateral structure 800, and other components therein may be referred to as a translation assembly 114/800. FIG. 8A is a perspective view of the translation assembly 114/800. FIG. 8B is a rear view of the translation assembly 114/800. FIG. 8C is a sectional view of the translation assembly 114/800.

In the translation assembly 114/800, the translation mechanism 114 may be a sleeve or sleeve structure that at least partially surrounds a structure of a support element (e.g., the support element 112 described above). In particular, the translation assembly 114/800 may include conduits 802A and 802B (generally, conduit 802 or conduits 802), which is an example of the translation mechanism 114. Accordingly, the conduits 802 may be retained relative to a support element, a frame, and a brace member. For instance, with reference to FIGS. 8A and 1A, the support element 112 may be received in the conduits 802 such that the conduits 802 may translate relative to the support element. Additionally, the conduits 802 may be coupled to the frame 111 via the brace member 1700.

The conduits 802 may define at least a portion of the translation volumes 804. The translation volumes 804 may extend through at least a portion of the entire conduit 802, which may allow the elongated structures (e.g., the legs of the support element) to extend through the conduits 802. The conduits 802 may translate relative to the elongated structures as the support element rotates.

The translation assembly 114/800 may also include the lateral structure 800. The lateral structure 800 may be attached to the conduits 802 at an inner surface of the conduits 802. The lateral structure 800 may be a shell structure in which the lock device 400 is at least partially positioned. The lock device 400 may include a compression mechanism 820. The compression mechanism 820 may include one or more buttons, such as two buttons 815 and 817. The two buttons 815 and 817 may be disposed in an opposed configuration. A user may actuate the compression mechanism 820 by drawing or pushing the two opposed buttons 815 and 817 towards one another. Drawing the opposed buttons 815 and 817 of the compression mechanism 820 towards one another pull lock tabs 803 and 805 towards a center portion of the lateral structure 800. With sufficient force, the lock tabs 803 and 805 may be withdrawn from receivers defined in a support element. When the lock tabs 803 and 805 are withdrawn from the receivers and into the lateral structure 800, the conduits 802 may be able to translate relative to the support element.

With reference to FIG. 8C, the lock tabs 803 and 805 may be biased by a biasing mechanism such as one or more springs 812 and 811. For instance, in the depicted embodiment the lock tabs 803 and 805 may be biased away from one another such that the lock tabs 803 and 805 are biased towards being introduced and retained in the receivers. Specifically, in the exemplary embodiment shown in the accompanying figures, a first lock tab 803 may be biased in a direction indicated by arrow 821 and a second lock tab 805 may be biased in a direction indicated by arrow 823. In other embodiments, the lock tabs 803 and 805 may be otherwise biased.

Figure 9A:
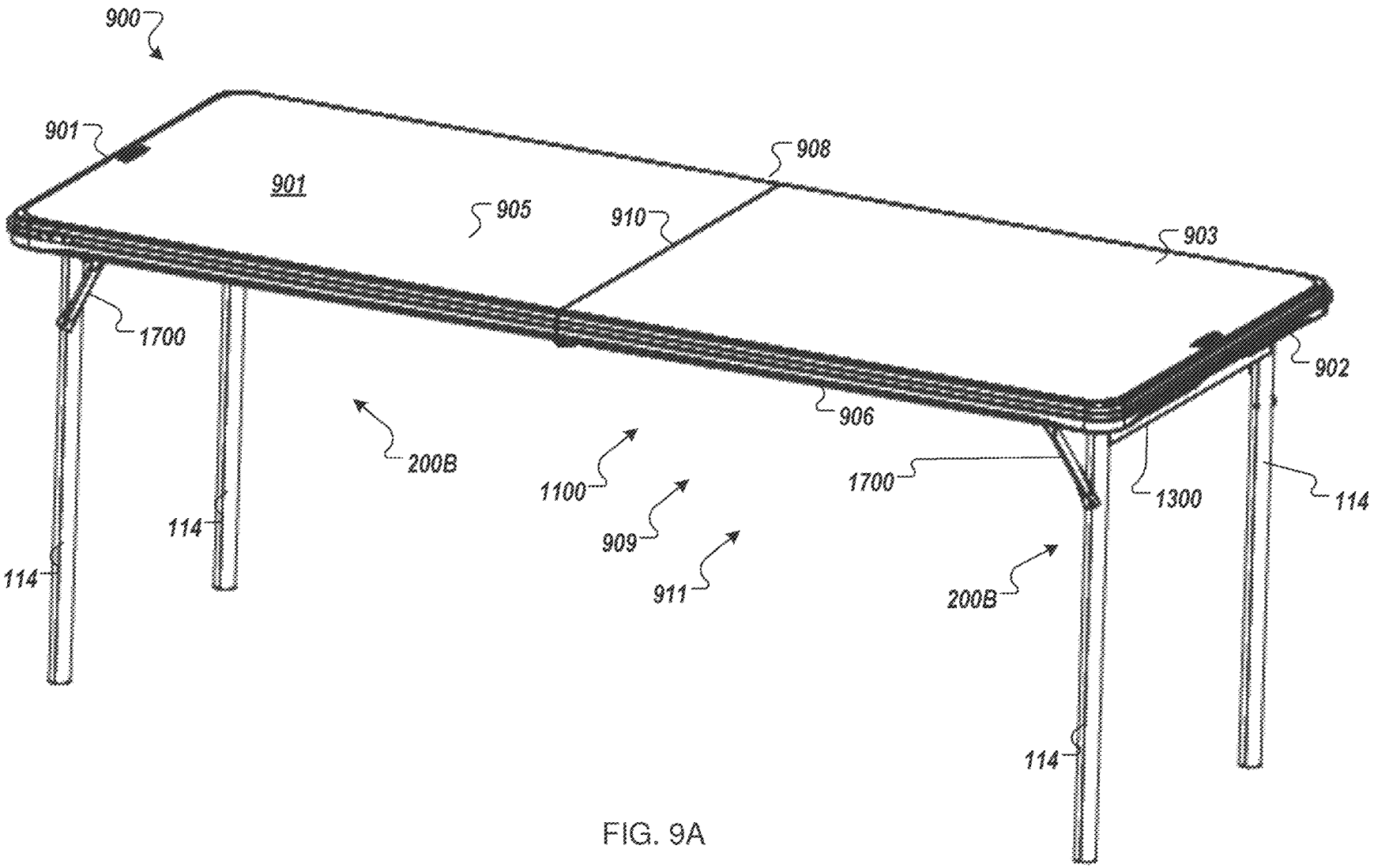
FIG. 9A illustrates another exemplary table that may implement a first and/or a second leg assembly.
Figure 9B:
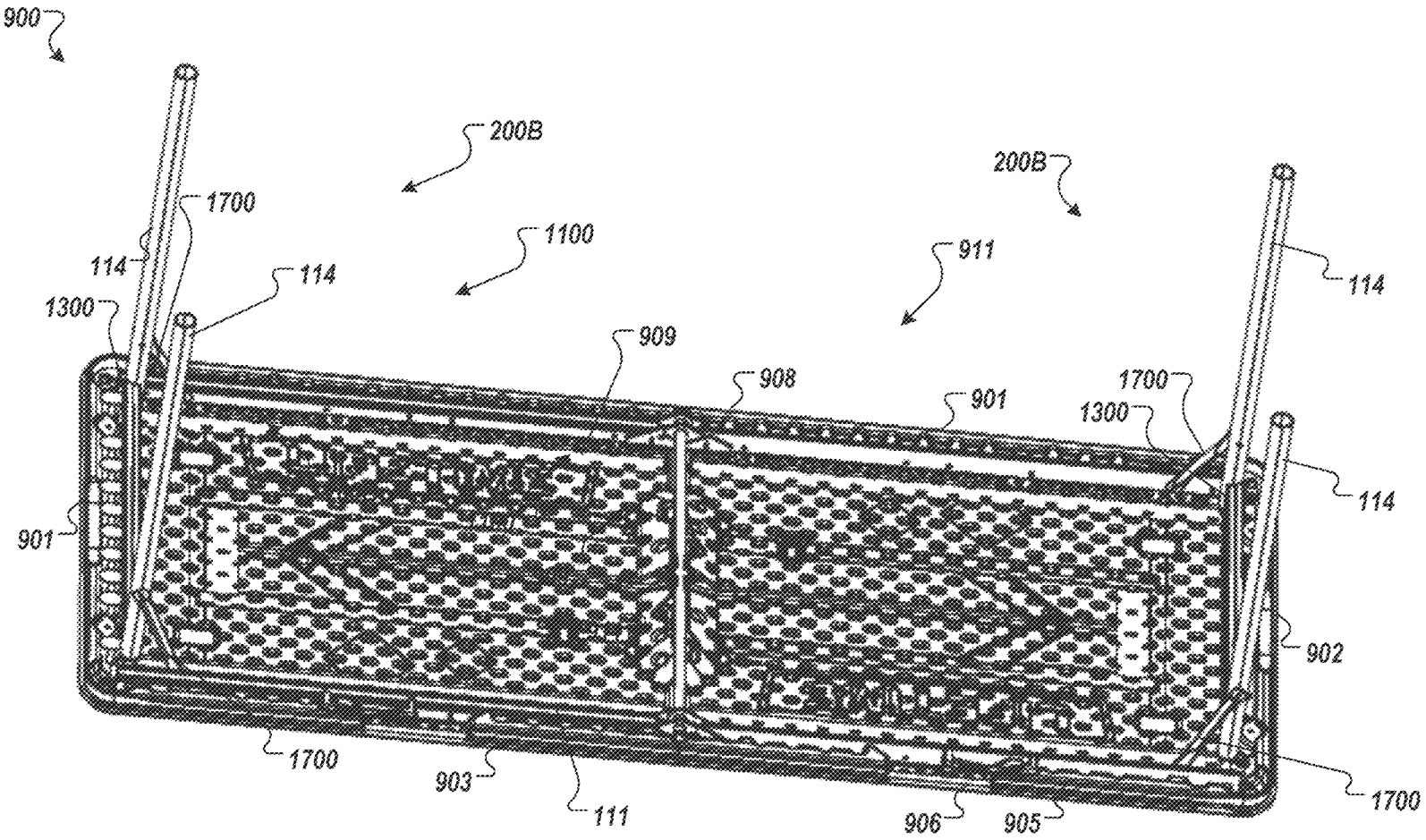
FIG. 9B is a lower perspective view of the table shown in FIG. 9A.

FIGS. 9A-9D illustrate another exemplary structure, such as a second exemplary table 900 (second table 900). The second table 900 may implement one or both of the leg assemblies 200 as described in the present disclosure. FIG. 10 is an enlarged view of a portion of the second table 900 depicting the second leg assembly 200B attached to an exemplary tabletop 901. The second table 900 may include a tabletop 901 that is selectively supported by a support assembly 1100. The support assembly 1100 may be configured to support the tabletop 901 relative to a surface such as a floor or the ground. The support assembly 1100 shown in FIGS. 9A-10 may include the second leg assembly 200B. The second leg assembly 200B can be positioned in a first position and a second position. In the first position, the second leg assembly 200B may be disposed in a storage configuration in which the leg assemblies 200 are positioned adjacent to, in contact with, or substantially adjacent to a lower surface 909 of the tabletop 901. Such positioning may reduce a height of the second table 900, which may also reduce a volume used by the second table 900 when the table is being stored. The second position may be a use configuration. In the second position, the second leg assemblies 200B may be disposed substantially perpendicular to the lower surface 909 of the tabletop 901. The leg assemblies 200B may support the tabletop 901 such that the second table 900 may be used (e.g., a user placing items on the tabletop 901). In FIGS. 9A-10, the leg assemblies 200B are shown in the use configuration.

Figure 9C:
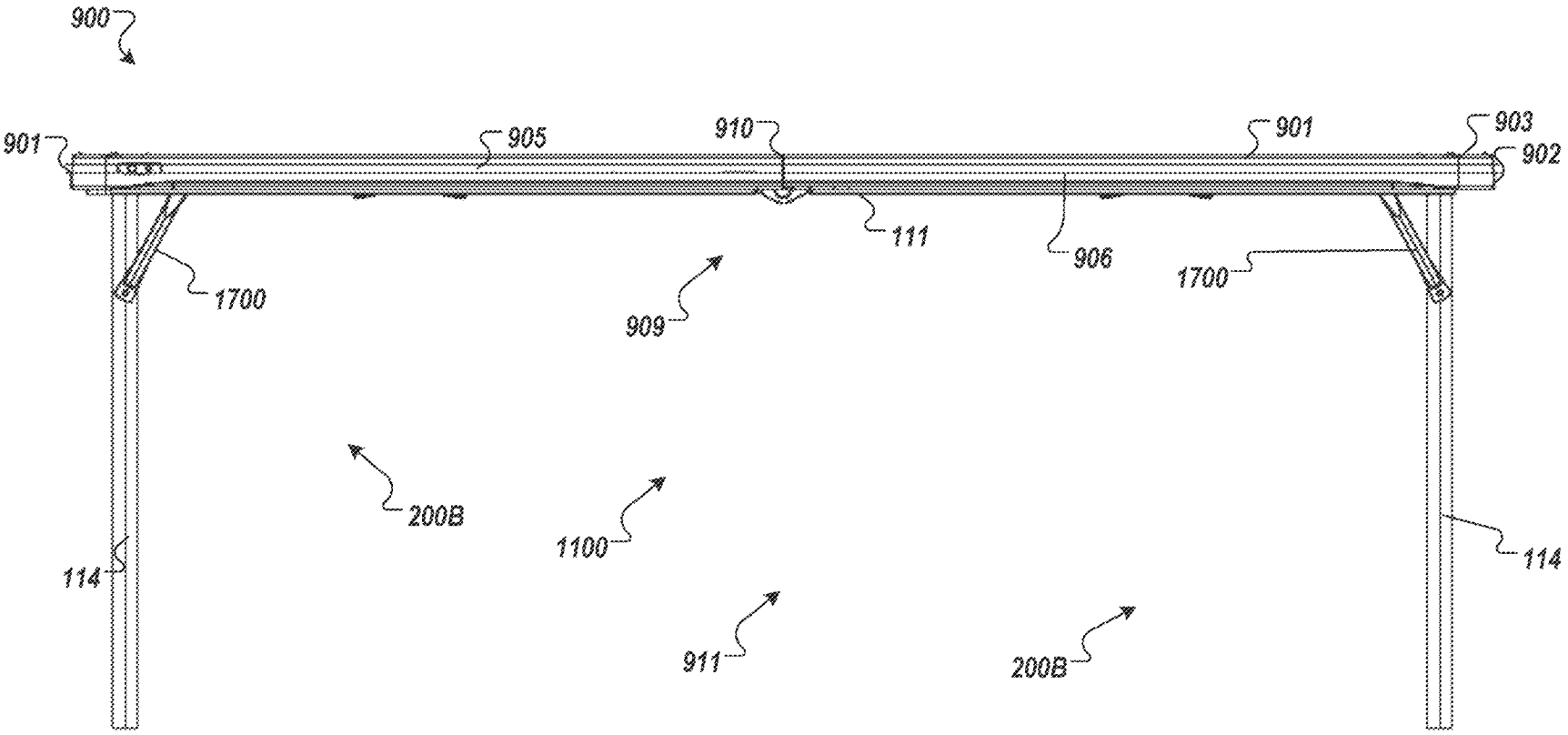
FIG. 9C is a side view of the table shown in FIG. 9A.
Figure 9D:
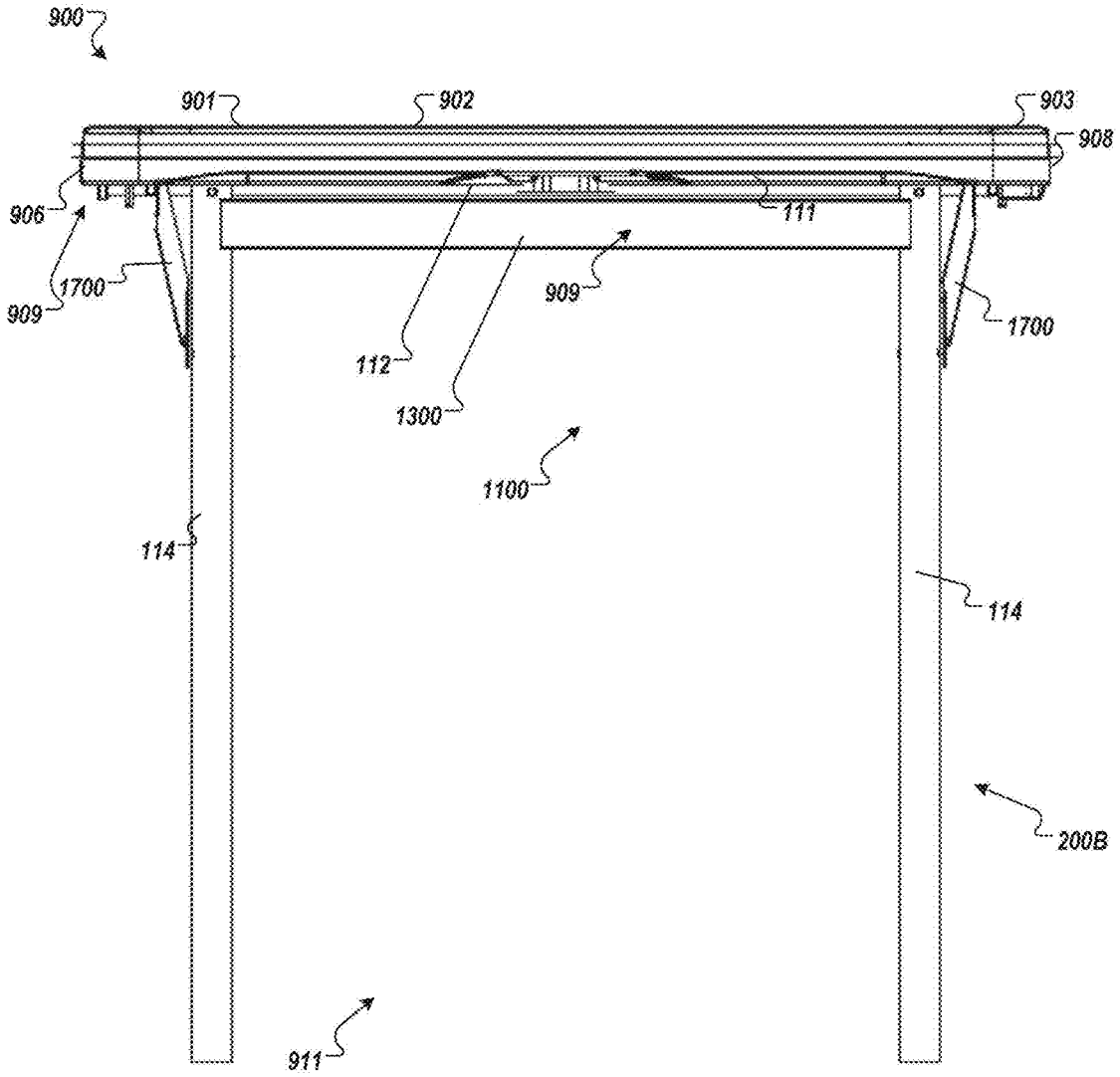
FIG. 9D is an end view of the table shown in FIG. 9A.
Figure 10:
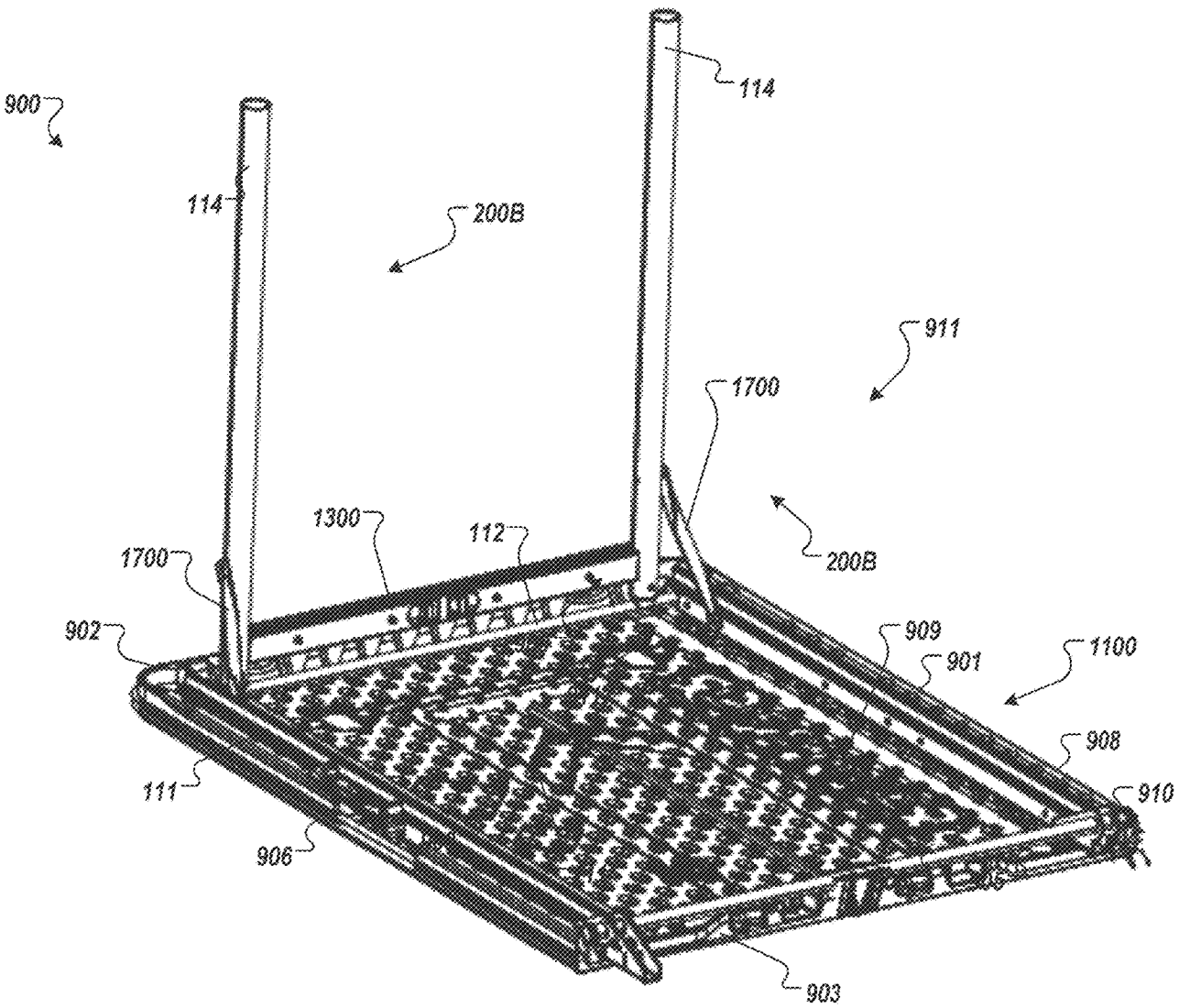
FIG. 10 is an enlarged view of a portion of the table shown in FIG. 9A, depicting an exemplary leg assembly attached to an exemplary tabletop.

Referring to FIGS. 9C and 9D, the support assembly 1100 and the leg assemblies 200B may be sized, shaped, configured, and/or arranged to open up, increase, or vacate the volume, generally indicated by item number 911, below the tabletop 901. For instance, in some existing tables, the leg assemblies may include an angled support. The angled support may extend from a center of the tabletop to a cross member of the leg assemblies. Accordingly, the angled support may occupy the volume (e.g., 911) below the tabletop. Presence of the angled support may interfere with chairs or a user's legs, which may limit the use of the table. Accordingly, the exemplary embodiments described in the present disclosure may not include that type of angled support. Specifically, the second table 900 may not include a structure that extends from a center 910 of the tabletop 901 to the leg assemblies 200. Instead, the leg assemblies 200B may include brace members 1700. The brace members 1700 may be coupled between a frame 111 and the leg assemblies 200B. The brace members 1700 may be located near outer edges of the tabletop 101. The locations of the brace members 1700 and the omission of structures in the volume 911 may open up or increase the volume 911 below the tabletop 101.

The second table 900 shown in FIGS. 9A-10 is an exemplary fold-in-half table. Accordingly, the tabletop 901 may include a first portion 903 and a second portion 905. Each of the first portion 903 and the second portion 905 may be constructed from plastic such as a high-density polyethylene (HDPE). The first portion 903 and the second portion 905 may be constructed from different processes, such as blow-molding. Additionally, or alternatively, each of the first portion 903 and the second portion 905 may be integrally constructed as part of a unitary, one-piece structure that may be formed using a blow molding process.

The exemplary fold-in-half table shown in FIGS. 9A-10 may have a length of about 71.9 inches between a first end 902 and a second end 904. The fold-in-half table may have a width of about thirty inches between a first side 906 and a second side 908. In other embodiments, the leg assembly, such as the leg assembly 200B, may be implemented in other tables or other structures, which may also be blow-molded structures. For instance, the leg assemblies 200B may be implemented in banquet tables (e.g., tables that are 72 inches in length, tables that are 96 inches in length, etc.), seminar tables, folding tables, nesting tables, round tables, bistro tables, fold-in-half round tables, benches, picnic tables, and the like.

With reference to FIGS. 9A-10, the leg assemblies 200B may include a support element 112 and the support element may be rotatably coupled to the frame 111. The leg assemblies 200B may also include a translation mechanism 114 and the translation mechanism may be retained relative to the support element 112. The brace members 1700 may be coupled between the translation mechanism 114 and the frame 111. As the support element 112 transitions between the first position and the second position, the brace members 1700 may rotate and the translation mechanism 114 may translate a long a portion of the support element 112. In the depicted exemplary embodiment, for the support element 112 to rotate, the translation mechanism 114 may translate and the brace member 1700 may rotate. Accordingly, in the use configuration, the leg assembly 200 may be locked, which may secure the translation mechanism 114 relative to the support element 112.

For example, the leg assemblies 200B may include a lock device, such as the lock device 400. The lock device 400 may be configurable in an engaged arrangement in which the lock device 400 may fix the translation mechanism 114 to the support element 112. The lock device 400 may be configured in the engaged arrangement when the leg assemblies 200B are in the use configuration. Accordingly, in the engaged arrangement, the leg assemblies 200 may be fixed such that the translation mechanism 114 cannot translate relative to the support element 112. Also, the lock device 400 may be configurable in a disengaged arrangement in which the translation mechanism 114 is not fixed relative to the support element 112. In the disengaged arrangement, the leg assemblies 200 may transition from the second position to the first position or between a use configuration and a storage configuration.

Referring to FIG. 9B, the second table 900 may include the second leg assembly 200B. In other embodiments, the second table 900 may include one or two of the first leg assemblies 200A described elsewhere in the present disclosure.

Figure 11A:
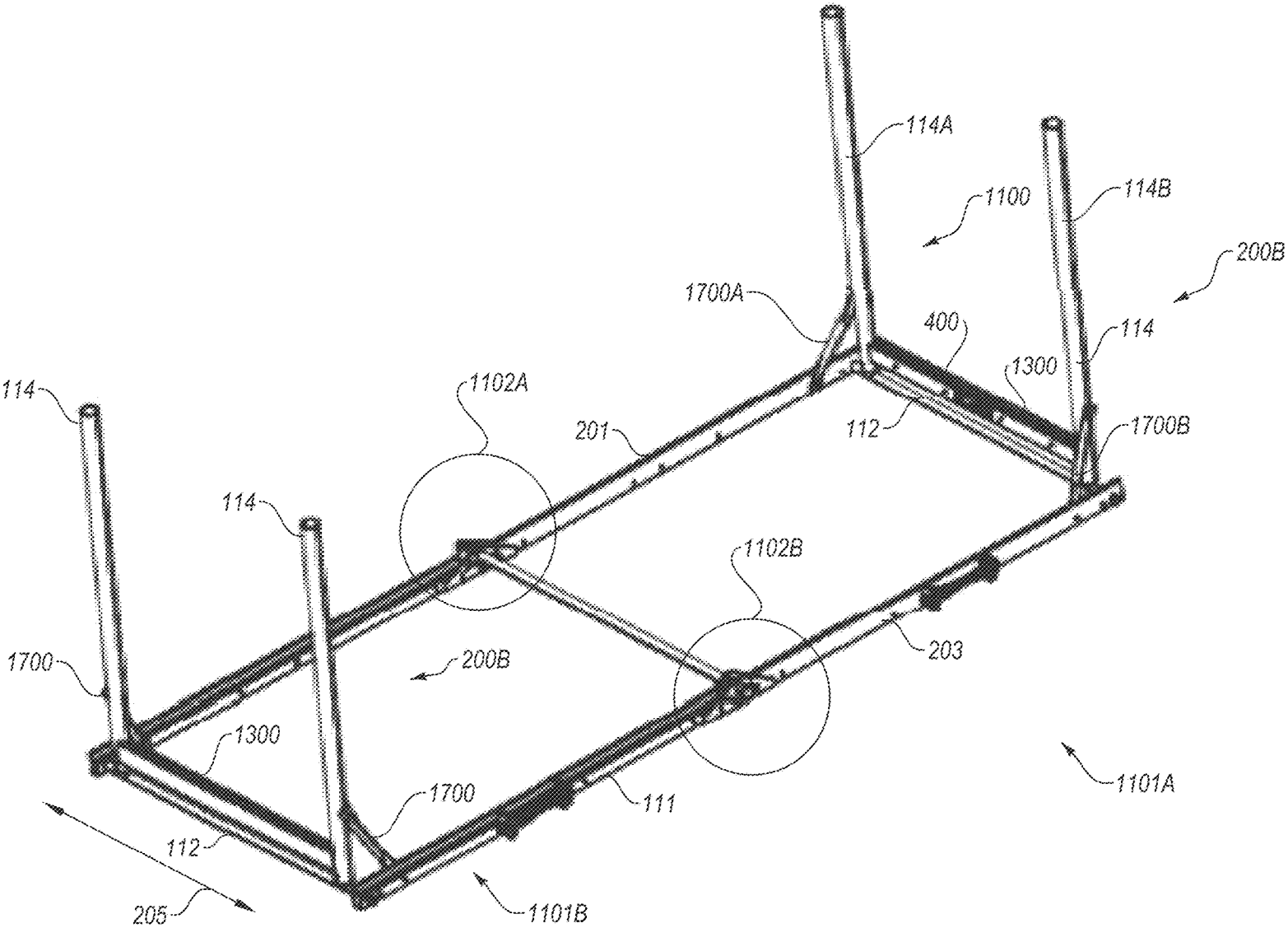
FIG. 11A illustrates an exemplary support assembly with the leg assemblies disposed in a use arrangement.
Figure 11B:
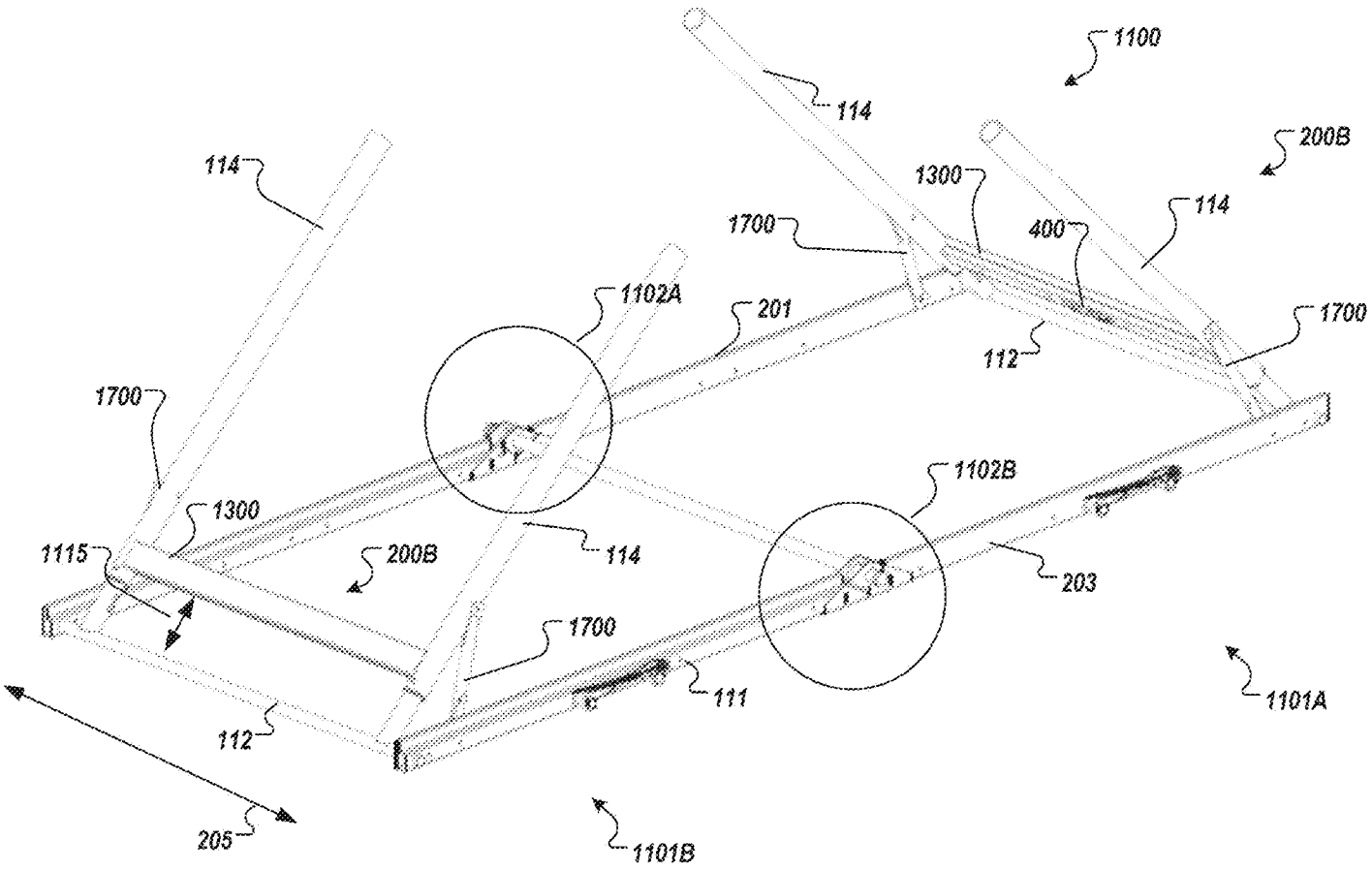
FIG. 11B illustrates the support assembly shown in FIG. 11A with the leg assemblies disposed in a partially folded arrangement.
Figure 11C:
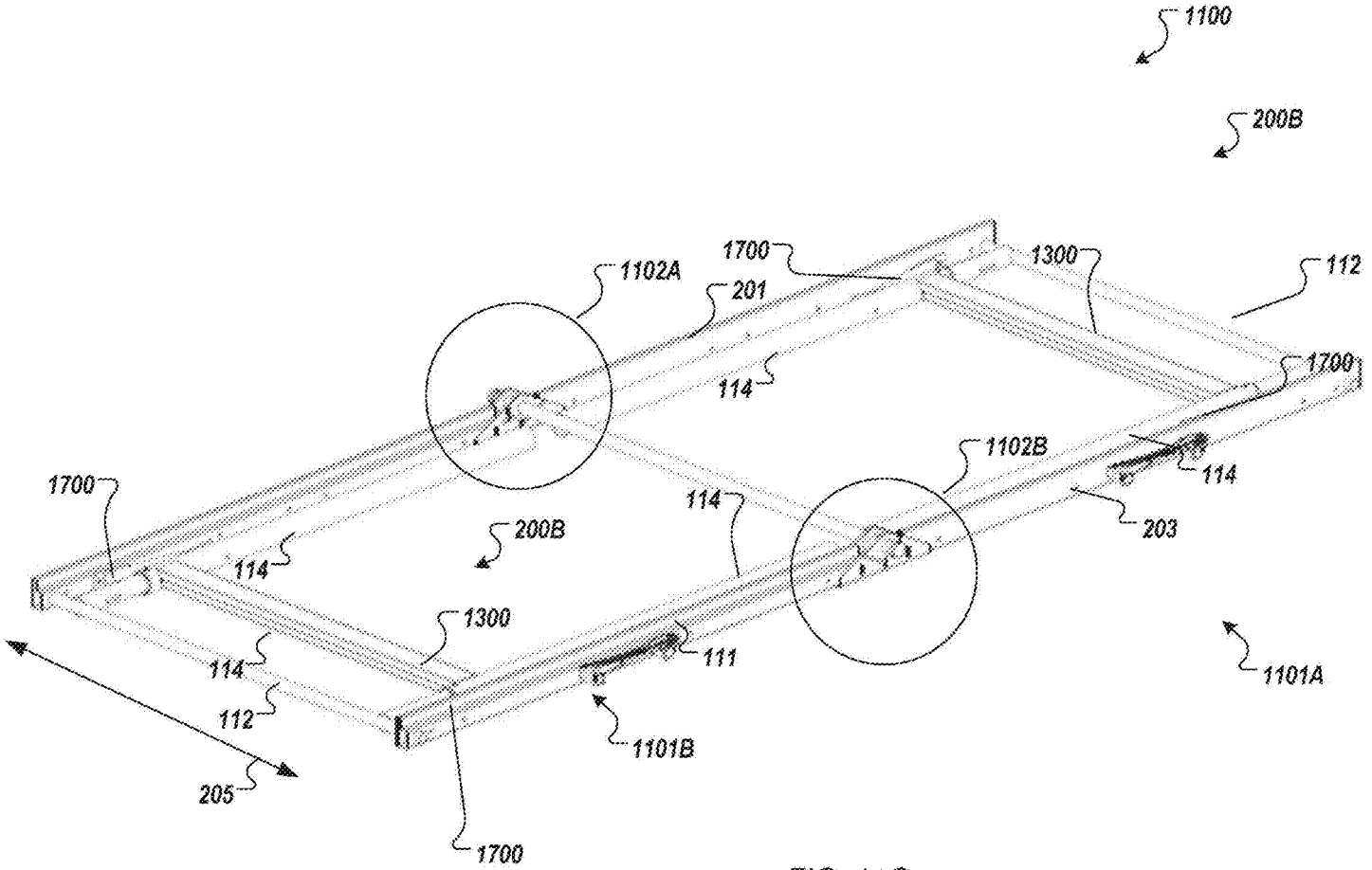
FIG. 11C illustrates the support assembly shown in FIG. 11A with the leg assemblies disposed in a storage arrangement.

FIGS. 11A-11C illustrate an exemplary embodiment of the support assembly 1100 that may be implemented in a structure such as the second table 900 shown in FIGS. 9A-9D or the first table 100 shown in FIGS. 1A-1D. FIG. 11A illustrates the support assembly 1100 with the second leg assemblies 200B disposed in a use arrangement or configuration. FIG. 11B illustrates the support assembly 1100 of FIG. 11A with the leg assemblies 200B disposed in partially folded arrangement or configuration. FIG. 11C illustrates the support assembly 1100 of FIG. 11A with the leg assemblies 200B disposed in a storage arrangement or configuration.

With reference to FIGS. 11A-11C, the support assembly 1100 may include the frame 111 and the leg assemblies 200B. The support assembly 1100 may be generally configured to selectively support a tabletop such as the tabletop 101 shown in FIGS. 1A-1D or the tabletops 901A and 901B shown in FIGS. 9A-9D. In the depicted embodiment, the support assembly 1100 is configured for use with a fold-in-half table. Some additional embodiments of a suitable fold-in-half table may be as described in U.S. Pat. No. 8,573,139, which is incorporated herein by reference in its entirety. The frame 111 shown in FIGS. 11A-11C may include hinges 1102A and 1102B, which may enable a first portion 1101A of the support assembly 1100 to be folded over on a second portion 1101B of the support assembly 1100.

The support assembly 1100 may also be used in connection with other structures or other tables (e.g., banquet tables, round tables, etc.), benches, etc. Some adaptations may be required to the frame 111 to use the support assembly 1100 with the table 100, however, the leg assemblies 200B may operate substantially as described in the following paragraphs.

With reference to FIGS. 11A-11C, the leg assemblies 200B may be configured to rotate relative to the frame 111. For instance, the leg assemblies 200B may rotate from a first angular position in which the leg assemblies 200B are disposed substantially perpendicular to the frame 111 (such as shown in FIG. 11A) to a second angular position in which the leg assemblies 200B are disposed substantially parallel to the frame 111 (such as shown in FIG. 11C). FIG. 11B depicts the leg assemblies 200B transitioning from the first angular position to the second angular position.

The support assembly 1100 may include the frame 111, the support element 112, the translation mechanism 114, the lock device 400, the brace members 1700, and/or the lateral structure 1300. The frame 111 may include the first longitudinal structure 201 and the second longitudinal structure 203. The first longitudinal structure 201 may be separated by the lateral frame dimension 205 from the second longitudinal structure 203. The leg assemblies 200B may be positioned within the first and second longitudinal structures 201 and 203. For instance, with reference to FIG. 11A, a first brace member 1700A may be rotatably coupled to the first longitudinal structure 201 at a first end and to a first translational mechanism 114A at a second end. The first translational mechanism 114A may be retained relative to the support element 112, which may be rotatably coupled to the frame 111. The first translational mechanism 114A may be coupled to a second translational mechanism 114B by the lateral structure 1300. The second translational mechanism 114B may also be retained relative to the support element 112. The second translational mechanism 114B may be coupled to a second brace member 1700B at a first end. At a second end of the second brace member 1700B, the brace member 1700B may be rotatably coupled to the second longitudinal structure 203. Accordingly, the second leg assembly 200B and the brace members 1700 may be at least partially located between the first and second longitudinal structures 201 and 203.

Referring to FIG. 11A, the second leg assemblies 200B are disposed in a use configuration. In the use configuration, the leg assemblies 200B are disposed substantially perpendicular to the frame 111. The translation mechanisms 114 may be positioned on a surface to support the frame 111 above the surface. In the use configuration, the lock device 400 may be disposed in an engaged arrangement. In the engaged arrangement, the lock device 400 may fix the translation mechanism 114 relative to the support element 112. Also, in the use configuration, the translation mechanism 114 may be translated towards the support element 112 and the brace members 1700 may be oriented at an angle relative to the translation mechanism 114.

Referring to FIG. 11B, to transition the second leg assemblies 200B, the lock device 400 may be transitioned from the engaged arrangement to a disengaged arrangement. When the lock device 400 is in the disengaged arrangement, the translational mechanism 114 may not be fixed to the support element 112. Accordingly, the translational mechanism 114 may translate relative to the support element 112 as the support element 112 rotates relative to the frame 111. Additionally, the brace members 1700 may rotate with the translational mechanism 114 as the support element 112 rotates. In particular, with reference to FIG. 11B, the second leg assembly 200B may rotate in a direction represented by arrow 1119. As the second leg assembly 200B rotates in the direction 1119, the brace member 1700 may rotate in the same direction, which is represented by arrow 1117. Moreover, as the second leg assembly 200B rotates, a distance 1115 between the lateral structure 1300 and the support element 112 may increase.

Referring to FIG. 11C, the support assembly 1100 is depicted in a storage configuration. In the storage configuration, the leg assemblies 200B may be disposed substantially parallel to the frame 111. The translation mechanisms 114 may be positioned in a volume at least partially defined by the frame 111. In the storage configuration, the lock device 400 may also be in the disengaged arrangement, which may allow the translational mechanism 114 to translate relative to the support element 112. Also, in the storage configuration, the brace members 1700 may be positioned between the translational mechanism 114 and an inner surface of the frame 111.

Figure 12:
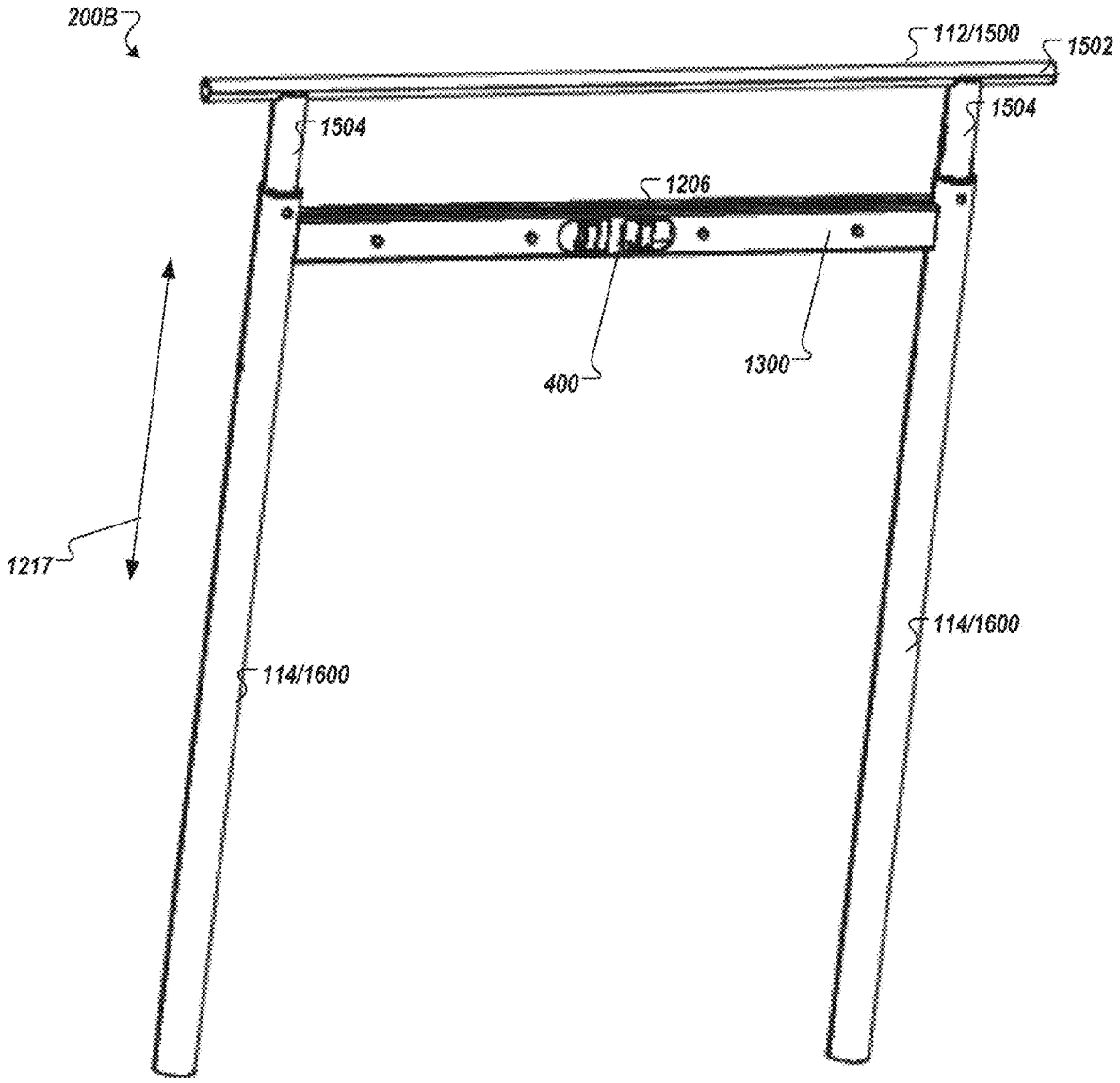
FIG. 12 illustrates an exemplary embodiment of a leg assembly.
Figure 13:
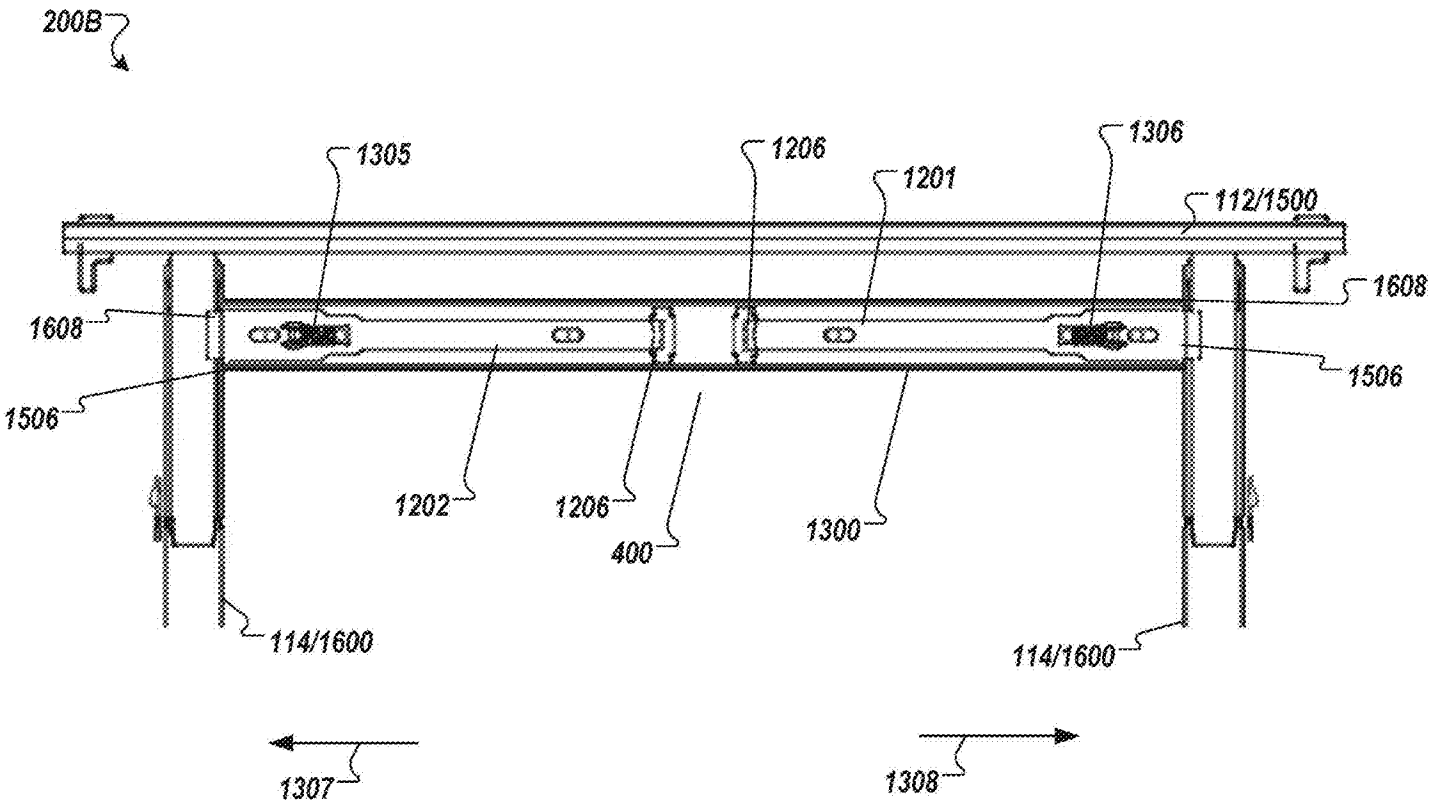
FIG. 13 is a sectional view of a portion of the leg assembly shown in FIG. 12.
Figure 14A:
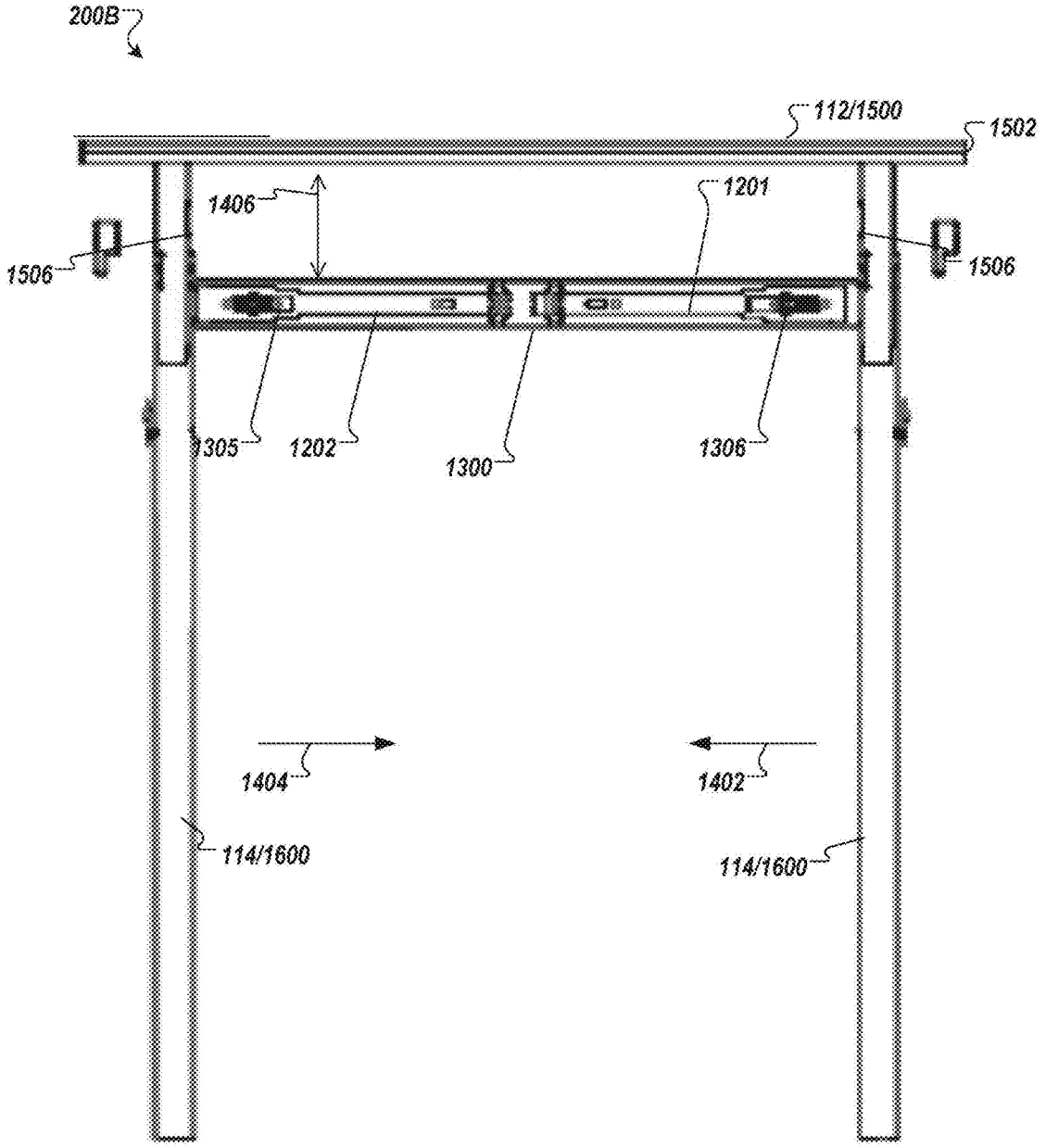
FIGS. 14A and 14B illustrate an exemplary leg assembly with an exemplary translation mechanism translating on an exemplary support element.
Figure 14B:
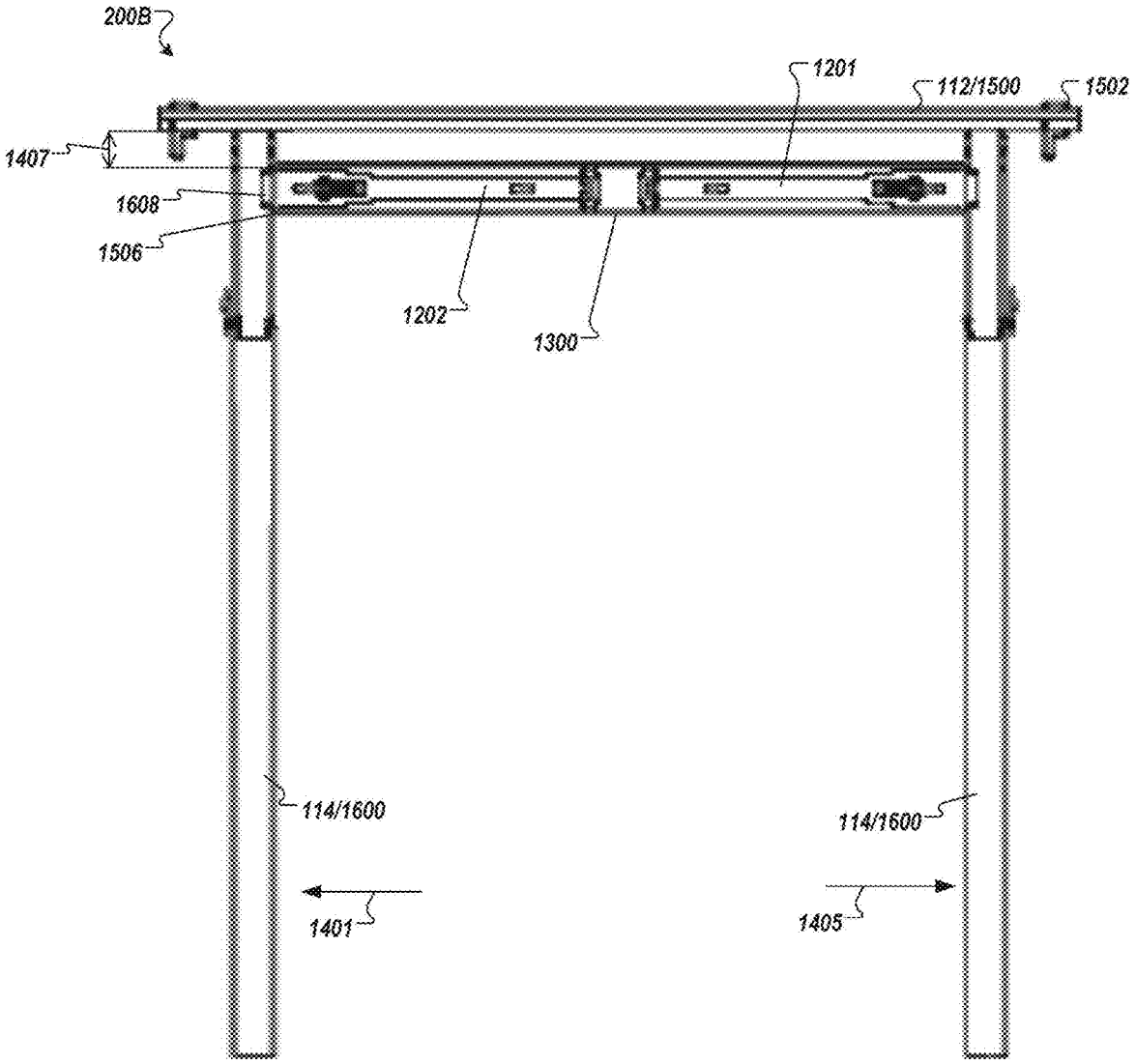

FIG. 12 illustrates an exemplary embodiment of the second leg assembly 200B that may be implemented in a structure such as the first table 100 or second table 900 described above. FIG. 13 depicts a sectional view of a portion of the second leg assembly 200B shown in FIG. 12. FIGS. 14A and 14B illustrate the second leg assembly 200B with an exemplary translation mechanism 114/1600 translating on an exemplary support element 112/1500.

With combined reference to FIGS. 12-14B, the second leg assembly 200B may include the support element 112, the translation mechanism 114, the lock device 400, and/or a lateral structure 1300. The second leg assembly 200 shown in FIGS. 12-14B may include one or more components and the support element 112 may also be labeled "1500," which is further described in FIG. 15. The second leg assembly 200 may include one or more translation mechanisms, such as two translation mechanisms 114. As shown in FIG. 12, the translation mechanism 114 may include a sleeve structure and the sleeve structure may at least partially surround the elongated structure 1504 of the support element 112. The translation mechanisms may also be labeled "1600" to correspond to a leg, which is further described with reference to FIG. 16.

The support element 112 may be rotatably coupled to a first longitudinal structure and a second longitudinal structure. For example, the support element 112 may include an end structure 1502 attached to an elongated structure 1504. The end structure 1502 may be rotatably coupled to the first longitudinal structure and the second longitudinal structure such that the leg assembly 200B is rotatable relative to the frame between a first position and a second position. The elongated structure 1504 may extend into the translation mechanism 114, which may be configured to translate along a portion of the support element 112 as the support element 112 rotates relative to the frame.

The translation mechanism 114 may be retained relative to the support element 112. For instance, the translation mechanism 114 may be slidably retained relative to the support element 112 such that the translation mechanism 114 translates relative to the support element 112 in a particular direction. In the exemplary embodiment shown in FIG. 12, the translation mechanism 114 may translate in a direction indicated by arrow 1217. Because the brace members (1700) may be rotatably coupled between the translation mechanism 114 and the frame, in order for the support element 112 to rotate, the translation mechanism 114 may translate. Accordingly, fixing the translation mechanism 114 relative to the support element 112 may prevent the support element 112 from transitioning between the use position and the storage position.

The lateral structure 1300 may be attached to the translation mechanism 114. For example, in the depicted embodiment, the lateral structure 1300 may extend from a translation mechanism, such as a first translation mechanism 114 (e.g., a first leg 1600), to another translation mechanism, such as a second translation mechanism 114 (e.g., a second leg 1600).

The lateral structure 1300 may be shell structure, which may be configured to retain the lock device 400. Accordingly, the lock device 400 may be at least partially disposed in the lateral structure 1300. The lock device 400 may include a compression mechanism 1206. The compression mechanism 1206 may include one or more buttons, such as two buttons. The two buttons may be disposed in an opposed configuration. A user may actuate the compression mechanism 1206 by drawing or pushing the two opposed buttons towards one another. The act of drawing the opposed buttons of the compression mechanism 1206 towards one another may pull lock tabs 1201 and 1202 towards a center portion of the leg assembly 200B. With sufficient force, the lock tabs 1201 and 1202 may be withdrawn from receivers 1506, which may be defined in the support element 112. When the lock tabs 1201 and 1202 are withdrawn from the receivers 1506 and into the lateral structure 1300, the translation mechanism 114 may be able to translate relative to the support element 112.

The lock device 400 may be configurable in two arrangements. In an engaged arrangement, which is shown in FIGS. 13 and 14B, the lock tabs 1201 and 1202 may extend from the sides of the lateral structure 1300 and may be received in the receiver 1506. The lock tabs 1201 and 1202 may also extend through openings 1608 in the translation mechanism 114. In the engaged arrangement, the lock device 400 may fix the translation mechanism 114 relative to the support element 112. Accordingly, the translation mechanism 114 may not translate relative to the support element 112, which may prevent the support element 112 from rotating.

With reference to FIG. 13, the lock tabs 1201 and 1202 are depicted engaged in the receiver 1506, which may correspond to the engaged arrangement of the lock device 400. The lock tabs 1201 and 1202 may be biased by a biasing member such as one or more springs 1305 and 1306. For instance, in the depicted embodiment, the lock tabs 1201 and 1202 may be biased away from one another such that the lock tabs 1201 and 1202 are biased towards being introduced and retained in the receivers 1506. Specifically, as shown in the accompanying figures, a first lock tab 1201 may be biased in a direction indicated by arrow 1307 and a second lock tab 1202 may be biased in a direction indicated by arrow 1308. In other embodiments, the lock tabs 1201 and 1202 may be otherwise biased.

Referring back to FIGS. 12-14B, the lock device 400 may also be configurable in a disengaged arrangement, which is depicted in FIGS. 12 and 14B. In the disengaged arrangement, the lock tabs 1201 and 1202 may be withdrawn from the receivers 1506 and into the lateral structure 1300. The translation mechanism 114 may accordingly translate relative to the support element 112, which may enable the support element 112 to rotate relative to a frame. To transition the lock device 400 from the engaged arrangement to the disengaged arrangement, a user may press the buttons on the compression mechanism 1206 towards one another. The buttons may translate these forces to the lock tabs 1201 and 1202 and retract them from the receivers 1506.

Referring to FIGS. 14A and 14B, the second leg assembly 200A is depicted in the disengaged arrangement and the engaged arrangement, respectively. Referring to FIG. 14A, the lock tabs 1201 and 1202 are pulled towards one another. The direction the lock tabs 1201 and 1202 are moved are represented in FIG. 14A by arrows 1402 and 1404. The force applied to the buttons may be sufficient to overcome a spring force applied by springs 1305 and 1306. With the lock tabs 1201 and 1202 withdrawn from the receivers 1506, the translation mechanism 114 may translate relative to the support element 112. For instance, a distance 1406 between the end structure 1502 and a top of the lateral structure 1300 may increase.

In FIG. 14B, the lock tabs 1201 and 1202 may be pressed away from one another by the springs 1305 and 1306. When the lock tabs 1201 and 1202 are aligned with the receivers 1506, the lock tabs 1201 and 1202 may extend through the openings 1608 of the translation mechanisms 114 and into the receivers 1506. The direction the lock tabs 1201 and 1202 may move because of the springs 1305 and 1306 are represented in FIG. 14B by arrows 1401 and 1405. With the lock tabs 1201 and 1202 positioned in the receivers 1506, the translation mechanism 114 may be fixed to the support element 112, which may fix a distance 1407 between the end structure 1502 and a top of the lateral structure 1300.

Figure 15:
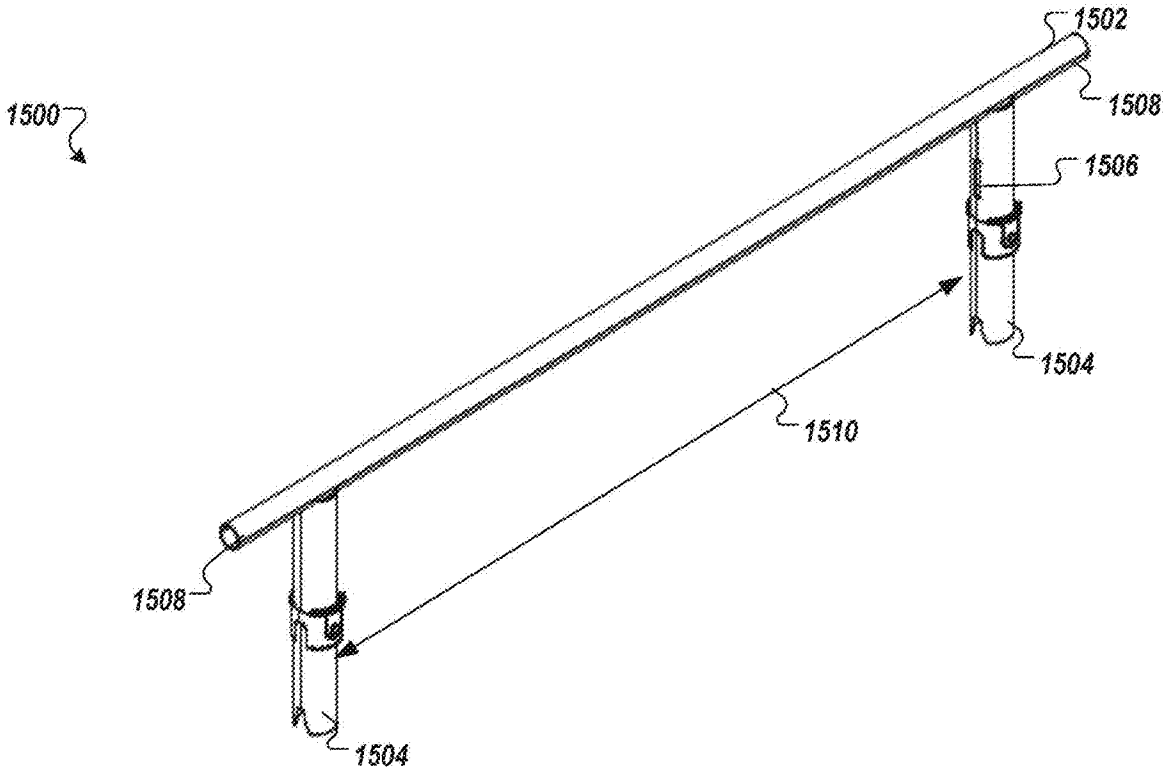
FIG. 15 illustrates an exemplary support element that may be implemented in the leg assembly.

FIG. 15 illustrates an exemplary support element 1500 that may be implemented in the second leg assembly 200 described in the present disclosure. The support element 1500 is an example of the support element 112 described above. Accordingly, the support element 1500 may be configured to be rotatably attached to a first longitudinal structure and a second longitudinal structure of a frame (e.g., the frame 111 described above).

The support element 1500 may include an end structure 1502 that is attached to one or more elongated structures 1504, which may be referred to in the embodiment of FIG. 15 as shaft supports. The shaft supports 1504 may extend substantially perpendicular to the end structure 1502. The shaft supports 1504 may each be configured to be received within a translation volume of a leg. For instance, the shaft supports 1504 may include a diameter and a length that enables the elongated structures 1504 to be received in the translation volume and for a corresponding translation mechanism to translate relative to the support element 1500.

The two shaft supports 1504 may be separated by a shaft support separation distance 1510. The shaft support separation distance 1510 may be less than a lateral frame dimension (e.g., 205) between the first and the second longitudinal structures of a frame. Thus, the shaft supports 1504 may be positioned within the fame of a table.

The end structure 1502 may be rotatably coupled to the frame. For example, the outer portions 1508 may be received by the first and the second longitudinal structures of the frame such that the support element 1500 is rotatable relative to the frame between the first position and the second position. The end structure 1502 may be rotatable relative to the frame, but the end structure may be fixed relative to the frame such that the end structure 1502 cannot be displaced.

The elongated structures 1504 may each define a receiver 1506 (an exemplary receiver is shown in FIG. 15). The receiver 1506 may be positioned on an inner surface of the elongated structures 1504 and the receivers 1506 may be disposed such that the receivers 1506 face one another. The receiver 1506 may be sized and shaped to receive a lock tab that extends from the lock device (e.g., 400) when the lock device is configured in the engaged arrangement. The size and position of the receivers 1506 may correspond to openings included on legs (e.g., the opening 1608 of the leg 1600 of FIG. 16). Accordingly, the lock tab may extend through the opening in the leg and into the receiver 1506. As described above, in some embodiments, the lock tabs may be spring biased such that the lock tabs are positioned in the receiver 1506.

Figure 16:
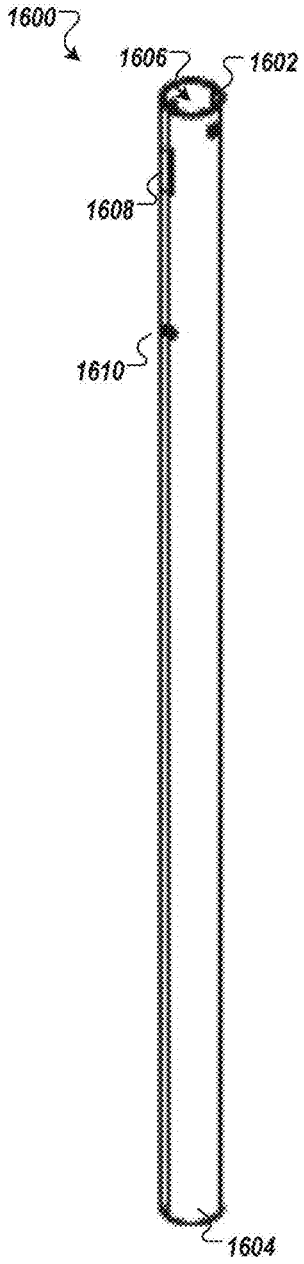
FIG. 16 illustrates an exemplary leg that may be implemented in the leg assembly.

FIG. 16 illustrates an exemplary leg 1600 that may be implemented in a leg assembly, such as the second leg assembly 200B. Exemplary embodiments of the second leg assembly 200B described in the present disclosure may include two of the legs 1600 shown in FIG. 16, which may be positioned on either side of the support element (e.g., the support element 1500 of FIG. 15 or support element 112). The leg 1600 of FIG. 16 is an example of the translation mechanism 114 described in the present disclosure. Accordingly, the leg 1600 may be configured to translate relative to the support element. For example, when the support element rotates from the first position to the second position, the leg 1600 may translate relative to the support element.

The leg 1600 of FIG. 16 may be substantially cylindrical and may extend from a first end 1602 to a second end 1604. At the first end 1602, the leg 1600 may define a translation volume 1606 in which a support shaft of the support element is disposed. As the support element rotates, the leg 1600 may translate relative to the support shaft, while maintaining the support shaft within the translation volume 1606.

The leg 1600 may also define an opening 1608 that is configured to receive a lock tab from a lock device (e.g., 400). The opening 1608 may be positioned to correspond to a receiver in the support shaft when the leg assembly 200B is in a use position. Thus, the lock tab may be disposed in the opening 1608 and the receiver when the leg assembly 200B is in the use position. The leg 1600 may also define one or more fastener openings 1610. The fastener openings 1610 may be configured to receive a fastener that attaches a brace member to the leg 1600.

Figure 17A:
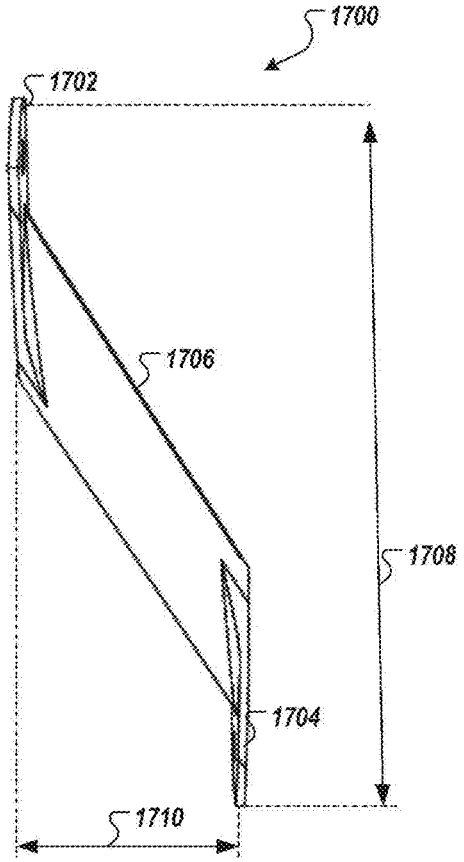
FIGS. 17A and 17B illustrate an exemplary brace member that may be implemented in a leg assembly.
Figure 17B:
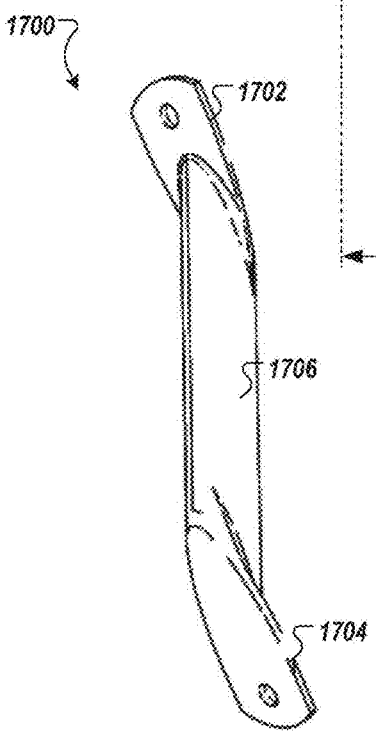

FIGS. 17A and 17B illustrate an exemplary brace member 1700 that may be implemented in a leg assembly, such as the first leg assembly 200A or the second leg assembly 200B described in the present disclosure. FIG. 17A is a first perspective view of the brace member 1700. FIG. 17B is a second perspective view of the brace member 1700. The brace member 1700 may be configured to be disposed between a frame (e.g., frame 111) and an outer portion of the translation mechanism (e.g., translation mechanism 114). For instance, the brace member 1700 may be configured to be rotatably attached to the frame and rotatably attached to the translation mechanism.

The brace member 1700 may include two ends 1702 and 1704, which may define an opening. The ends may be attached to the frame and the translation mechanism, respectively. The ends 1702 and 1704 may be substantially parallel to one another in some embodiments. The ends 1702 and 1704 may be connected by a brace end connector 1706. The brace end connector 1706 may be angled between or otherwise attach the ends 1702 and 1704. The angle of the brace end connector 1706 relative to the ends 1702 and 1704 and length of the brace end connector 1706 may determine a length 1708 (such as shown in FIG. 17A) and a width 1710 (such as shown in FIG. 17A) of the brace member 1700. The length 1708 may be sized such that the translation member can smoothly translate relative to the support element (e.g., 112) as the support element rotates between the first position and the second position. The width 1710 may be sized based on a lateral frame dimension (e.g., 205) and a distance between the translation members.

As described above, the leg assemblies 200A and 200B may be configured in a use arrangement when the leg assemblies 200A and 200B are disposed at an angle of about ninety degrees (90°) relative to the tabletop 101 or 901. For example, the use arrangement of the tables 100 and 900 can be seen in FIGS. 1A-2 and 9A-10, respectively. In some circumstance, a user may configure the tables 100 and/or 900 in the use arrangement by rotating the leg assemblies 200A and/or 200B relative to the tabletops 101 or 901. As described above, when leg assemblies 200A and/or 200B are disposed at an angle of about ninety degrees (90°), ends of the lock tabs 803 and 805 or 1201 and 1202 may be positioned in the receivers 613 or 1506. In these mechanisms, there may be an engaged position (in which the lock tabs 803, 805, 1201, and 1202 are positioned in the receivers 613 or 1506) and a disengaged position (in which the lock tabs 803, 805, 1201, and 1202 are not positioned in the receivers 613 or 1506). In some circumstances, the leg assemblies 200A and 200B may be rotated relative to the tabletops 101 and 901. However, the lock tabs 803, 805, 1201, and 1202 may not be positioned or fully positioned in the receivers 613 or 1506. For example, a user may erroneously think that the leg assemblies 200A and 200B are engaged or locked when they are not. The user may begin to use the table 100 or 900 with the leg assemblies 200A or 200B in an unsafe condition. For instance, the table 100 or 900 may be loaded and/or a force applied to the table, which may cause the leg assemblies 200A or 200B to rotate relative to the tabletop 901 or 101. The table 100 or 900 may collapse or partially collapse by the leg assemblies 200A or 200B rotating towards the tabletop 101 or 901.

Accordingly, in the following paragraphs, some embodiments of a two-stage lock assembly are described. The two-stage lock assembly includes components that may address an improperly configured table. For instance, the two-stage lock assembly may provide an additional safety feature that may prevent or at least reduces the likelihood that the table 100 or 900 collapses in circumstances in which the leg assemblies 200A or 200B are not fully extended (e.g., to approximately ninety degrees relative to the tabletop). The two-stage lock assembly is described relative to the second leg assembly 200B. It may be understood with the benefit of this disclosure that the two-stage lock assembly may be implemented with the first leg assembly 200A or with other leg assemblies. Additionally, it may be understood that the two-stage lock assembly may be implemented with other tables or structures such as round tables, folding tables, nesting tables, bistro tables, fold-in-half round tables, benches, picnic tables, and the like.

Figure 18A:
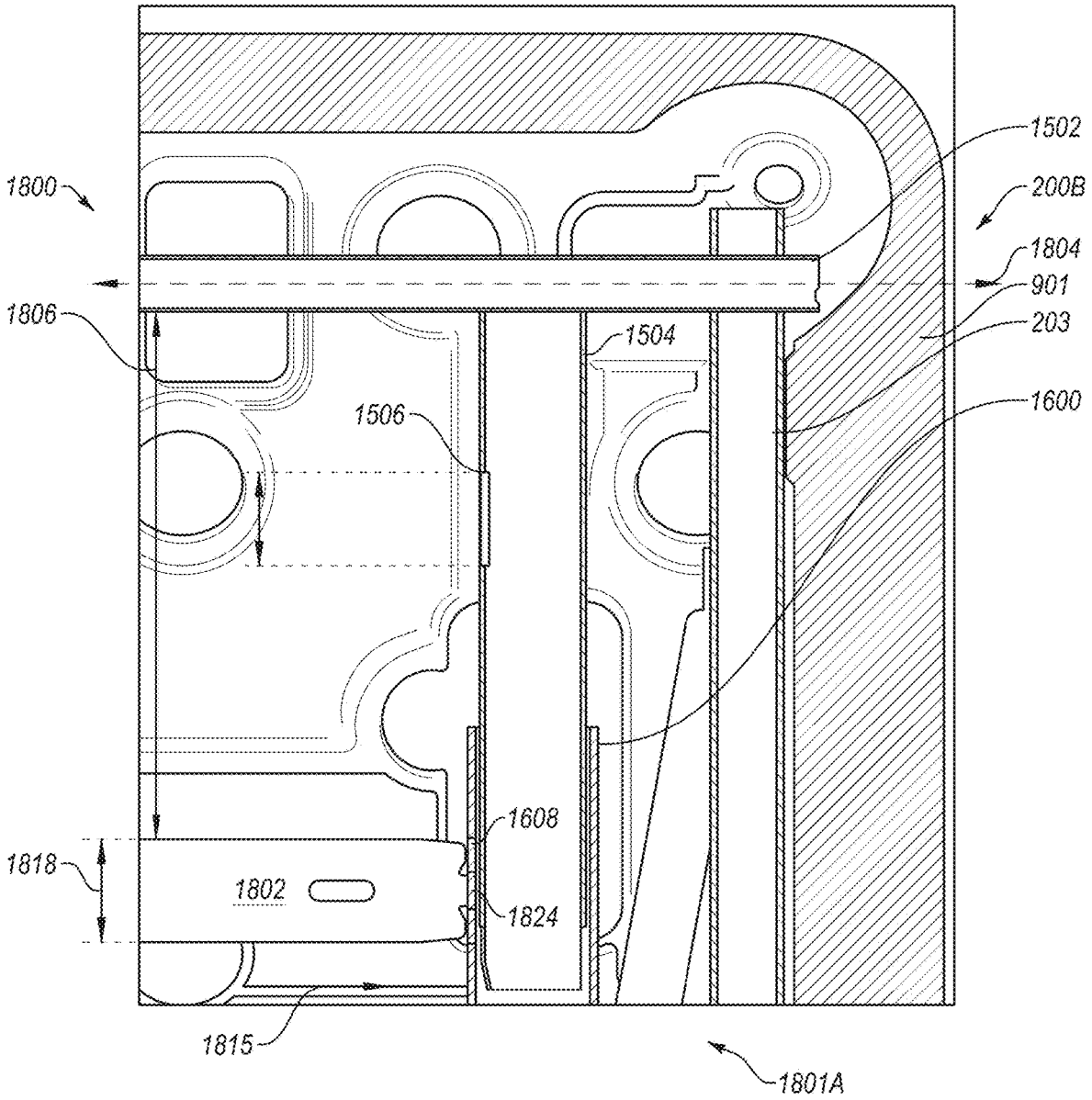
FIGS. 18A-18C depict an exemplary two-stage lock assembly that may be implemented in a lock device that may be implemented in a leg assembly.
Figure 18B:
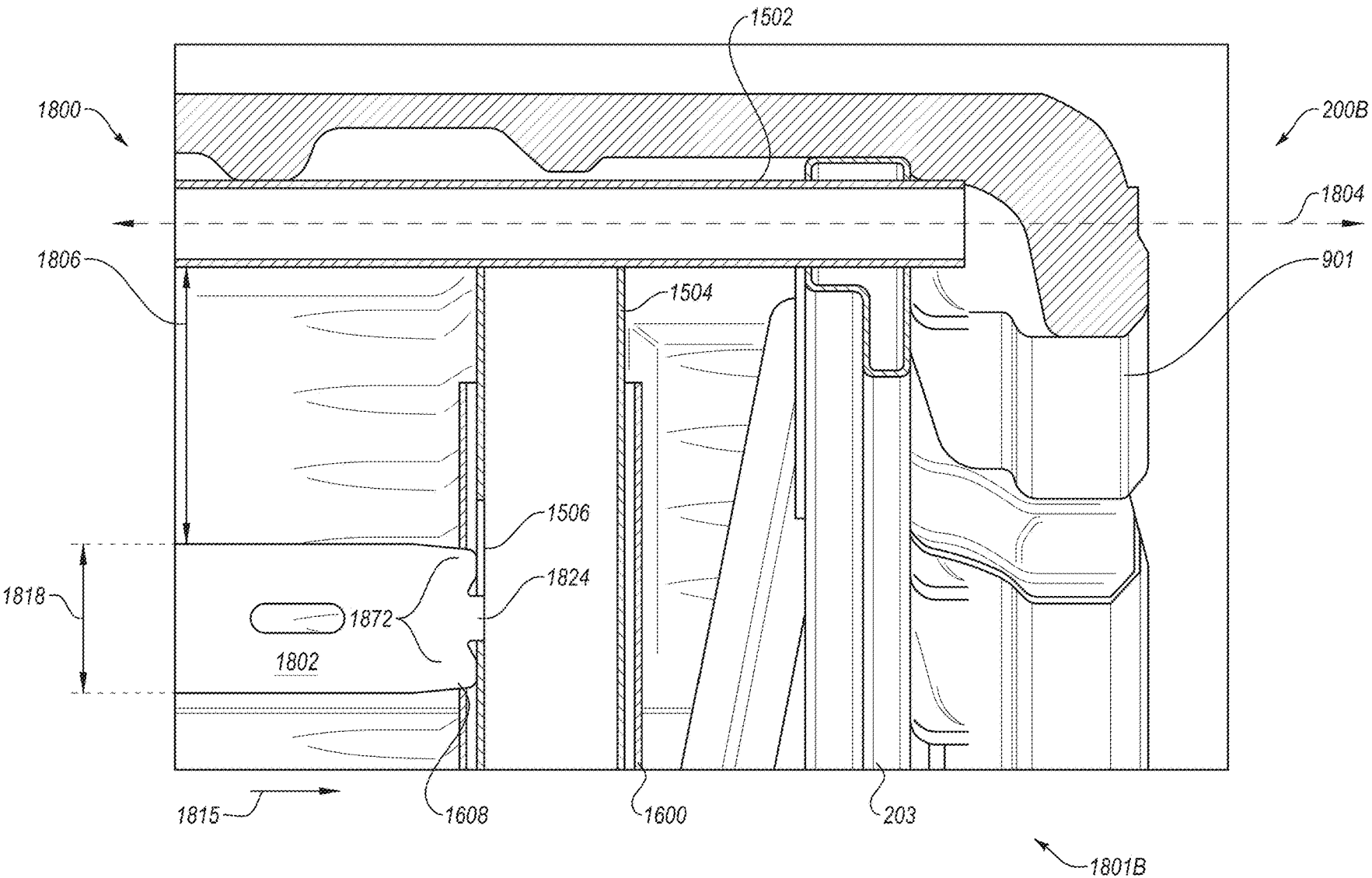
Figure 18C:
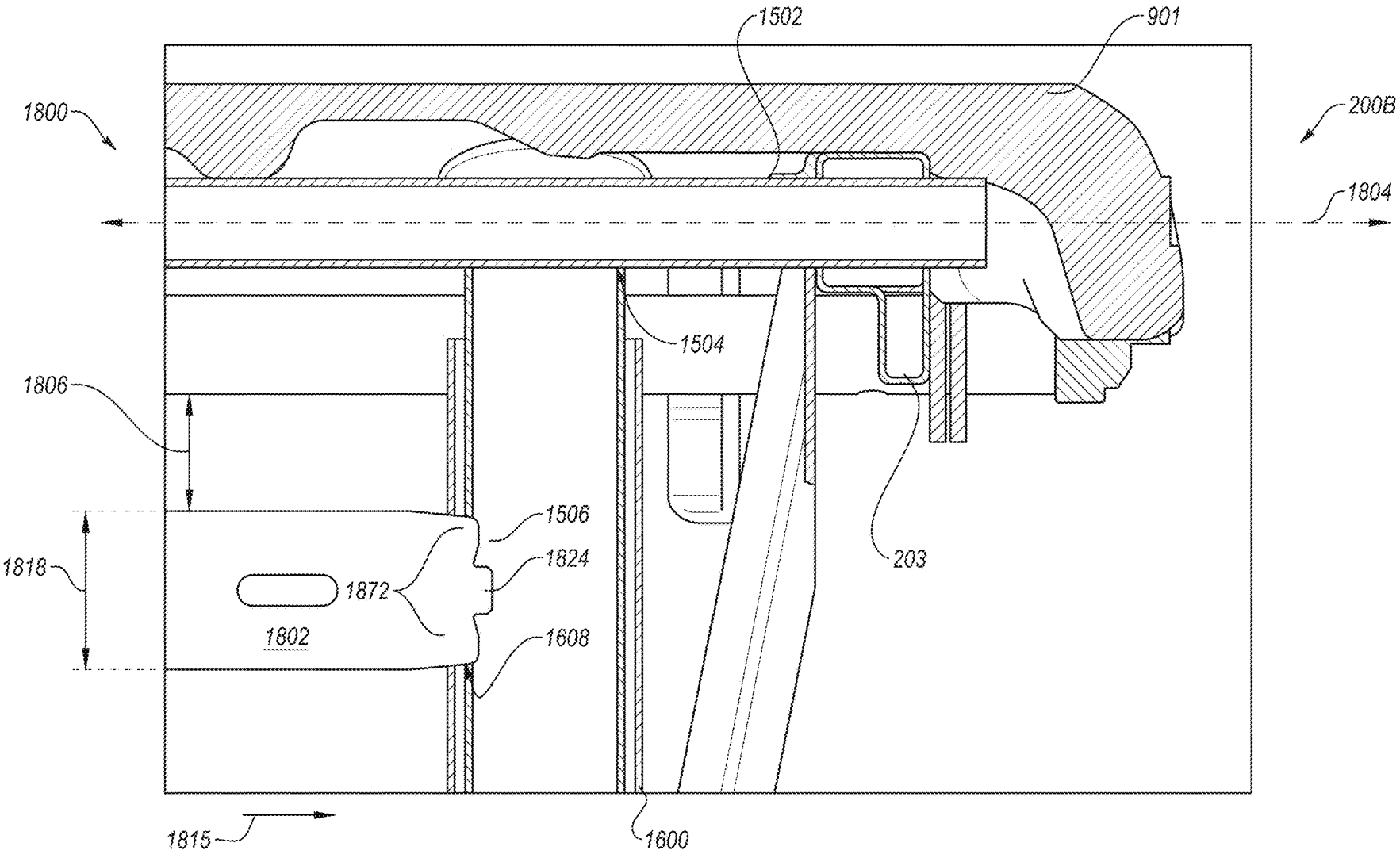

FIGS. 18A-18C depicts an example two-stage lock assembly 1800 that may be implemented in the lock device 400 described elsewhere in the present disclosure or another suitable lock device. FIGS. 18A-18C depict sectional views of a portion of the second leg assembly 200B implementing the two-stage lock assembly 1800. The two-stage lock assembly 1800 may also be implemented in the first leg assembly 200A or other suitable leg assemblies implemented with the first table 100 or the second table 900.

The portion of the second leg assembly 200B shown in FIGS. 18A-18C includes an upper portion of the leg 1600 and a portion of the end structure 1502 with the elongated structure 1504 extending into the leg 1600. FIGS. 18A-18C also includes a corner portion of a tabletop, such as the tabletop 901, with a portion of the longitudinal structure 203 attached to the tabletop 901. The sectional planes of FIGS. 18A-18C may bisect the end structure 1502 and the leg 1600 such that the receiver 1506 and the opening 1608 are visible.

The two-stage lock assembly 1800 may include a multi-element lock tab 1802. The multi-element lock tab 1802 may be disposed in a lateral structure such as the lateral structure 1300 described in FIG. 13. The lateral structure is omitted in FIGS. 18A-18C. Additionally, other components of the lock device (e.g., lock device 400) are omitted in FIGS. 18A-18C.

FIG. 18A depicts the two-stage lock assembly 1800 in a disengaged configuration 1801A. FIG. 18B depicts the two-stage lock assembly 1800 in a first engaged configuration 1801B. FIG. 18C depicts the two-stage lock assembly 1800 in a second engaged configuration 1801C. Each of these configurations 1801A-1801C is described below.

Referring to FIG. 18A, the disengaged configuration 1801A may occur when the leg 1600 and the end structure 1502 are positioned at an angle that is less than a first engagement angle. The first engagement angle may be an angle at which a first element 1824 of the multi-element lock tab 1802 enters the receiver 1506. For example, the leg assembly 200B may be in the disengaged configuration 1801A when the leg 1600 and the end structure 1502 are at an angle between about 0 degrees (e.g., against or immediately adjacent to the tabletop 901) and about 69 degrees relative to the tabletop 901. In this example, the first engagement angle may be about 70 degrees. In other embodiments, the first engagement angle may be any angle between about 69 degrees and about 89 degrees. In these embodiments, the leg assembly 200B may be in the disengaged configuration 1801A when the leg 1600 and the end structure 1502 are positioned in a range from about 0 degrees to the corresponding first engagement angle.

In the disengaged configuration 1801A, the first element 1824 may be positioned in the opening 1608 of the leg 1600. An end of the first element 1824 may abut or contact an outer surface of the elongated structure 1504. The outer surface of the elongated structure 1504 may prevent the multi-element lock tab 1802 from moving in an outward direction, which is represented by arrow 1815. For example, the two-stage lock assembly 1800 may be outwardly biased. In these embodiments, the multi-element lock tab 1802 may be biased or pushed by a spring or another biasing mechanism in the outward direction 1815. As the leg 1600 and the end structure 1502 are positioned at an angle between 0 degrees and the first engagement angle, the first element 1824 may be positioned in the opening 1608 and against the outer surface of the elongated structure 1504.

To transition the two-stage lock assembly 1800 to the first engaged configuration 1801B as shown in FIG. 18B, the leg 1600 and the end structure 1502 may be rotated relative to the tabletop 901. For instance, the leg 1600 and the end structure 1502 may be rotated about an axis 1804. As the leg 1600 and the end structure 1502 rotate, the leg 1600 and the multi-element lock tab 1802 may translate up the elongated structure 1504, which may be towards the end structure 1502. For example, in FIG. 18A, the multi-element lock tab 1802 may be separated from the end structure 1502 by a first distance 1806. As the leg 1600 and the end structure 1502 rotate, the first distance 1806 may be reduced such that the multi-element lock tab 1802 is disposed closer to the end structure 1502.

Referring to FIG. 18B, the first engaged configuration 1801B may occur when the leg 1600 and the end structure 1502 are positioned at an angle between the first engagement angle and a second engagement angle. The first engagement angle may be an angle at which the first element 1824 enters the receiver 1506. The second engagement angle may be an angle at which a second element 1872 enters the receiver 1506.

For example, the leg assembly 200B may be in the first engaged configuration 1801B when the leg 1600 and the end structure 1502 are at an angle between about 70 degrees and about 89 degrees relative to the tabletop 901. In this example, the first engagement angle may be about 70 degrees and the second engagement angle may be about 89 or about 90 degrees. In other embodiments, the first engagement angle may be any angle between about 69 degrees and about 89 degrees and the second engagement angle may be any angle between about 85 degrees and about 95 degrees. In these embodiments, the leg assembly 200B may be in the first engaged configuration 1801B when the leg 1600 and the end structure 1502 are positioned in a range from the first engagement angle and the second engagement angle.

In the first engaged configuration 1801B, the opening 1608 may overlap a lower portion of the receiver 1506. For instance, the leg 1600 may translate towards the end structure 1502 (reducing the distance 1806) such that the opening 1608 becomes aligned with a lower portion with the receiver 1506. Alignment between the opening 1608 and the lower portion of the receiver 1506 may enable the first element 1824 to move outwardly into the receiver 1506. For example, the first element 1824 may transition from abutting the outer surface of the elongated structure 1504 to being positioned in the receiver 1506. When the first element 1824 is positioned in the receiver 1506, the second element 1872 may be positioned in the opening 1608. An end surface of the second element 1872 may abut or contact the outer surface of the elongated structure 1504.

Additionally, in the depicted exemplary embodiment, the opening 1608 may include a height that substantially corresponds to a height 1818 of the multi-element lock tab 1802. Correspondence between the height of the opening 1608 and the height 1818 of the multi-element lock tab 1802 may enable a tight fit, which may assist in stability of the leg assembly 200B.

As mentioned above, the multi-element lock tab 1802 may be outwardly biased. Accordingly, as soon as the leg 1600 and the end structure 1502 are rotated to the first engagement angle, the first element 1824 may be pushed into the receiver 1506 and the second element 1872 may be pushed into the opening 1608.

With the first element 1824 in the receiver 1506, the leg 1600 may be prevented from translating in a direction away from the tabletop 901 and the end structure 1502. Prevention of such translation may further prevent the leg 1600 and the end structure 1502 from rotating relative to the tabletop 901. The first element 1824 may accordingly provide a safety feature when the leg 1600 and the end structure 1502 are not rotated to the second engagement angle.

For example, a user may inadequately rotate the leg 1600 and the end structure 1502. Without the first element 1824, inadequate rotation of the leg 1600 and the end structure 1502 may result in the lock tab not being introduced into the receiver 1506. Accordingly, the leg 1600 may not be locked relative to the end structure 1502, which may enable unintentional translation of the leg 1600 away from the end structure 1502 and collapse of the tabletop 901.

Thus, inclusion of the first element 1824 and positioning the first element 1824 in the receiver 1506 may reduce or prevent an unintentional collapse of the tabletop 901 when the leg 1600 and the end structure 1502 are not rotated to the second engagement angle. From the first engaged configuration 1801B, the second leg assembly 200B may be transitioned to the disengaged configuration 1801A and to the second engaged configuration 1801C. To transition the second leg assembly 200B, the multi-element lock tab 1802 may be removed or retracted from the opening 1608 and the receiver 1506. For instance, with reference to FIG. 18B and FIG. 13, the two-stage lock assembly 1800 may be implemented in the lock device 400. For example, the multi-element lock tab 1802 may be substituted for the lock tabs 1201 and 1202 of FIG. 13. To transition the second leg assembly 200B from the first engaged configuration 1801B to the disengaged configuration 1801A, a user may actuate the compression mechanism 1206 by drawing or pushing the two opposed buttons towards one another. Drawing the opposed buttons of the compression mechanism 1206 towards one another may pull the multi-element lock tabs 1802 towards a center portion of the leg assembly 200B. With sufficient force, the first elements 1824 of the multi-element lock tab 1802 may be withdrawn from receivers 1506. When the first elements 1824 of the multi-element lock tab 1802 are withdrawn from the receivers 1506 and into the lateral structure 1300, the second leg assembly 200B may be transitioned to the disengaged configuration 1801A.

To transition the two-stage lock assembly 1800 to the second engaged configuration 1801C as shown in FIG. 18C, the leg 1600 and the end structure 1502 may be rotated relative to the tabletop 901. For instance, the leg 1600 and the end structure 1502 may be rotated about the axis 1804. As the leg 1600 and the end structure 1502 rotate, the leg 1600 and the multi-element lock tab 1802 may translate up the elongated structure 1504, which may be towards the end structure 1502.

Referring to FIG. 18C, the second engaged configuration 1801C may occur when the leg 1600 and the end structure 1502 are positioned at the second engagement angle at which the second element 1872 may enter the receiver 1506. For example, the leg assembly 200B may be in the second engaged configuration 1801C when the leg 1600 and the end structure 1502 are at an angle between about 85 degrees and about 95 degrees relative to the tabletop 901.

In the second engaged configuration 1801C, the opening 1608 may overlap an operable portion of substantially all of the receiver 1506. For instance, the leg 1600 may translate towards the end structure 1502 (which may reduce the distance 1806) such that the opening 1608 becomes aligned with the receiver 1506. Alignment between the opening 1608 and the receiver 1506 may enable the second element 1872 to move outwardly into the receiver 1506. For example, the second element 1872 may transition from abutting the outer surface of the elongated structure 1504 to being positioned in the receiver 1506.

When the leg assembly 200B is in the second engaged configuration 1801C, the multi-element lock tab 1802 may lock the leg 1600 relative to the end structure 1502. For example, the multi-element lock tab 1802 may prevent the leg 1600 from translating relative to the elongated structures 1504, which may prevent the leg 1600 and the end structure 1502 from rotating relative to the tabletop 901. The leg assembly 200B may be transitioned from or to the disengaged configuration 1801A or the first engaged configuration 1801B through operation of the lock device 400.

Figure 19:
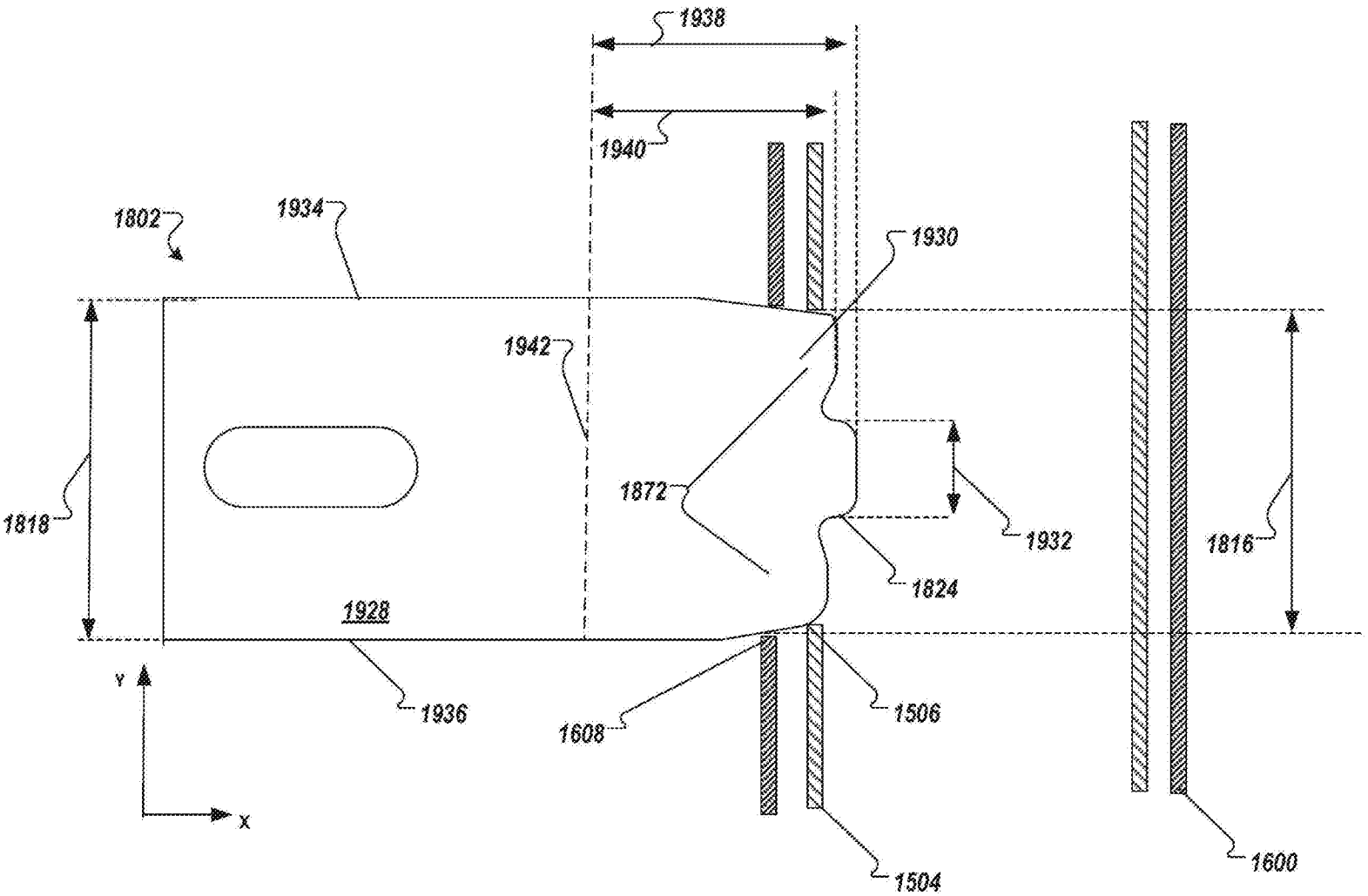
FIG. 19 depicts a detailed view of an exemplary multi-element lock tab engaged with an exemplary leg and an exemplary elongated structure.

FIG. 19 depicts a detailed view of the multi-element lock tab 1802 engaged with the leg 1600 and the elongated structure 1504, which may correspond to the second engaged configuration 1801C shown in FIG. 18C. Sectional views of the leg 1600 and the elongated structure 1504 are depicted in FIG. 19 such that the opening 1608 and the receiver 1506 are visible. The multi-element lock tab 1802 shown in FIG. 19 may include the first element 1824, the second element 1872, and a body 1928. The body 1928 may be generally the portion of the multi-element lock tab 1802 that extends into a lock device such as the lock device 400. In FIG. 19, a portion of the body 1928 is depicted. The body 1928 may include a top 1934, a bottom 1936, and an end 1930. The first element 1824 and the second element 1872 may be integrally formed with or may be features of the body 1928. The first element 1824 and the second element 1872 may be positioned at the end 1930 of the body 1928. The end 1930 may include the part of the body 1928 that is disposed in the opening 1608 and the receiver 1506.

The first element 1824 may extend from or may make up a part of the end 1930. In the embodiment of FIG. 19, the first element 1824 may be positioned in a central part of the body 1928. In other embodiments, the first element 1824 may be positioned on a lower portion (e.g., near or including the bottom 1936) or an upper portion (e.g., near or including the top 1934) of the end 1930 of the body 1928. The first element 1824 may include a first element height 1932. The first element height 1932 may include between about twenty-five percent (25%) and about fifty percent (50%) of the height 1818 of the multi-element lock tab 1802. The second element 1872 may make up a remaining part of the end 1930. For instance, the second element 1872 may include a portion of the end 1930 between the top 1934 and the first element 1824 and between the bottom 1936 and the first element 1824.

The first element 1824 and the second element 1872 may extend different distances from the end 1930. Extensions of the first element 1824 and the second element 1872 may enable the first element 1824 to be introduced into the receiver 1506 prior to the second element 1872. For example, in FIG. 19 a datum 1942 may be defined on the body 1928. The datum 1942 may be substantially parallel to the y-direction of FIG. 19. The first element 1824 may extend a first distance 1938 from the datum 1942. The second element 1872 may extend a second distance 1940 from the datum 1942. The second distance 1940 may be less than the first distance 1938.

In some embodiments, the top 1934 and/or the bottom 1936 may be sloped. For example, the top 1934 and/or the bottom 1936 may be sloped towards the first element 1824 near the end 1930. In other embodiments, the top 1934 and/or the bottom 1936 may be substantially planar or level. The multi-element lock tab 1802 may be sized relative to the opening 1608 and/or the receiver 1506. For instance, the multi-element lock tab 1802 may include a height 1818 that extends from the top 1934 to the bottom 1936. Similarly, the opening 1608 and the receiver 1506 may include a height 1816. The height 1816 may be substantially equivalent (e.g., within about 8%) the height 1818.

In the depicted embodiment, the opening 1608 and the receiver 1506 may include substantially equivalent heights (e.g., within about 8%) which are represented by height 1816. In some embodiments, a height of the opening 1608 may be greater than a height of the receiver 1506. In these and other embodiments, the height 1816 of the receiver 1506 may correspond to or be substantially equal to the height 1818. Additionally, in some embodiments, the height 1816 may be sized to correspond to a narrowed end of the multi-element lock tab 1802. For instance, the body 1928 may narrow near the end 1930. In these embodiments, the height 1816 may be sized to correspond to a height of the body 1928 near the end 1930.

Figure 20A:
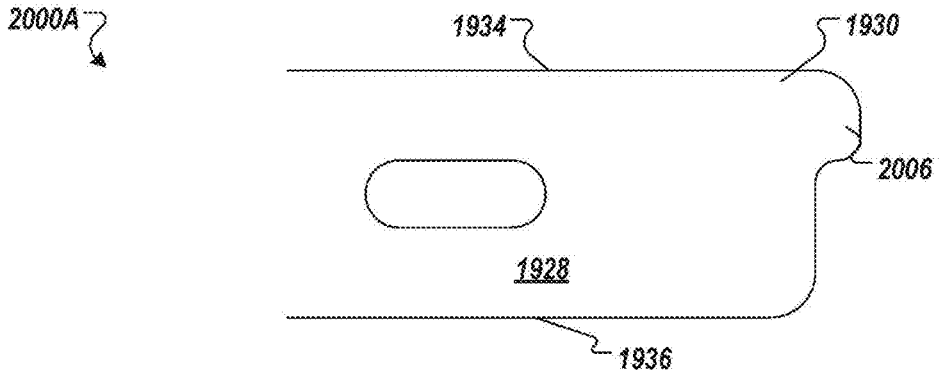
FIGS. 20A-20C depict exemplary multi-element lock tabs that may be implemented in the two-stage lock assembly of FIGS. 18A-18C.
Figure 20B:
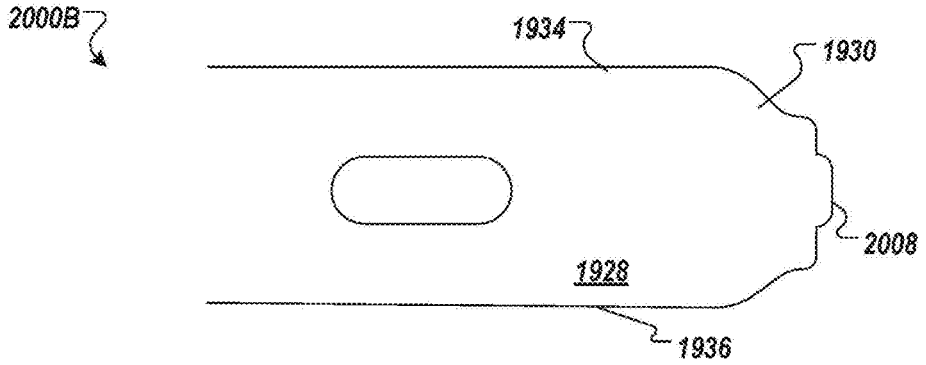
Figure 20C:
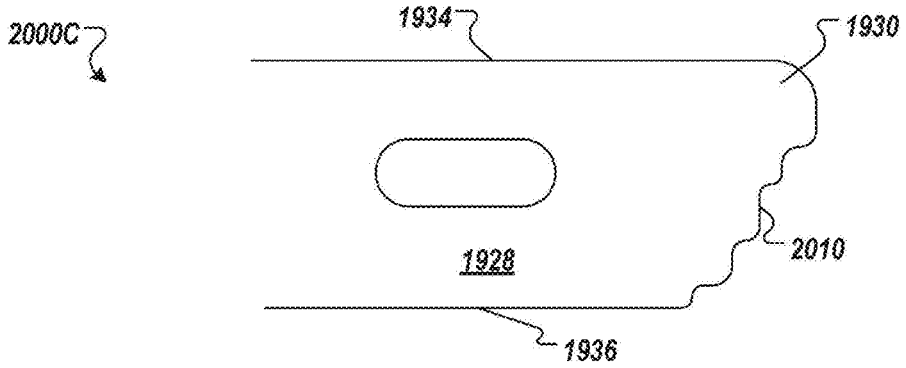

The particular geometry of the multi-element lock tab 1802 is not meant to be limiting. For instance, FIGS. 20A-20C depict alternative multi-element lock tabs 2000A-2000C that may be implemented in a lock assembly such as the two-stage lock assembly 1800 or a similar multi-stage lock assembly. Each of the multi-element lock tabs 2000A-2000C may include the body 1928, the top 1934, the bottom 1936, and the end 1930. Each of the multi-element lock tabs 2000A-2000C may include first elements on the first end 1930, which are different from the first element 1824 described above. For example, as shown in FIG. 20A, the first alternative lock tab 2000A may include a first element 2006. The first element 2006 may be positioned at or near the top 1934 of the body 1928. Positioning the first element 2006 at or near the top 1934 may lower the first engagement angle and may separate the first engagement angle from the second angle.

As shown in FIG. 20B, the second alternative lock tab 2000B may include a first element 2008. The first element 2008 may include two protrusive features. The two protrusive features may be positioned at or near a central portion of the body 1928. The first element 2008 may result in multiple engagement angles at which protrusive features are engaged in the receive 1506. Similarly, in FIG. 20C, the third alternative lock tab 2000C may include a first element 2010. The first element 2010 may include multiple protrusive features, which may be positioned at or near the top 1934 of the body 1928. The first element 2010 may result in multiple engagement angles at which protrusive features are engaged in the receive 1506.

For purposes of promoting an understanding of the present disclosure, reference will now be made to the following embodiments and specific language will be used to describe the same. It will nevertheless be understood that no limitation of the scope of the disclosure is thereby intended, such alterations and further modifications in the described subject matter, and such further applications of the disclosed principles as described herein being contemplated as would normally occur to one skilled in the art to which the disclosure relates.

The terms and words used in the following description and claims are not limited to the bibliographical meanings but are merely used to enable a clear and consistent understanding of the disclosure. It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

One of ordinary skill in the art may appreciate after reviewing this disclosure that the tables disclosed herein may have a number of different aspects, features, characteristics, and configurations. Further, a table may have any suitable number of aspects, features, characteristics, and configurations depending, for example, upon the intended use of the table.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:
- a tabletop;
- a frame attached to the tabletop; and
- a leg assembly comprising:
  - a support element rotatably coupled to the frame;
  - a translation mechanism retained relative to the support element and the frame, the translation mechanism configured to translate along a portion of the support element as the support element rotates relative to the frame
  - a receiver disposed in the support element; and
  - a two-stage lock assembly including a multi-element lock tab, the multi-element lock tab comprising:
    - a body;
    - a first element; and
    - a second element;
    - wherein, in a disengaged configuration, the translation mechanism is not fixed relative to the support element;
    - wherein, in a first use configuration the support element is rotated away from the tabletop a first amount, the translation mechanism is fixed relative to the support element in a first position with the first element positioned in the receiver and the second element is not positioned in the receiver;
    - wherein, in a second use configuration the support element is rotated away from the tabletop a second amount, the translation mechanism is fixed relative to the support element in a second position with the first element and the second element positioned in the receiver;
    - wherein, in the first use configuration, the support element is rotated away from the tabletop a first angle of at least about seventy degrees; and
    - wherein, in the second use configuration, the support element is rotated away from the tabletop a second angle of at least about eighty degrees.

2. The table of claim 1, wherein, in the disengaged configuration, the leg assembly is disposed between an angle of about zero degrees to a first engagement angle at which the first element is introduced to the receiver;
- wherein, in the first engaged configuration, the leg assembly is disposed at or between the first engagement angle and a second engagement angle; and
- wherein, in the second engaged configuration, the leg assembly is disposed at the second engagement angle.

3. The table of claim 1, wherein, in the first engaged configuration, the first element is disposed in the receiver and prevents an unintentional collapse of the tabletop when the lock assembly is not disposed in the second engaged configuration.

4. The table of claim 2, wherein the first engagement angle is between about 69 degrees and about 89 degrees; and wherein the second engagement angle is between about 88 degrees and about 95 degrees.

5. The table of claim 1, wherein the multi-element lock tab is outwardly biased such that when the leg assembly is rotated to a first engagement angle, the first element is disposed in the receiver; and wherein when the leg assembly is rotated to a second engagement angle, the second element is disposed in the receiver.

6. The table of claim 1, wherein in the first engaged configuration an opening in the leg assembly overlaps a lower portion of the receiver to enable the first element to move outwardly into the receiver.

7. The table of claim 6, wherein the opening includes a height that at least substantially corresponds to a height of at least a portion of the multi-element lock tab.

8. The table of claim 1, wherein the first element includes a first element height and the multi-element lock tab includes a second height; and wherein the first element height is between about twenty-five percent (25%) and about fifty percent (50%) of the second height.

9. The table of claim 1, wherein the first element forms at least a portion of a first portion of an end; and wherein the second element forms at least a portion of a second portion of the end, the first element and the second element disposed in a side-by-side configuration.

10. The table of claim 1, wherein the first element is disposed adjacent to the second element; and wherein the first element is positioned on a lower portion or an upper portion of the end.

11. The table of claim 1, wherein the first element is positioned on a lower portion or an upper portion of the end.

12. The table of claim 1, wherein a portion of the end is sloped towards the first element, the sloped portion extending from a side of the body to the first element.

13. The table of claim 1, wherein the first element includes two protrusive features.

14. The table of claim 1, wherein the first element is spaced apart from the second element by a gap.

15. A two-stage lock assembly configured to prevent structure collapse due to an insufficiently rotated leg assembly, the two-stage lock assembly comprising:

a multi-element lock tab configured for disposition in a lateral structure of a lock device, the multi-element lock tab including a body that includes an end on which a first element and a second element are disposed, wherein:

the multi-element lock tab is configurable in a disengaged configuration, a first engaged configuration, and a second engaged configuration;

the first element extends from the body farther than the second element to enable the first element to be introduced into a receiver prior to the second element; and the disengaged configuration occurs when the first element and the second element are not positioned in the receiver, the first engaged configuration occurs when the first element is positioned in the receiver and the second element is not positioned in the receiver, and the second engaged configuration occurs when the first and the second elements are positioned in the receiver;

wherein, in the disengaged configuration, the leg is disposed between an angle of zero degrees to a first engagement angle of seventy degrees at which the first element is introduced to a receiver;

wherein, in the first engaged configuration, the leg is disposed at or between the first engagement angle and a second engagement angle of ninety degrees; and wherein, in the second engaged configuration, the leg is disposed at the second engagement angle at which the second element enters the receiver.

16. The two-stage lock assembly of claim 15, wherein:

the first element includes a first element height and the multi-element lock tab includes a second height; and the first element height is between about twenty-five percent (25%) and about fifty percent (50%) of the second height.

17. The two-stage lock assembly of claim 15, wherein:

the first element makes up a first portion of the end; and the second element makes up a remaining part of the end, the first element disposed adjacent to the second element.

18. The two-stage lock assembly of claim 17, wherein:

the multi-element lock tab includes a top and a bottom; and the second element includes a portion of the end between the top and the first element and between the bottom and the first element, the first element and the second element disposed side-by-side.

19. A table comprising:

a tabletop;

a frame attached to the tabletop; and a leg assembly connected to the frame, the leg assembly comprising:

a support element rotatably coupled to the frame, the support element rotatable between a first position and a second position;

a translation mechanism translating along a portion of the support element as the support element rotates between the first position and the second position; and a two-stage lock assembly including a lock tab with a first element and a second element, the two-stage lock assembly including a disengaged configuration in which the translation mechanism is not fixed relative to the support element, a second engaged configuration in which the two-stage lock assembly fixes the translation mechanism relative to the support element, and a first engaged configuration in which the first element is positioned in a receiver in the support element and the second element is not positioned in the receiver;

wherein, in the disengaged configuration, the leg is disposed between an angle of zero degrees to a first engagement angle of seventy degrees at which the first element is introduced to a receiver;

wherein, in the first engaged configuration, the leg is disposed at or between the first engagement angle and a second engagement angle of ninety degrees; and wherein, in the second engaged configuration, the leg is disposed at the second engagement angle at which the second element enters the receiver.

* * * * *